US006397025B1

(12) United States Patent
Higeta et al.

(10) Patent No.: US 6,397,025 B1
(45) Date of Patent: May 28, 2002

(54) PROCESS CARTRIDGE REMANUFACTURING METHOD

(75) Inventors: Akira Higeta, Funabashi; Yoshiyuki Kakumi, Tuchiura, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/696,007

(22) Filed: Oct. 26, 2000

(30) Foreign Application Priority Data

Oct. 29, 1999 (JP) ..... 11-309102

(51) Int. Cl.[7] ..... G03G 15/00
(52) U.S. Cl. ..... 399/109; 399/103
(58) Field of Search ..... 399/109, 111, 399/113, 102, 103, 106

(56) References Cited

U.S. PATENT DOCUMENTS

| | | | | |
|---|---|---|---|---|
| 5,331,373 | A | 7/1994 | Nomura et al. | 399/111 |
| 5,452,056 | A | 9/1995 | Nomura et al. | 399/111 |
| 5,455,665 | A | 10/1995 | Baba et al. | 399/358 |
| 5,475,467 | A | 12/1995 | Watanabe et al. | 399/111 |
| 5,485,249 | A | 1/1996 | Higeta et al. | 399/105 |
| 5,502,547 | A | 3/1996 | Shirai | 399/102 |
| 5,528,341 | A | 6/1996 | Shishido et al. | 399/109 |
| 5,585,889 | A | 12/1996 | Shishido et al. | 399/113 |
| 5,697,021 | A | 12/1997 | Watanabe et al. | 399/102 |
| 5,740,499 | A | 4/1998 | Higeta et al. | 399/105 |
| 5,809,374 | A | 9/1998 | Tsuda et al. | 399/111 |
| 6,101,348 | A | 8/2000 | Nonaka et al. | 399/103 |

FOREIGN PATENT DOCUMENTS

| | | |
|---|---|---|
| JP | 3-249781 | 11/1991 |
| JP | 5-80601 | 4/1993 |
| JP | 6-195000 | 7/1994 |
| JP | 6-308819 | 11/1994 |
| JP | 7-92887 | 4/1995 |
| JP | 7-181857 | 7/1995 |
| JP | 7-219295 | 8/1995 |
| JP | 8-202242 | 8/1996 |
| JP | 8-305258 | 11/1996 |
| JP | 9-81013 | 3/1997 |
| JP | 11-24533 | 1/1999 |
| JP | 11-143225 | 5/1999 |
| JP | 11-237821 | 8/1999 |

*Primary Examiner*—Sophia S. Chen
(74) *Attorney, Agent, or Firm*—Fitzpatrick, Cella, Harper & Scinto

(57) ABSTRACT

A remanufacturing method of remanufacturing a process cartridge includes:

(a) a step of preparing a used process cartridge;

(b) a container separating step of separating the process cartridge into a toner developing container and a developing container by disengaging pins from the process cartridge, (c) a developing roller dismounting step of dismounting a developing roller from the toner developing container separated by the container separating step;

(d) a developing blade dismounting step of dismounting a developing blade from the toner developing container separated by the container separating step;

(e) a cut-away portion sealing step of sealing with a seal a cut-away portion of the toner developer container;

(f) a developing blade mounting step of mounting a developing blade on the toner developer container;

(g) a developing roller mounting step of mounting the developing roller on the toner developer container;

(h) a toner refilling step of refilling the toner into a toner accommodating portion of the toner developing container; and (i) a container coupling step of coupling the toner developing container having the seal, the developing blade and the developing roller with a cleaning container by engaging the pins into them.

29 Claims, 45 Drawing Sheets

PROCESS CARTRIDGE REMANUFACTURING METHOD

FIELD OF THE INVENTION AND RELATED ART

The present invention relates to a remanufacturing method for a process cartridge.

Here, the process cartridge is a cartridge containing at least a developing roller as developing means and an electrophotographic photosensitive member as a unit, the cartridge being detachably mountable to a main assembly of an electrophotographic image forming apparatus.

The electrophotographic image forming apparatus is an apparatus in which an image is formed on a recording material (recording paper, textile or the like) using an electrophotographic image forming process, and includes an electrophotographic copying machine, an electrophotographic printer (a LED printer, a laser beam printer and so on), an electrophotographic printer-type facsimile machine, an electrophotographic word processor, and the like.

In an electrophotographic image forming apparatus using an electrophotographic image forming process, a process cartridge is used, which integrally contains an electrophotographic photosensitive member and process means actable on the electrophotographic photosensitive member, the process cartridge being detachably mountable to the main assembly of the electrophotographic image forming apparatus. With this process cartridge type, the maintenance of the apparatus can be carried out in effect without service people. Therefore, the process cartridge type is widely used in the field of electrophotographic image forming apparatus.

Such a process cartridge forms an image on recording material with toner. Therefore, the toner is consumed in accordance with image forming operations. When the toner is consumed up to such an extent that the user is not satisfied with the image quality, the commercial value of the process cartridge is lost.

It is desired that such a used process cartridge be given commercial value again by remanufacturing the process cartridge through an easy method.

SUMMARY OF THE INVENTION

Accordingly, it is a principal object of the present invention to provide a remanufacturing method of a process cartridge.

It is another object of the present invention to provide a remanufacturing method of a process cartridge in which when the process cartridge is transported, the toner is prevented from leaking out.

It is a further object of the present invention to provide a remanufacturing method of a process cartridge wherein the process cartridge in which the toner is consumed to such an extent that the user is not satisfied with the image quality is recycled to be given a commercial value.

According to an aspect of the present invention, there is provided a remanufacturing method of remanufacturing a process cartridge comprising:

(a) a step of preparing a used process cartridge which comprises a toner developing container, a cleaning container and pins for coupling the toner developing container and the cleaning container at opposite longitudinal ends of the process cartridge, the toner developing container including a toner accommodating portion, a toner supply opening, a developing roller, and a developing blade, the toner developing container being provided adjacent the opposite ends with a cut-away portion for passing a laser beam for measuring a gap between the photosensitive drum and the developing roller;

the cleaning container including an electrophotographic photosensitive drum;

(b) a container separating step of separating the process cartridge into the toner developing container and the developing container by disengaging the pins from the process cartridge;

(c) a developing roller dismounting step of dismounting the developing roller from the toner developing container separated by the container separating step;

(d) a developing blade dismounting step of dismounting the developing blade from the toner developing container separated by the container separating step;

(e) a cut-away portion sealing step of sealing with a seal the cut-away portion of the toner developer container;

(f) a developing blade mounting step of mounting the developing blade on the toner developer container having the cut-away portion sealed with the seal mounted thereto;

(g) a developing roller mounting step of mounting the developing roller on the toner developer container having the cut-away portion sealed with the seal mounted thereto;

(h) a toner refilling step of refilling the toner into the toner accommodating portion of the toner developing container having the seal, the developing blade and the developing roller; and (i) a container coupling step of coupling the toner developing container having the seal, the developing blade and the developing roller with the cleaning container by engaging the pin into them.

According to another aspect of the present invention, there is provided a remanufacturing method of remanufacting a process cartridge comprising:

(a) a step of preparing a used process cartridge which comprises a toner developing container, a cleaning container and pins for coupling the toner developing container and the cleaning container at opposite longitudinal ends of the process cartridge, the toner developing container including a toner accommodating portion, a toner supply opening, a developing roller and a developing blade, the toner developing container being provided adjacent the opposite ends with a cut-away portion for passing a laser beam for measureing a gap between the photosensitive drum and the developing roller;

the cleaning container including an electrophotographic photosensitive drum;

(b) a container separating step of separating the process cartridge into the toner developing container and the developing container by disengaging the pins from the process cartridge:

(c) a developing roller dismounting step of dismounting the developing roller from said toner developing container separated by the container separating step;

(d) a developing blade dismounting step of dismounting the developing blade from the toner developing container separated by the container separating step;

(e) a cut-away portion sealing step of sealing with a seal the cut-away portion of the toner developer container;

(f) a flexible sheet mounting step of mounting a flexible sheet to the toner developing container having the cut-away portion so as to extend along the longitudinal direction of the developing roller when the developing roller is mounted to the toner developing container;

(g) first and second side seal mounting steps of mounting a first side seal continuously on a longitudinal end of the flexible sheet mounted on the toner developing container having the cut-away portion and the toner developing container having the cut-away portion, and mounting a second side seal continuously on the other longitudinal end of the flexible sheet and the toner developing container having the cut-away portion;

(h) a developing blade mounting step of mounting the developing blade on the toner developer container having the cut-away portion sealed with the seal mounted thereto;

(i) a developing roller mounting step of mounting the developing roller on the toner developer container having the cut-away portion sealed with the seal mounted thereto;

(j) a toner refilling step of refilling the toner into the toner accommodating portion of the toner developing container having the seal, the developing blade and the developing roller; and (k) a container coupling step of coupling the toner developing container having the seal, the developing blade and the developing roller with the cleaning container by engaging the pin into them.

According to a further aspect of the present invention, there is provided a remanufacturing method of remanufacting a process cartridge comprising:

(a) a step of preparing a used process cartridge which comprises a toner developing container, a cleaning container and pins for coupling the toner developing container and the cleaning container at opposite longitudinal ends of said process cartridge, the toner developing container including a toner accommodating portion, a toner supply opening, a developing roller and a developing blade, the toner developing container being provided adjacent the opposite ends with a cut-away portion for passing a laser beam for measuring a gap between photosensitive drum and the developing roller;

the cleaning container including an electrophotographic photosensitive drum;

(b) a container separating step of separating the process cartridge into the toner developing container and the developing container by disengaging the pins from the process cartridge:

(c) a developing roller dismounting step of dismounting the developing roller from the toner developing container separated by the container separating step;

(d) a developing blade dismounting step of dismounting the developing blade from the toner developing container separated by the container separating step;

(e) a cut-away portion sealing step of sealing with a seal the cut-away portion of the toner developer container;

(f) a developing blade mounting step of mounting the developing blade on the toner developer container having the cut-away portion sealed with the seal mounted thereto;

(g) a developing roller mounting step of mounting the developing roller on the toner developer container having the cut-away portion sealed with the seal mounted thereto;

(h) a toner refilling step of refilling the toner into the toner accommodating portion of the toner developing container having the seal, the developing blade and the developing roller, through the toner supply opening of the toner developing container having the seal; and (i) a container coupling step of coupling the toner developing container having the seal, the developing blade and the developing roller with the cleaning container by engaging the pin into them.

According to a further aspect of the present invention, there is provided a remanufacturing method of remanufacting a process cartridge comprising:

(a) a step of preparing a used process cartridge which comprises a toner developing container, a cleaning container and pins for coupling the toner developing container and the cleaning container at opposite longitudinal ends of the process cartridge, the toner developing container including a toner accommodating portion, a toner supply opening, a developing roller and a developing blade, the toner developing container being provided adjacent the opposite ends with a cut-away portion for passing a laser beam for measuring a gap between the photosensitive drum and the developing roller;

the cleaning container including an electrophotographic photosensitive drum;

(b) a container separating step of separating the process cartridge into the toner developing container and the developing container by disengaging the pins from the process cartridge;

(c) a developing roller dismounting step of dismounting the developing roller from the toner developing container separated by the container separating step;

(d) a developing blade dismounting step of dismounting the developing blade from the toner developing container separated by the container separating step;

(e) a cut-away portion sealing step of sealing with a seal the cut-away portion of the toner developer container;

(f) a flexible sheet mounting step of mounting a flexible sheet to the toner developing container having the cut-away portion so as to extend along the longitudinal direction of the developing roller when the developing roller is mounted to the toner developing container;

(g) first and second side seal mounting steps of mounting a first side seal continuously on a longitudinal end of the flexible sheet mounted on the toner developing container having the cut-away portion and the toner developing container having the cut-away portion, and mounting a second side seal continuously on the other longitudinal end of said flexible sheet and the toner developing container having the cut-away portion;

(h) a developing blade mounting step of mounting the developing blade on the toner developer container having the cut-away portion sealed with the seal mounted thereto;

(i) a developing roller mounting step of mounting the developing roller on the toner developer container having the cut-away portion sealed with the seal mounted thereto;

(j) a toner refilling step of refilling the toner into the toner accommodating portion of the toner developing container having the seal, the developing blade and the developing roller, through the toner supply opening of the toner developing container having the seal; and (k) a container coupling step of coupling the toner developing container having the seal, the developing blade and the developing roller with the cleaning container by engaging the pin into them.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The preferred embodiments of the present invention will be described in conjunction with the accompanying drawing us.

A description will be provided first as to the general arrangements of an image forming apparatus and the process cartridge according to an embodiment of the present invention and then as the manufacturing method of the process cartridge. A description will be provided then as to the steps of disassembling and reassembling of the process cartridge and as to the reassembled process cartridge.

The remanufacturing of the process cartridge from which the toner has been used up is disassembled into a toner developing container and a cleaner container, and the toner developing container is partly disassembled, and they are reassembled to provide a process cartridge having the toner developing container which is similar in function to a new process cartridge but has a partly different structure from a new process cartridge.

Referring to FIGS. 1 to 5, a description will be provided as to the process cartridge and an image forming apparatus to which the process cartridge is detachably mountable. A description will be provided as to the general arrangements of the process cartridge and the image forming apparatus, and then as to the structure of the cartridge frames and further as to the coupling of the frames.

(General Arrangement)

Figure 1:
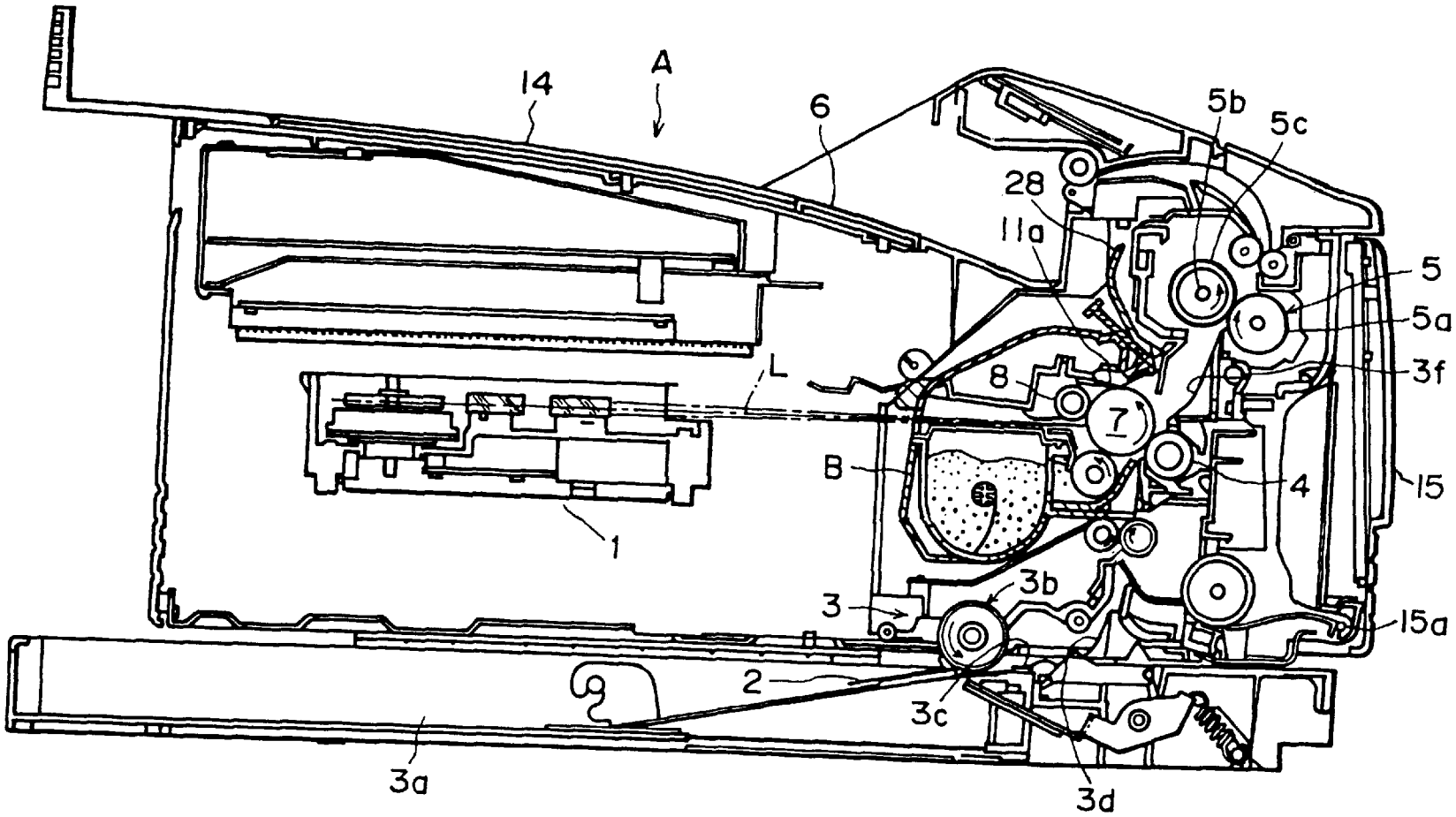
FIG. 1 is a longitudinal sectional view of an electrophotographic image forming apparatus.

The image forming apparatus in this embodiment is an electrophotographic image forming apparatus (laser beam printer) A, as shown in FIG. 1, wherein an electrophotographic photosensitive member in the form of a drum is exposed to information light modulated in accordance with image information from an optical system 1, so that a latent image is formed on the photosensitive member, and the latent image is developed into a toner image. In synchronism with the formation of the toner image, the recording material 2 is fed out, one by one, from a sheet feeding cassette 3*a* using a pick-up roller 3*b* and separation claws 3*c* press-contacted at the comers of the top surface of the recording material 2, and the sheet is fed by feeding means 3 including a feeding path 3*d* and a pair of registration rollers. The toner image formed on the electrophotographic photosensitive member in the process cartridge B is transferred onto the recording material 2 by applying a voltage to transfer means in the form of a transfer roller 4, and then the recording material 2 is fed to fixing means 5 on a feeding path 3*f*. The fixing means 5 comprises a driving roller 5*a* and a fixing roller 5*c* containing a heater 5*b* therein, and pressure and heat are imparted to the recording material 2 which is passing therethrough, by which the transferred toner image is fixed on the recording material. The recording material 2 is further fed by discharging rollers, and is discharged to a discharging portion 6 through a reverse feeding path.

Figure 4:
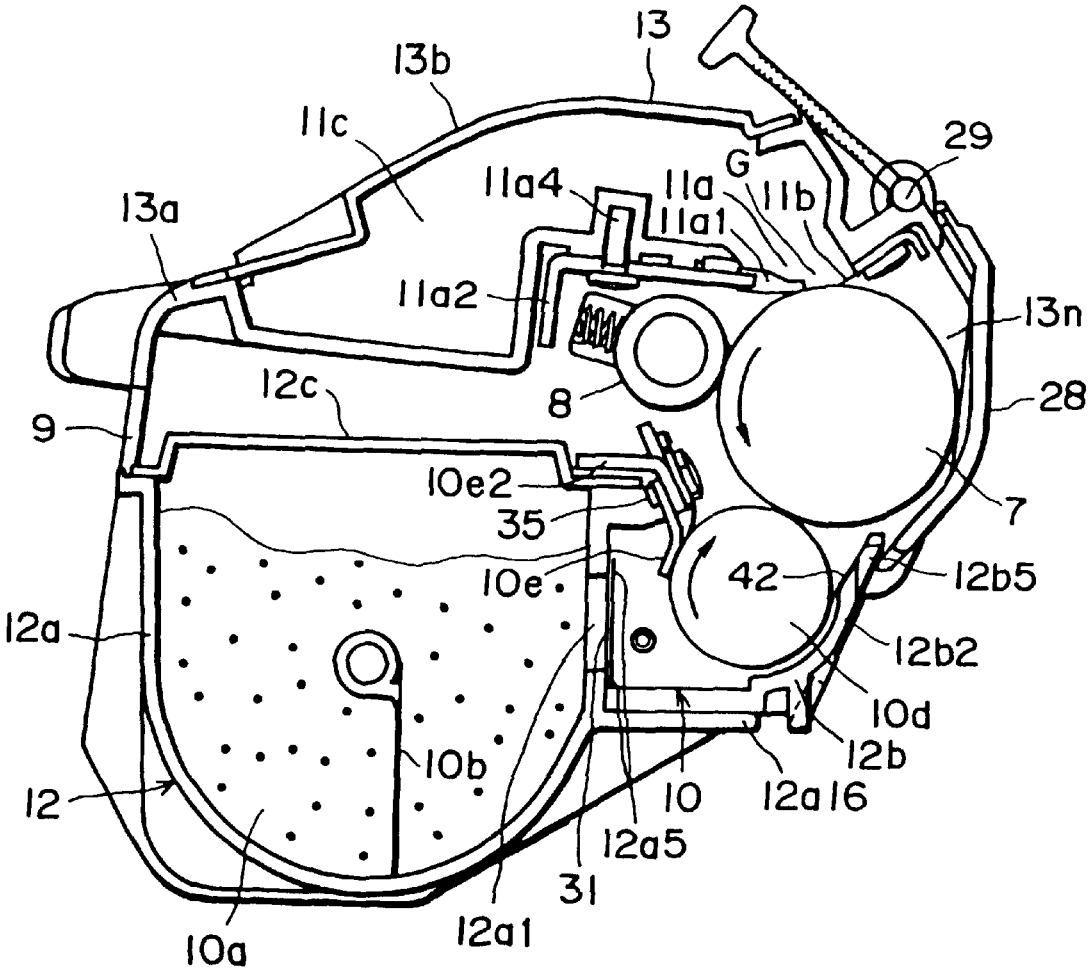
FIG. 4 is a longitudinal sectional view of a process cartridge.

On the other hand, the process cartridge B contains the electrophotographic photosensitive member and at least one process means. Here, the process means includes charging means for electrically charging the electrophotographic photosensitive member, the developing means for developing a latent image formed on the electrophotographic photosensitive member, and cleaning means for cleaning the surface of the electrophotographic photosensitive member to remove residual toner. As shown in FIG. 4, in the process cartridge B of this embodiment, the electrophotographic photosensitive member in the form of an electrophotographic photosensitive drum 7 having a photosensitive layer is rotated, and a voltage is applied on the charging roller 8, which is the charging means, so that the surface of the photosensitive drum 7 is uniformly charged, and the photosensitive drum 7 is exposed to image light from the optical system 1 through an opening 9, by which an electrostatic latent image is formed, and the image is developed by developing means 10.

In the developing means 10, the toner in a toner accommodating portion 10*a* is fed out by feeding means in the form of a rotatable toner feeding member 10*b*, and a developing roller 10*d* containing therein a stationary magnet is rotated, by which a layer of toner particles triboelectrically charged by the developing blade 10*e* is formed on the surface of the developing roller 10*d*. The toner is selectively transferred onto the photosensitive drum 7 so that a toner image is formed. The developing roller 10*d* functions to supply the toner to the photosensitive drum 7. The developing blade 10*e* functions to regulate a thickness of the toner layer on the surface of the developing roller 10*d*.

The transfer roller 4 is supplied with a voltage having a polarity opposite from the polarity of the toner image, by which the toner image is transferred onto the recording material 2. Thereafter, the residual toner remaining on the photosensitive drum 7 is scraped off by the cleaning blade 11*a*, and the removed toner is received by a receptor sheet 11*b*, and the received toner is collected into a removed toner accommodating portion 11*c*.

(Cartridge Mounting Means)

Various parts, such as photosensitive drum 7, are supported and accommodated in a cartridge frame which is provided by coupling the toner developing container 12 and the cleaner container 13. The cartridge is mounted to the main assembly 14 of the apparatus.

Figure 2:
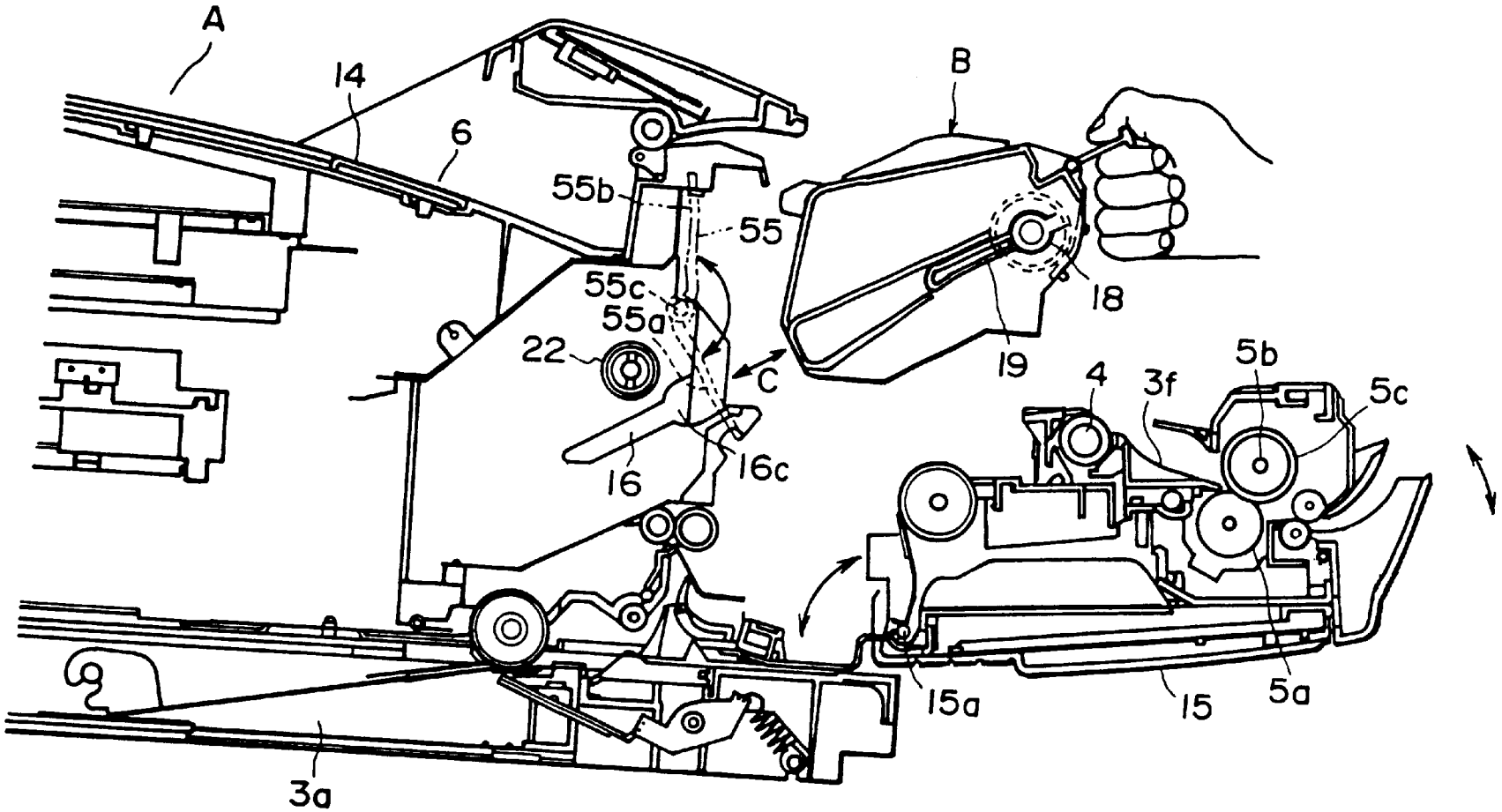
FIG. 2 is a longitudinal sectional view of an electrophotographic image forming apparatus.
Figure 3:
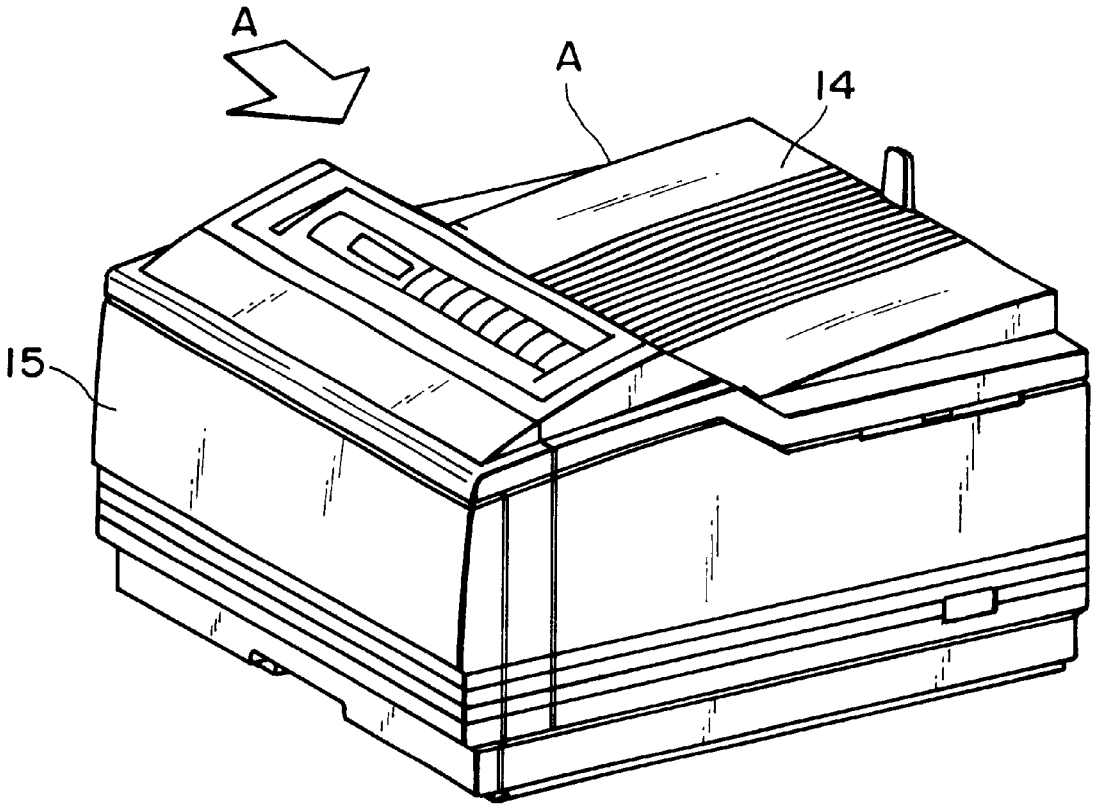
FIG. 3 is a perspective view of an electrophotographic image forming apparatus.

In the cartridge mounting means, when the cover member 15 is opened by rotating it about the shaft 15*a* (FIGS. 1, 2), there are guide grooves 16 inclined toward the rear side at each of the left and right sides of the cartridge mounting space as shown in FIG. 2. The guide grooves 16 are disposed substantially symmetrically and are substantially linear. At the inlet side of the guide grooves 16 there is provided a positioning portion 16*c* (main assembly side positioning portion 16*c*).

Figure 5:
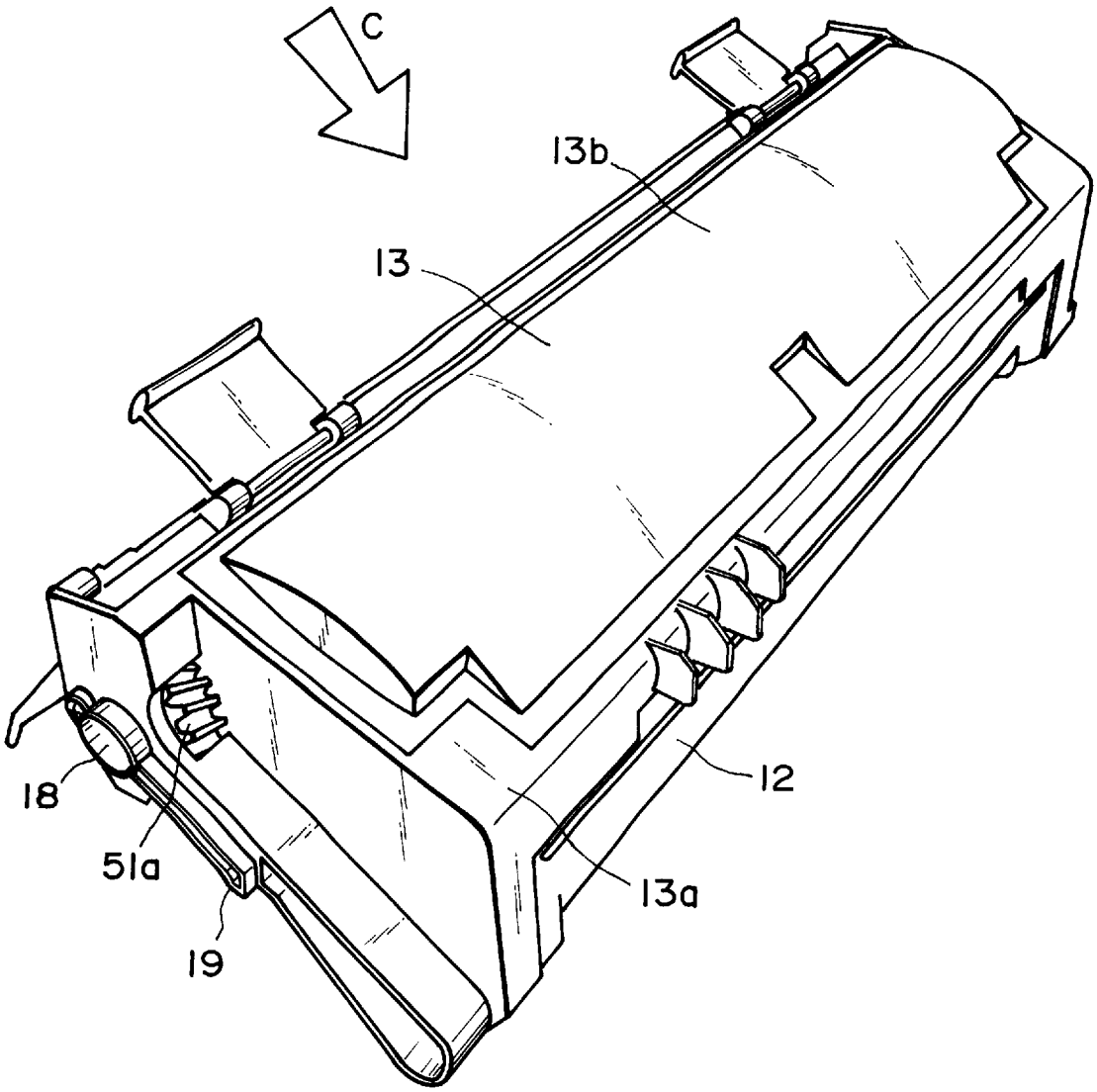
FIG. 5 is a perspective view of a process cartridge.
Figure 6:
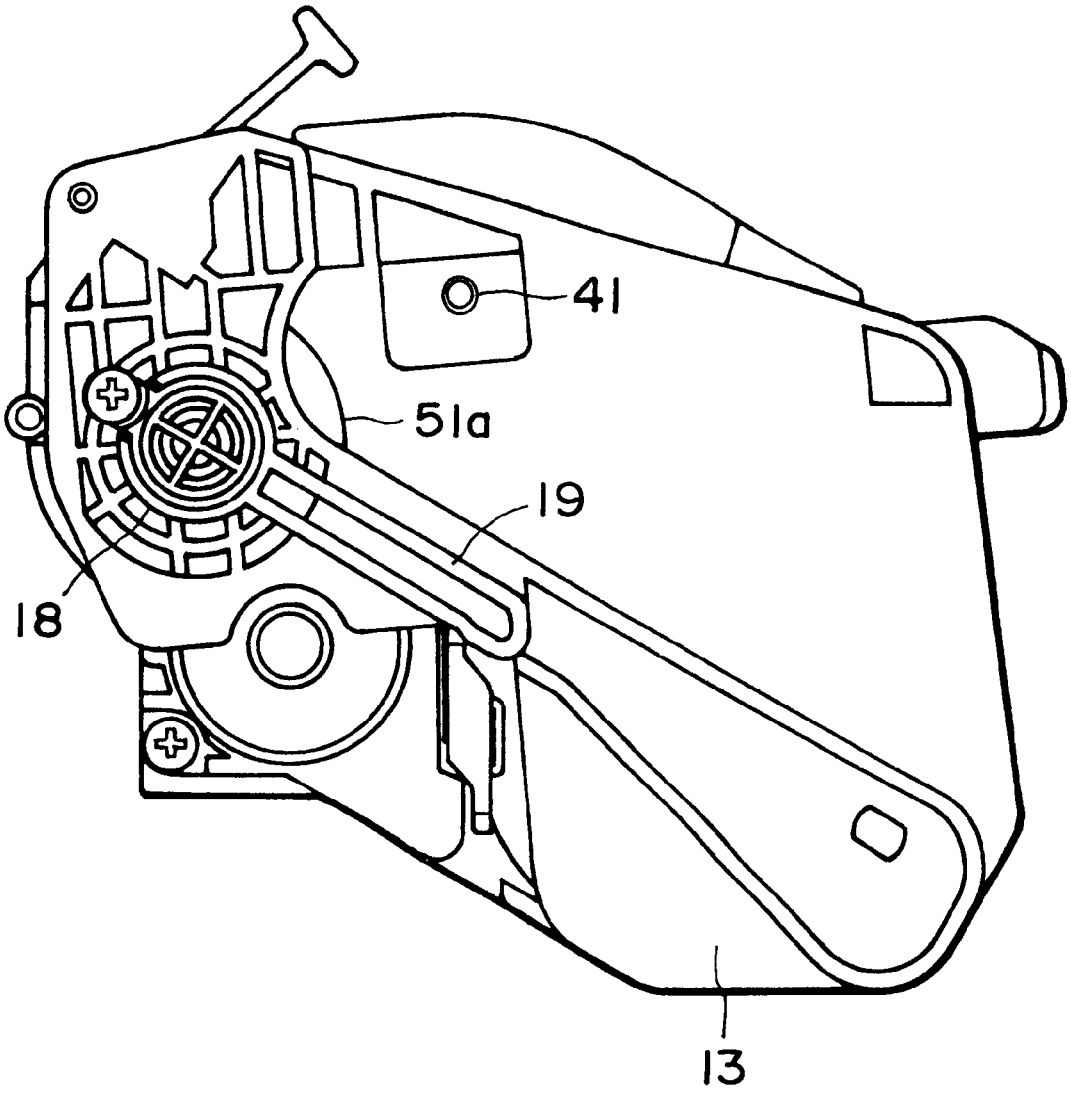
FIG. 6 is a side view of a process cartridge.

On the other hand, at the opposite outer ends of the process cartridge, there are provided guide portions correspondingly to the guide grooves 16 to be guided by the guide groove 16. The guide portions are projected substantially symmetrically at the opposite longitudinal ends, respectively. As shown in FIG. 5, it comprises a boss 18 and a rib 19 which are integral. The boss 18 and the rib 19 are integrally formed with the cleaner container 13 to which the photosensitive drum 7 is mounted, and the boss 18 is disposed on an extension of a rotational axis of the photosensitive drum 7, and the rib 19 is extended from the boss 18 in an inserting direction of the process cartridge B as indicated by an arrow C in FIG. 5. The rib 19 extends inclined downwardly in conformity with the guide groove 16.

With this structure, when the process cartridge is to be mounted to the main assembly, as shown in FIG. 2, the cover member 15 is open, and the ribs 19 are engaged into the guide grooves 16, and then, the process cartridge B is inserted into the main assembly 14 of the apparatus. With the insertion, the process cartridge B makes a translational motion, that is, a linear motion inclined downward. When the process cartridge B is further inserted, the boss 18 of the process cartridge B is seated on the main assembly side positioning portion 16c in the inlet of the guide groove 16. Simultaneously, the free end 19*a* of the rib 19 is abutted to a stopper surface 16*a* of the guide groove 16 by a moment about the boss 18 produced by the weight of the process cartridge B. The gravity center of the process cartridge B is at rib 19 side of the boss 18. Thus, the drum gear 51*a* (FIG. 5) fixed to an end of the photosensitive drum 7 is brought into meshing engagement with a driving gear 22 (FIG. 2) provided in the main assembly 14, so that the driving force can be transmitted to the process cartridge B.

Figure 10:
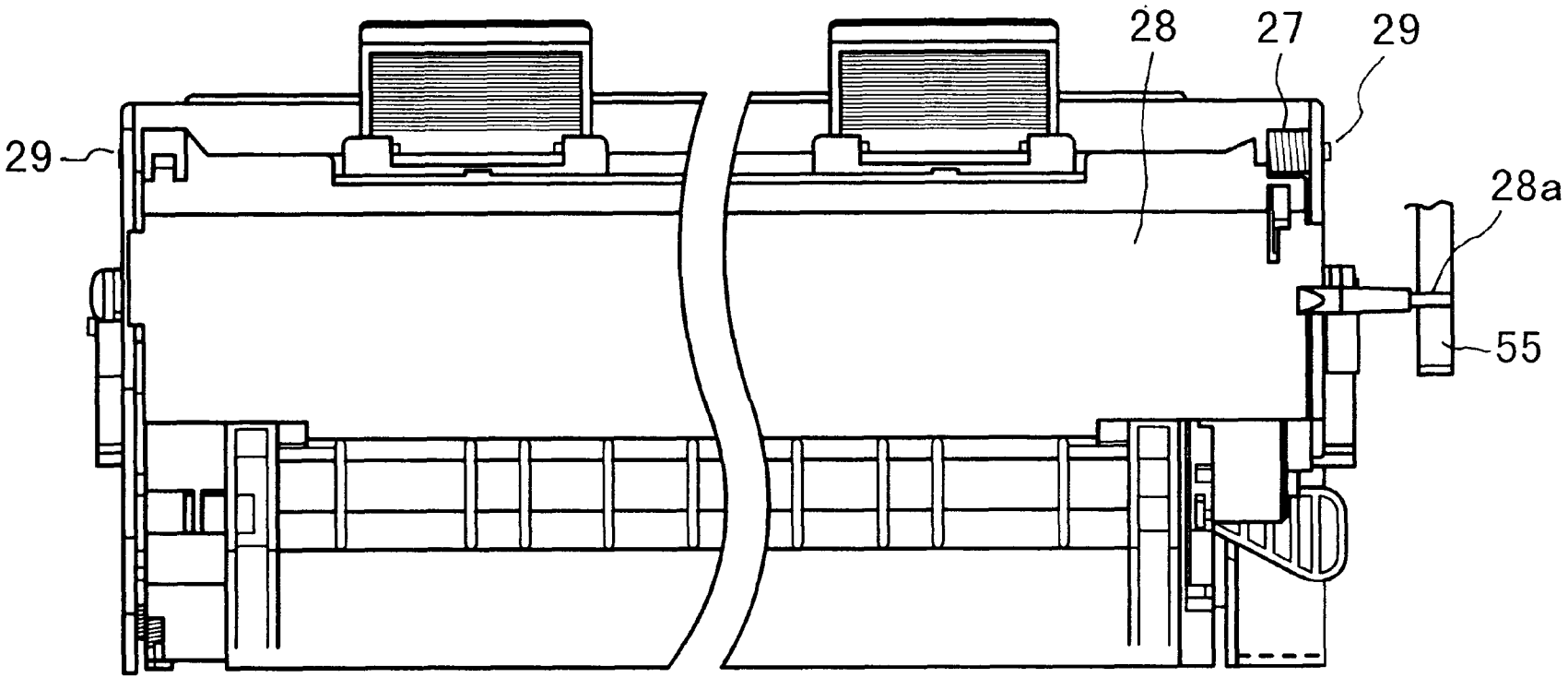
FIG. 10 is a top plan view of a process cartridge.

Then, the cover member 15 is closed, by which the shutter opening lever 55, which is interrelated with the cover member 15 is rotated in the clockwise direction about the shaft 55*c* from a position 55*a* to a position 55*b*, so that it is engaged with a pin 28*a* provided on the drum shutter member 28 as shown in FIG. 10, and the drum shutter member 28 is opened about a pin 29 mounted to the cleaner container 13 against a spring force of a spring 27, thus opening a transfer opening 13*n*. The coil spring 27 is fitted around the pin 29, and one end thereof is engaged to the cleaner container 13, and the other end is engaged to the drum shutter member 28, and therefore, when the cover member 15 is open or when the process cartridge B is outside the main assembly 14, the drum shutter member 28 closes the transfer opening 13*n* by the spring force of the coil spring 27.

When the process cartridge B is to be taken out, the cover member 15 is opened, which the shutter opening lever 55 is rotated about the shaft 55*c* to return from the position 55*b* to the position 55*a*. Then, drum shutter member 28 rotates about the pin 29 by the spring force of the coil spring 27, thus closing the transfer opening 13*n*. The process cartridge B is pulled up such that in the boss 18 is away from the positioning portion 16*c*, and thereafter, the process cartridge B is further pulled up such that ribs 19 are guided by the guide grooves 16.

(Structure of Cartridge Frame)

A description will be provided as to the structure of the cartridge frame. The cartridge frame is made of polystyrol resin material by injection molding, and as shown in FIG. 4, a lower developing frame 12*b* is welded to a side of the developing device frame 12*a*, and a cap member 12*c* is welded to the upper portion, thus constituting a toner developing container 12. A cap member 13*b* is welded to a top of a cleaning frame 13*a* to constitute an integral cleaner container 13. Then, the cleaner container 13 is coupled with the toner developing container 12 to constitute a cartridge frame.

Figure 13:
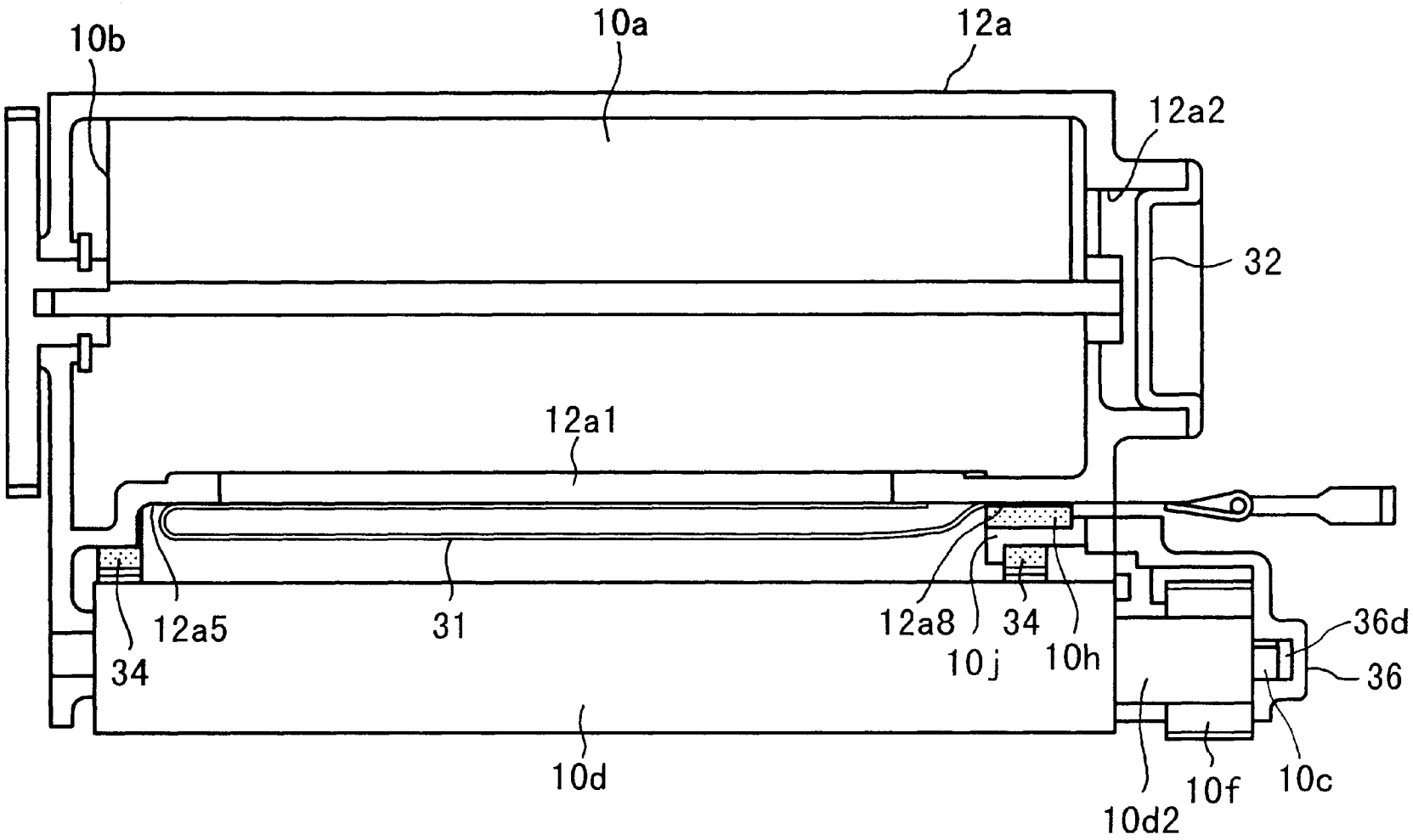
FIG. 13 is a horizontal sectional view of a toner developing container.

The developing device frame 12*a* is provided at an end thereof with a toner supply opening 12*a*1, as shown in FIG. 13, 14, is also provided at one longitudinal end with a toner filling opening 12*a*2. The developing device frame 12*a* is provided therein with a plurality of erected supporting members (not shown) in the longitudinal direction. The toner supply opening 12*a*1 permits supply of the toner from the toner accommodating portion 10*a* to the developing roller 10*d*. The toner in the toner accommodating portion 10*a* is supplied to the developing roller 10*d* through the toner supply opening 12*a*1.

When the developing means is mounted in place, as shown in FIGS. 4, 13, a toner feeding member 10*b* is mounted in the developing device frame 12*a*, and thereafter, the cap member 12*c* is welded to the developing device frame 12*a*. Subsequently, a toner seal 31 in the form of a film is welded on a surface 12*a*5 of the seat formed around the circumference of the toner supply opening 12*a*1 of the toner developing container 12 to seal the opening 12*a*1. Then, the toner is filled through the toner filling opening 12*a*2, and thereafter, the filling opening 12*a*2 is plugged by a cap 32 to seal the toner accommodating portion 10*a*. The toner seal 31 sealing the toner supply opening 12*a*1, as shown in FIG. 13, is folded back at one longitudinal end of the opening 12*a*1, and the free end thereof is extended out through a slit 12*a*8 of the developing device frame 12*a*. The free end of the toner seal 31 is nipped by fingers of the user and is pulled out when the user starts use of the process cartridge B.

When it is pulled out, the sealing is not complete at the portion where the toner seal 31 extends through the toner developing container 12.

Therefore, as shown in FIG. 13, an elastic sealing material 10*h* such a felt is provided in the slit 12*a*8 at an end, closer to the fee end, of the toner seal 31.

As shown in FIG. 13, the elastic sealing material 10*h* is overlaid on the toner seal 31 and urges the toner seal 31. Therefore, when the toner seal 31 is pulled out, the elastic sealing material 10*h* occupies the slit 12*a*8 which has been occupied by the toner seal 31 to be press-contacted to a wall of the developing device frame 12*a*, thus preventing leakage of the toner to the outside.

Figure 15:
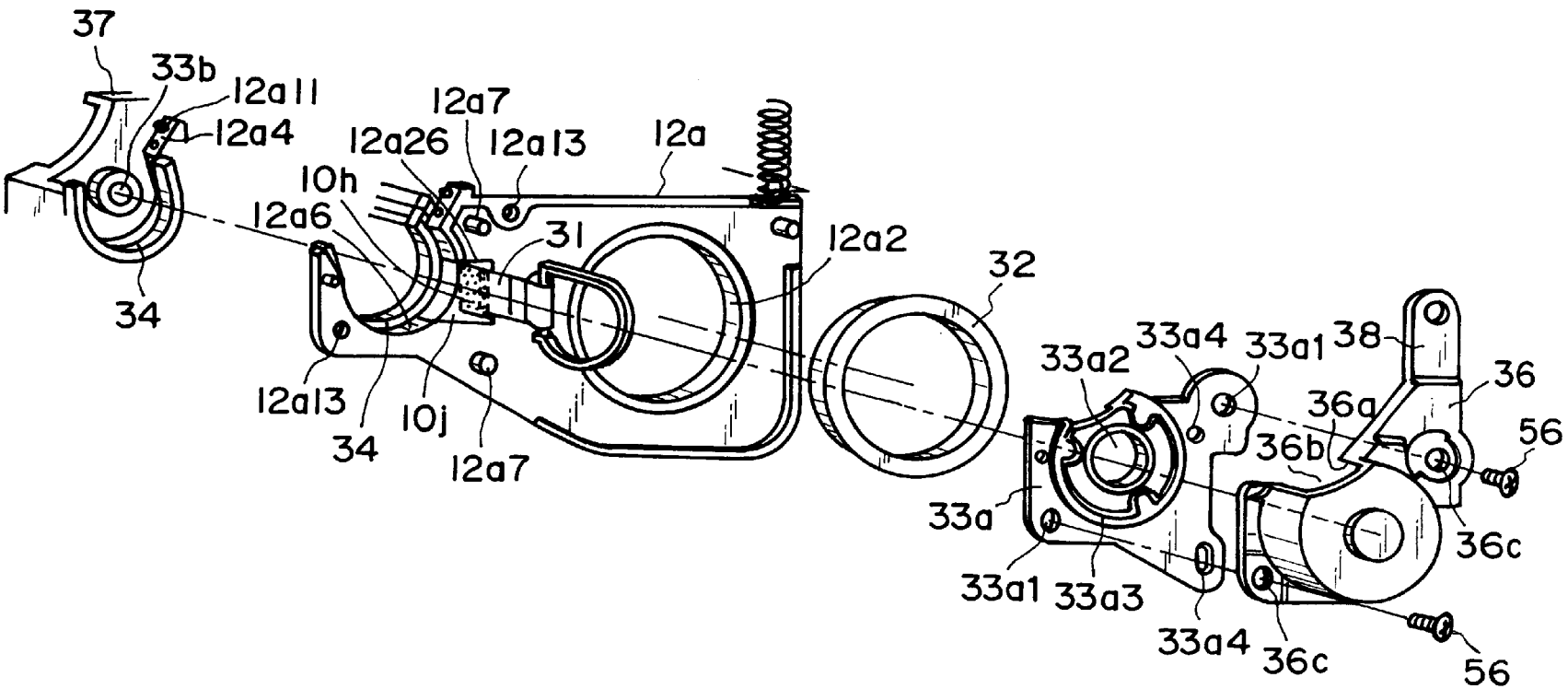
FIG. 15 is an exploded perspective view of supporting means for the developing roller.

A description will be provided as to the mounting of the elastic sealing material 10*h*. As shown in FIG. 15, a part of the arcuate portion 12*a*6 of the developing device frame 12*a* is provided with an angle groove 12*a*26 extending in the longitudinal direction. The bottom of the angle groove 12*a*26 is flush with the toner seal sticking seat surface 12*a*5. An elastic sealing material 10*h* such as a felt or the like is stuck on a piece 10*j* engaged in the angle groove 12*a*26.

With this structure, even when the toner seal 31 is pulled out, the toner is prevented from leaking to the outside of the toner developing container 12 through the slit 12*a*8.

Figure 8:
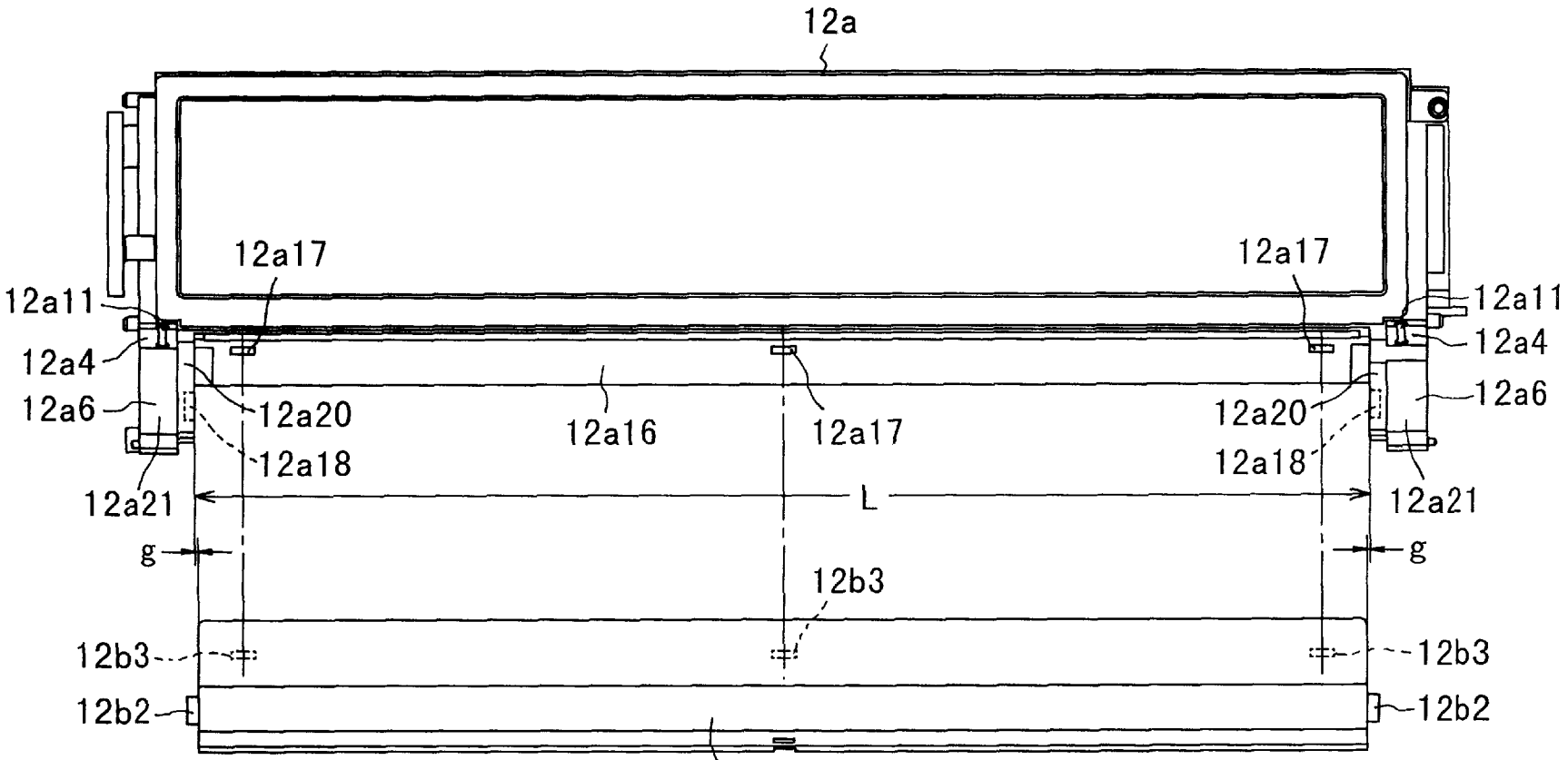
FIG. 8 is a top plan view of a frame of a toner developing container.
Figure 9:
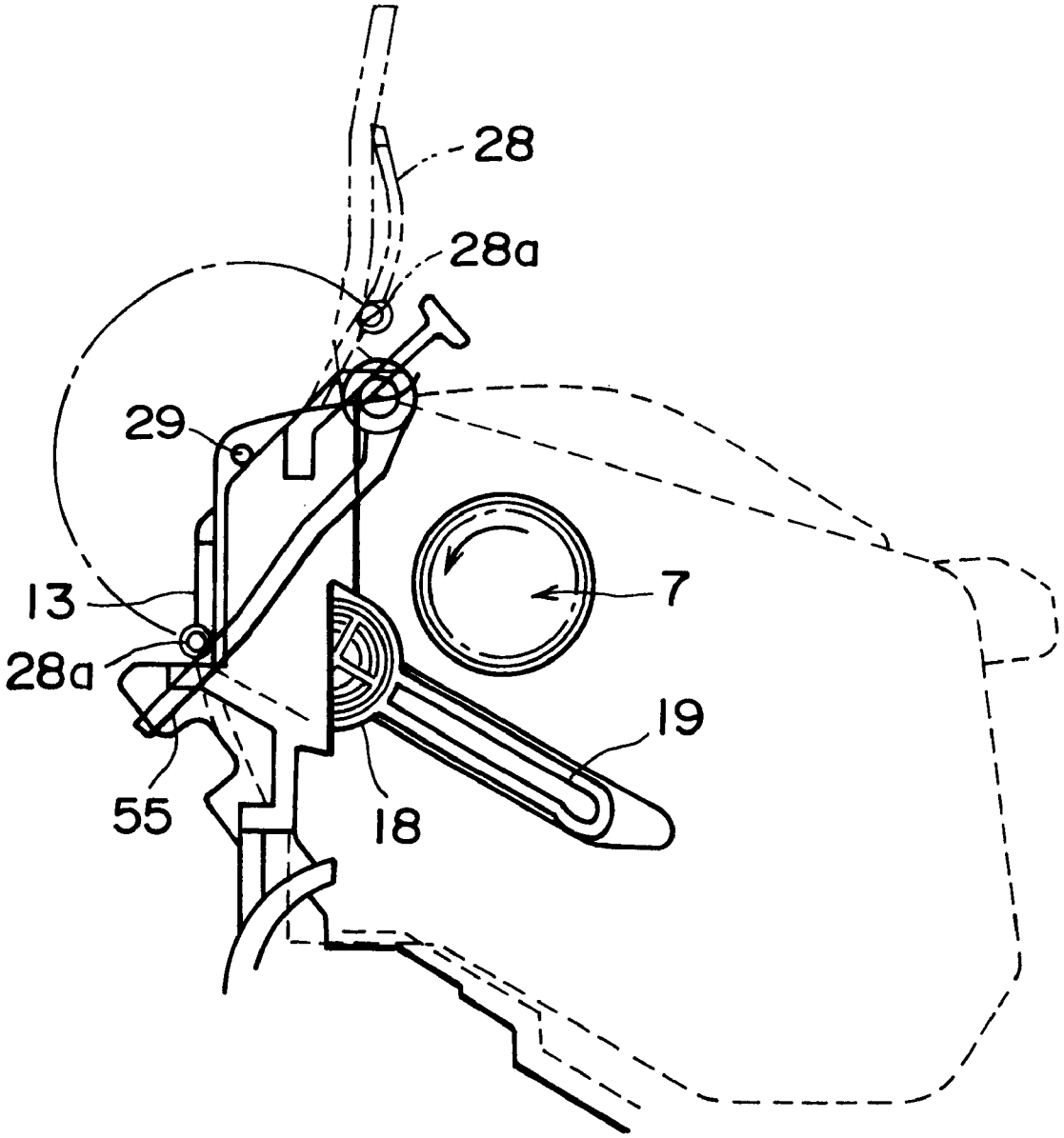
FIG. 9 is a side view of a drum shutter.

Then, the lower developing frame 12*b* is welded to the developing device frame 12*a*. As shown in FIG. 8, the developing device frame 12*a* is provided at the opposite longitudinal ends of the toner supply opening 12*a*1 with arcuate portions 12*a*6 at which the end seals 34 are to be mounted. A flat flange 12*a*16 is extended between the arcuate portions 12*a*6 below the seal sticking seat surface 12*a*5, and the flange 12*a*16 is substantially perpendicular to the seal sticking seat surface 12*a*5. On the other hand, lower developing frame 12*b* is engaged with the longitudinally opposing surfaces of the arcuate portions 12*a*6. Therefore, in concentration of manufacturing errors, the lower developing frame 12*b* has a length which is smaller than the distance between the opposing surfaces of the arcuate portion 12*a*6 by 2×g where g is a gap at each ends. The flange 12*a*16 is provided with holes 12*a*17, and the lower developing frame 12*b* is provided with dowels 12*b*3 for engagement with the holes 12*a*17, respectively. With the dowels 12*b*3 being in engagement with the respective hole 12*a*17, the bottom surface of the lower developing frame 12*b* and the top surface of the flange 12*a*16 of the developing device frame 12*a* are welded to each other. By doing so, gap g is formed between the arcuate portion 12*a*6 and the lower developing frame 12*b* at each end. The dimension of the gap g is not constant when the lower developing frame 12*b* is fixed to the developing device frame 12*a*.

When the lower developing frame 12*b* is engaged with the developing device frame 12*a*, a sealing material 39 such as a felt is inserted between the developing device frame 12*a* and each of the longitudinal opposite ends of the lower developing frame 12*b*.

Figure 20:
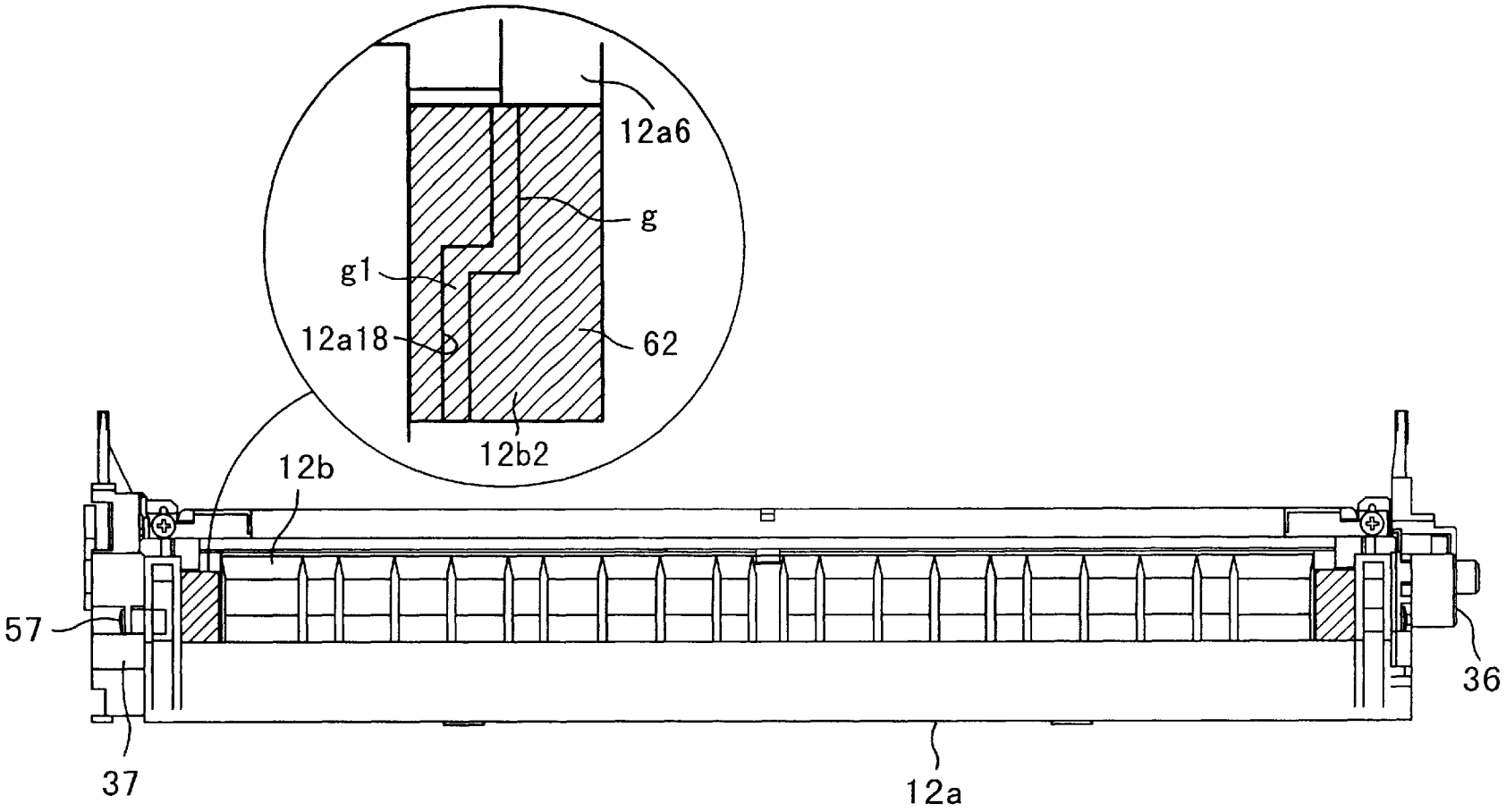
FIG. 20 is a front view of a toner developing container as seen in the direction opposite from the mounting direction of the process cartridge.

Each of the opposite ends of the lower developing frame 12*b* is provided with an outward projection 12*b*2 (FIG. 8). The developing device frame 12*a* is provided at each of the end portions with a recess 12*a*18 for engagement with a projection 12*b*2 when the dowels 12*b*3 are engaged with the holes 12*a*17 for the purpose of welding or bonding of the lower developing frame 12*b*. As shown in FIG. 20, a gap g1 is provided between the recess 12*a*18 and the projection 12*b*2. The gap is substantially equal to the gap g formed between the lower developing frame 12*b* and the arcuate portion 12*a*6.

As shown in FIG. 8, the arcuate portion 12*a*6 of the developing device frame 12*a* is provided with a sticking portion 12*a*20 to which the end seal 34 is stuck. The sticking portion 12*a*20 has an arcuate peripheral surface having a common axis with the arcuate portion 12*a*21 provided longitudinally outside of the arcuate portion 12*a*6. The axis is the rotational axis of the developing roller 10*d* in the toner developing container 12. The sticking portion 12*a*20 is provided with an arcuate surface having a radius which is smaller than that of the outer arcuate portion 12*a*21. An end of the sticking portion 12*a*20, as shown in FIG. 8, ends short of (inside) the circumference of the outer arcuate portion 12*a*21.

Figure 17:
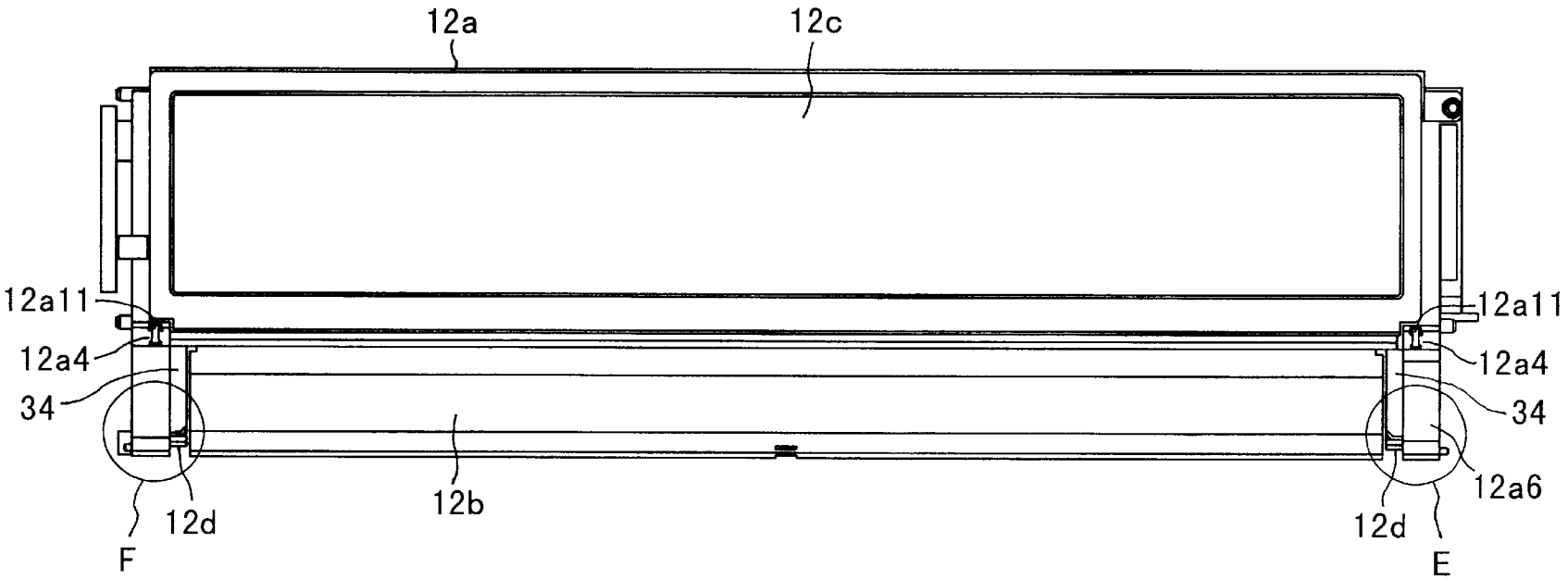
FIG. 17 is a top plan view of a toner developing container from which the developing roller and the developing blade have been removed.
Figure 18:
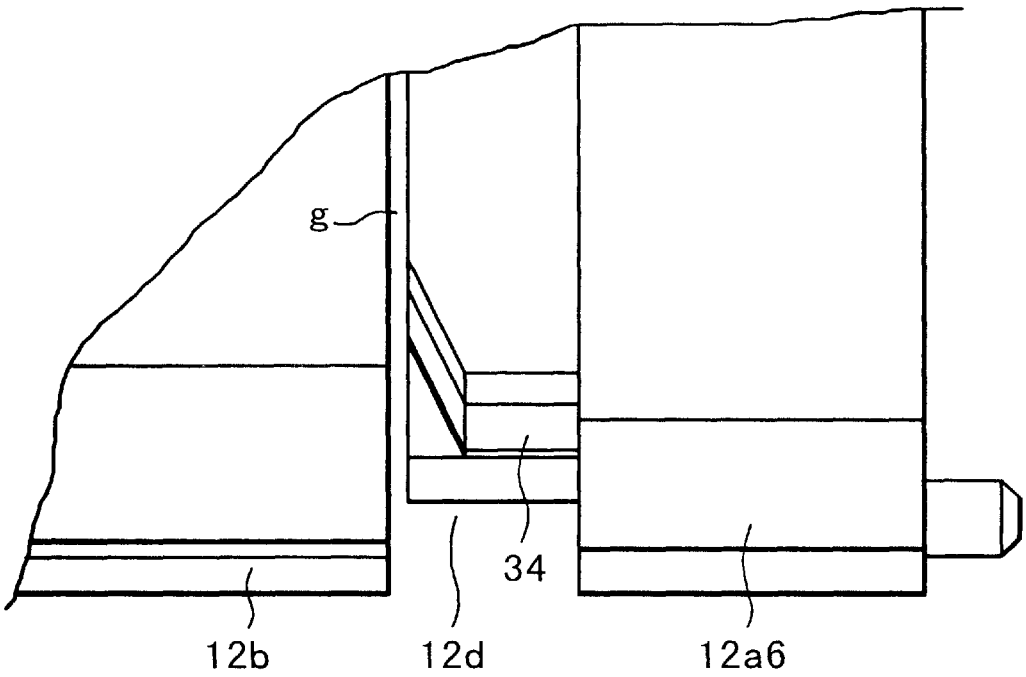
FIG. 18 is an enlarged view of E part in FIG. 17.
Figure 19:
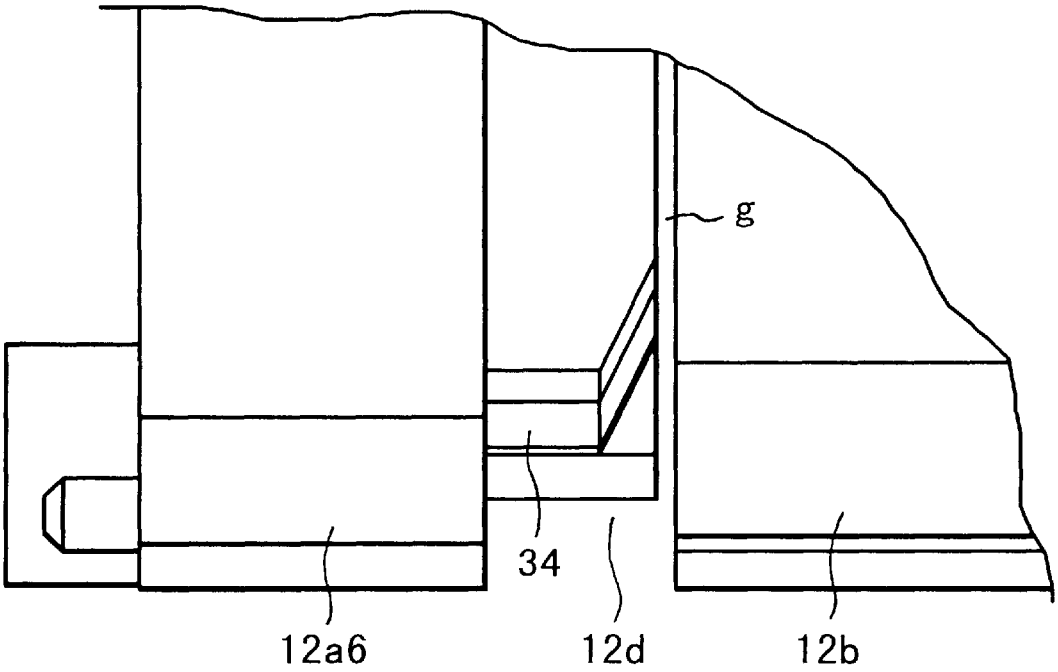
FIG. 19 is an enlarged view of F part of FIG. 17.

As shown in FIGS. 17, 18, 19, when the lower developing frame is welded to or bonded to the developing device frame 12*a*, a slit 12*d* is provided between the arcuate portion 12*a*6 and the lower developing frame 12*b*.

Figure 21:
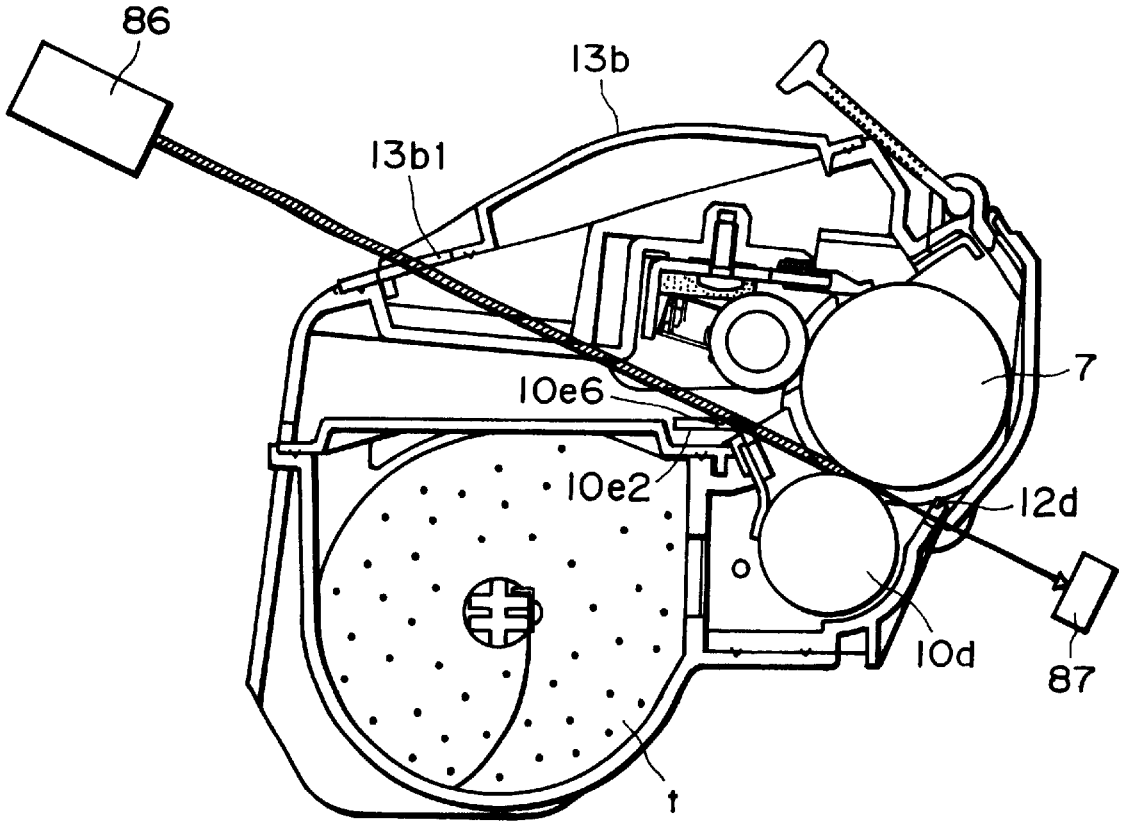
FIG. 21 is a longitudinal sectional view of a process cartridge.
Figure 22:
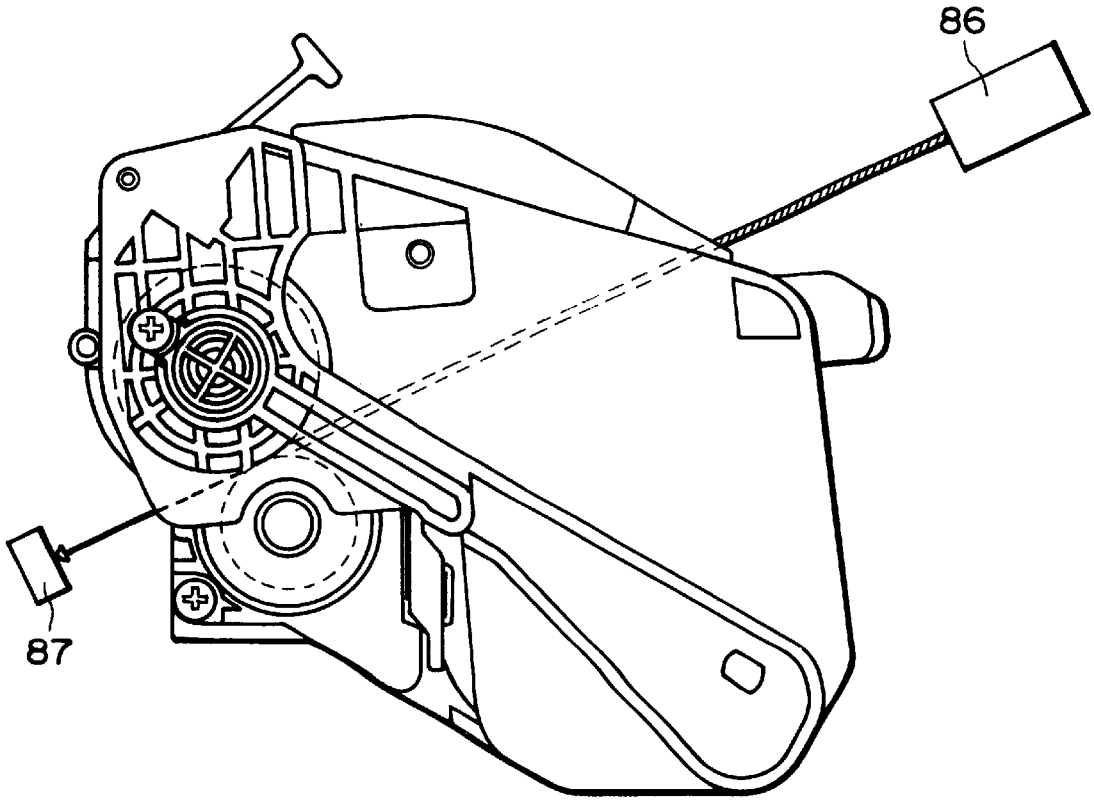
FIG. 22 is a side view of a process cartridge.
Figure 23:
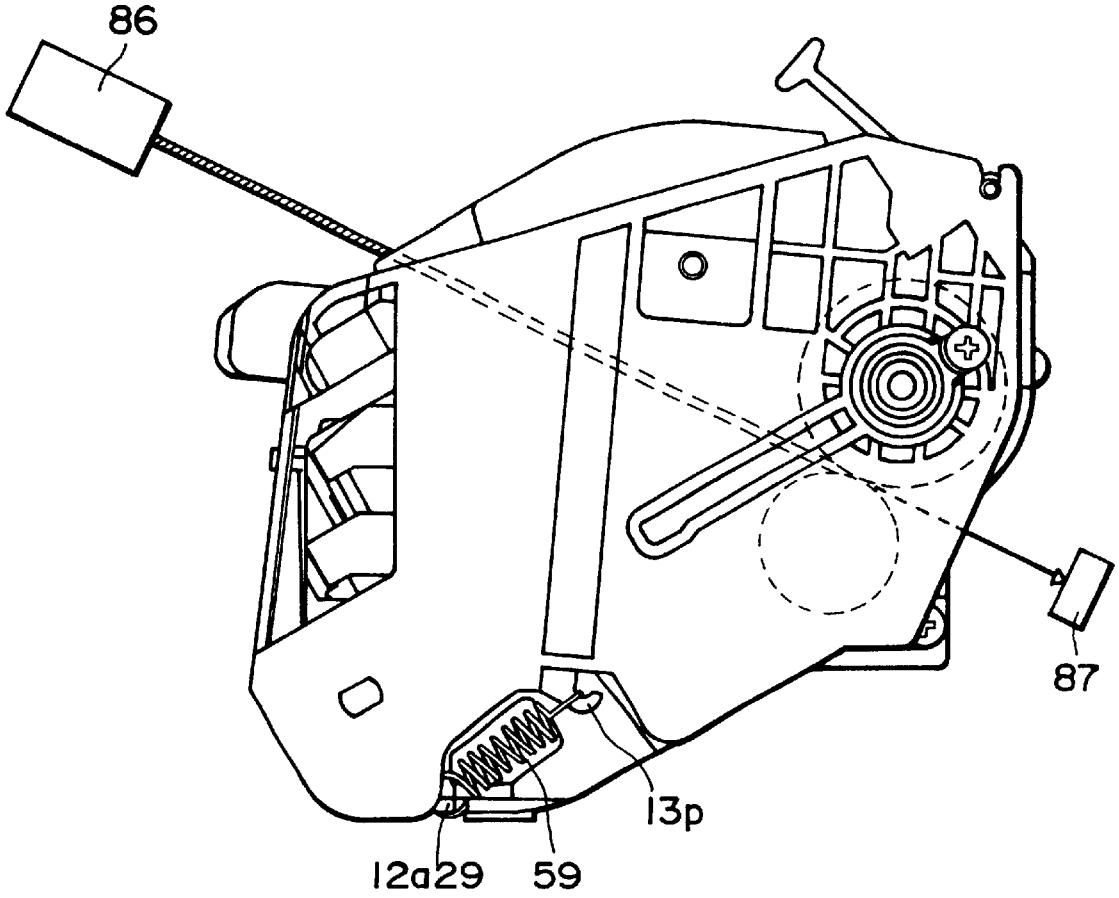
FIG. 23 is a side view of a process cartridge.

The slit 12*d*, as shown in FIGS. 21 to 23, is on an optical path of a laser beam passing through a gap (development gap) formed between the photosensitive drum 7 and the developing roller 10*d* provided by the spacer roller 10*d*1 which is disposed to each of the opposite end portions of the photosensitive drum 7 and the developing roller 10*d*. An optical path passes through the slit 12*d*, a slit 10*e*6 provided in the metal blade 10*e*2 and a hole 13*b*1 formed in the cap member 13*b*.

In FIG. 21, the laser beam emitted from the laser source 86 has a width which is larger than the gap (approximately 300 $\mu$m) between the photosensitive drum 7 and the developing; roller 10*d*. The laser beam emitted from the laser source 86 travels through the hole 13*b*1, the slit 10*e*6, the gap between the photosensitive drum 7 and the developing roller 10*d* and the slit 12*d*, and is then received by a photoreceptor 87. The width of the laser beam received by the photoreceptor 87, is measured in a direction parallel with the face of the sheet of the drawing of FIG. 21. Therefore, the development gap can be detected.

The measurement of the gap between the photosensitive drum 7 and the developing roller 10*d* using the laser beam, is effected at each of opposite longitudinal ends of the photosensitive drum 7 (two positions). Therefore, the hole 13*b*1, the slit and the slit 10*e*6, 12*d* are each provided at least two positions (adjacent opposite longitudinal ends).

After the lower developing frame 12*b* is welded to the developing device frame 12*a*, the end seal 34 and the seal 35 are mounted.

Figure 16:
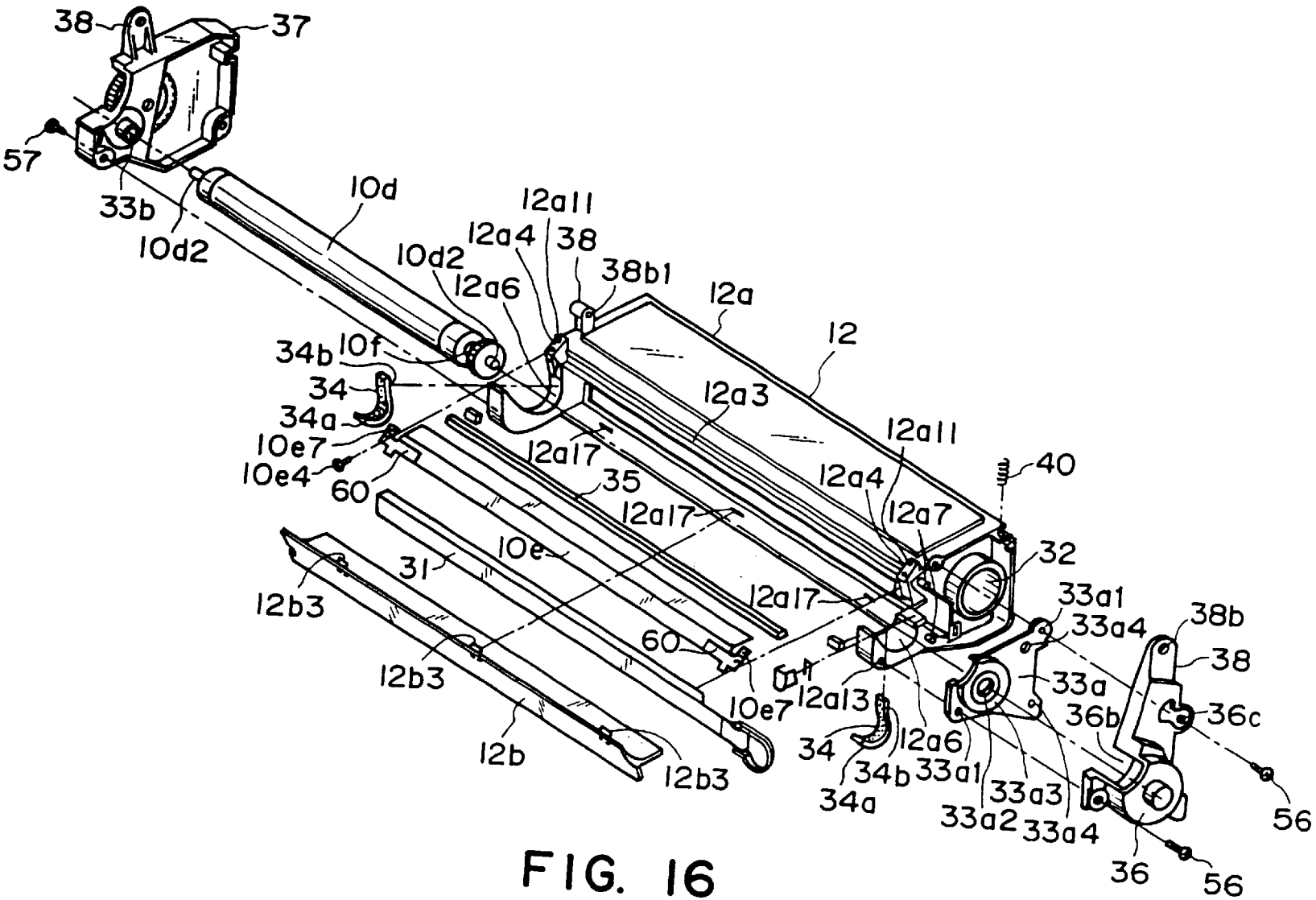
FIG. 16 is an exploded perspective view of a toner developing container.

As shown in FIG. 16, the end seal 34 functions to provide a seal between the developing device frame 12*a* and each of the end portions of the developing blade 10*e* and each of the end portions of the developing roller 10*d*, and it comprises an arcuate portion 34*a* contactable to the developing roller 10*d* along its circumferential surface and an integral linear portion 34*b* along a rear surface of each of the end portions of the metal blade 10*e*2. The outer circumference of the arcuate portion 34*a* is stuck to the sticking portion 12*a*20 of the developing device frame 12*a*.

As shown in FIG. 4, a seal 35 of urethane foam or the like is mounted and extended between blade mounting seat surfaces 12*a*4 formed above the toner discharging opening 12*a*1 of the toner discharging, and the developing blade 10*e* is screwed on the blade mounting seat surface 12*a*4 with the seal 35 therebetween. By doing so, the seal 35 is compressed between the metal blade 10*e*2 and a developing device frame 12*a* so that sealing is accomplished between the metal blade 10*e*2 and the developing device frame 12*a*.

Figure 24:
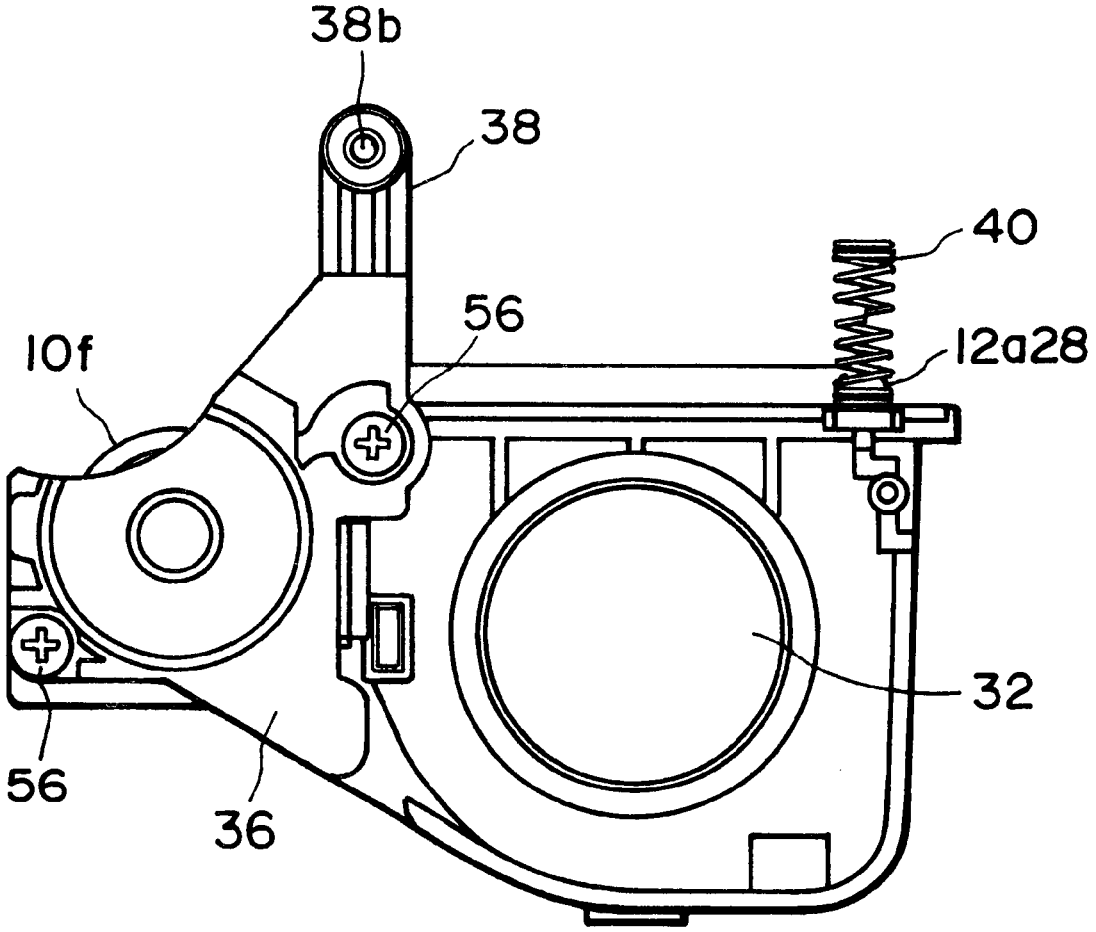
FIG. 24 is a side view of a toner developing container.
Figure 25:
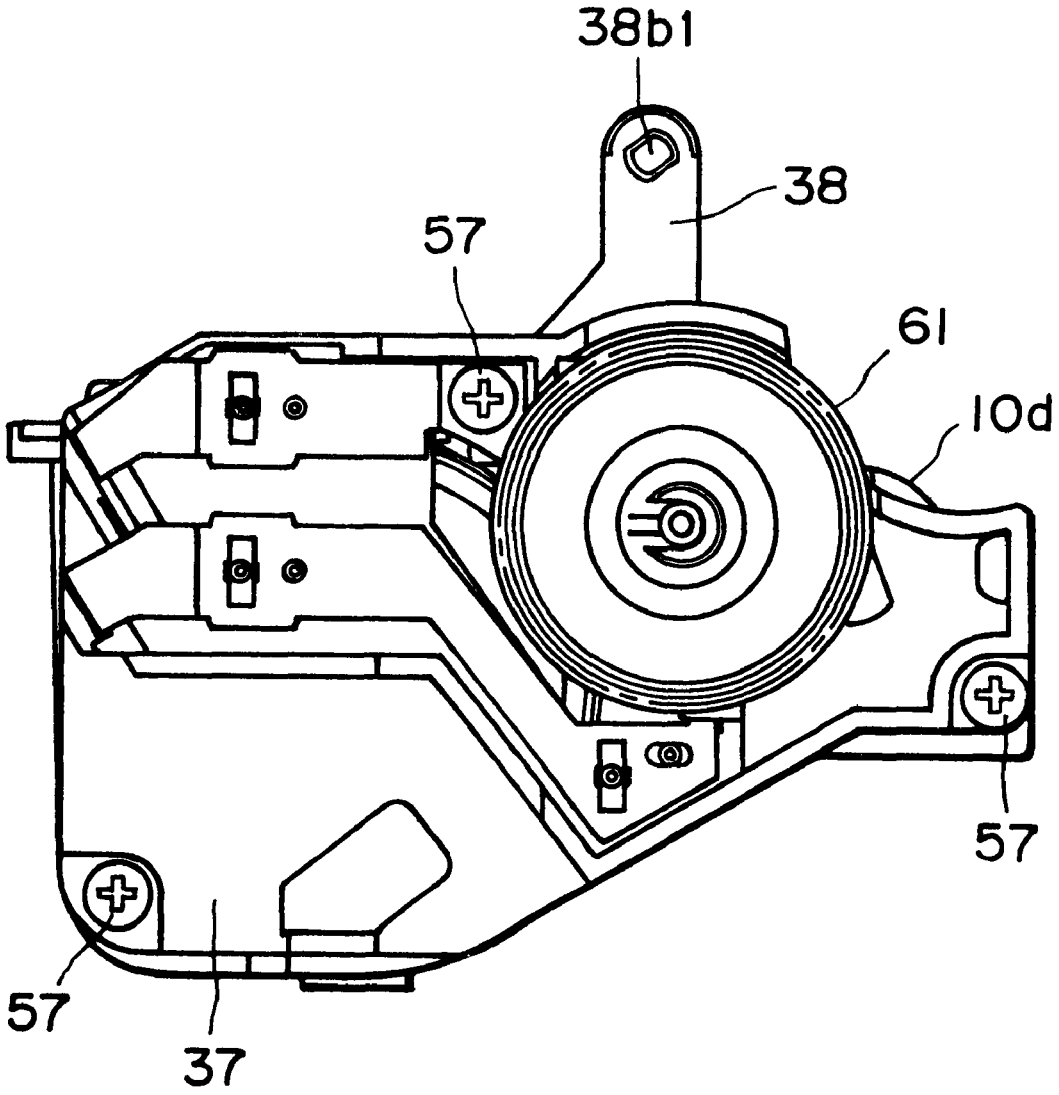
FIG. 25 is a side view of a toner developing container.

The development holder 36 shown in FIGS. 16, 24 is secured to one of the ends of the developing device frame 12*a*, and the development holder 37 shown in FIGS. 16, 25 is secured to the other end thereof. The development holders 36, 37 are fixed to the developing device frame 12*a* by small screws 56, 57.

The shaft 10*d*2 of the developing roller 10*d* at one end is engaged with a fixed bearing 33*b* which is in the form of a shaft integral with the development holder 37 shown in FIGS. 15, 16. The developing roller shaft 10*d*2 is received by a bearing hole 33*a*2 of the bearing 33*a* at the other end of the developing roller 10*d*, and as shown in FIG. 15, a hole 33*a*4 is engaged with a positioning dowel 12*a*7 provided on the developing device frame 12*a* at an outside of one of the longitudinal ends. Then, the developing roller gear 10*f* is engaged with the developing roller shaft 10*d*2. The engaging portion 33*a*3 of the bearing 33*a* is engaged with a part-cylindrical engaging portion 36*a* of the development holder 36. At this time, the developing roller gear 10*f* is accommodated in the development holder 36. A small screw 56 is penetrated through a hole 36*c* of the development holder 36, a hole 33*a*1 of the bearing 33*a* and is threaded into a female screw 12*a*13 of the developing device frame 12*a*. The gear accommodating portion 36*b* outside the development holder 36 is part-cylindrical, and when the toner developing container 12 and a cleaner container 13 are coupled, the developing roller gear 10*f* is brought into meshing engagement with the drum gear 51*a* through the open part of the gear accommodating portion 36*b*.

Each of the development holders 36, 37 is provided with an integral arm portion 38 functioning as a connecting portion for connecting the toner developing container 12 and the cleaner container 13.

The toner developing container 12 having the various members constituting the developing means and the cleaner container 13 having the various members constituting the photosensitive drum 7, the charging roller 8 and a cleaning means are coupled by the arm portions 38 to constitute the process cartridge B.

(Coupling Between Toner Developing Container and Cleaner Container)

Figure 7:
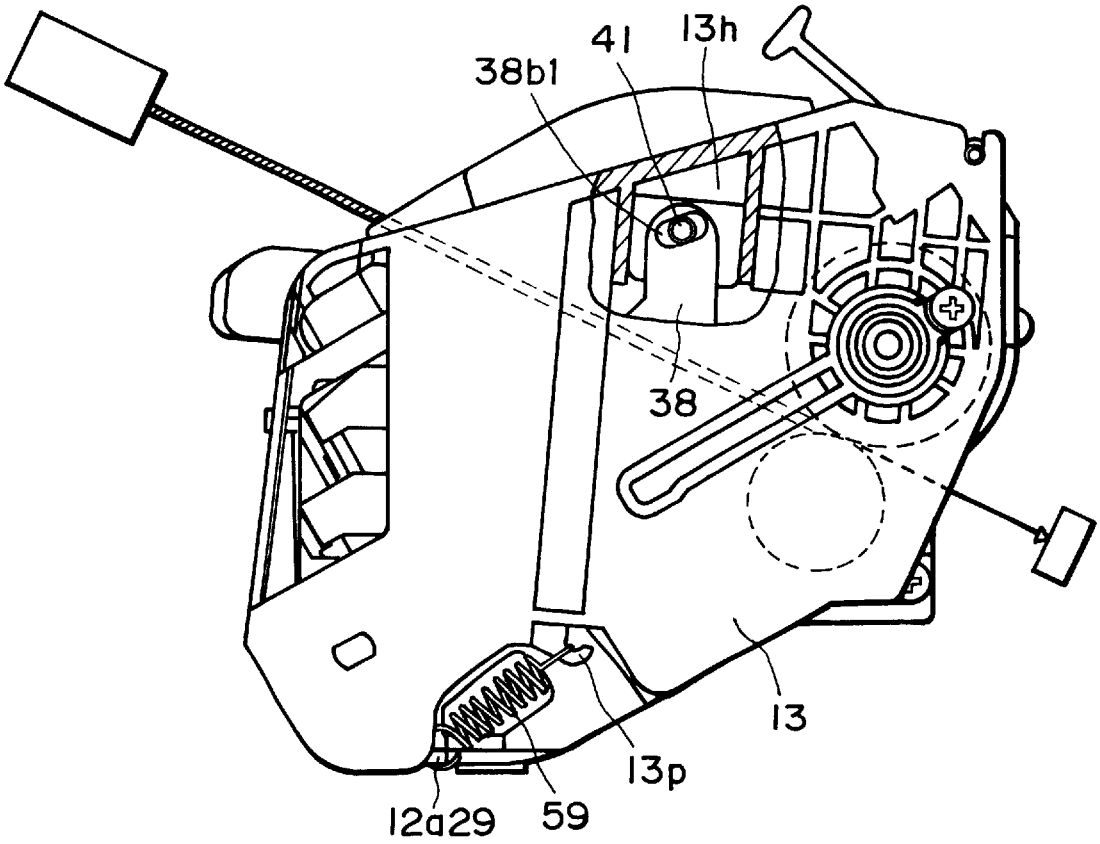
FIG. 7 is a partly broken side view of a process cartridge.
Figure 11:
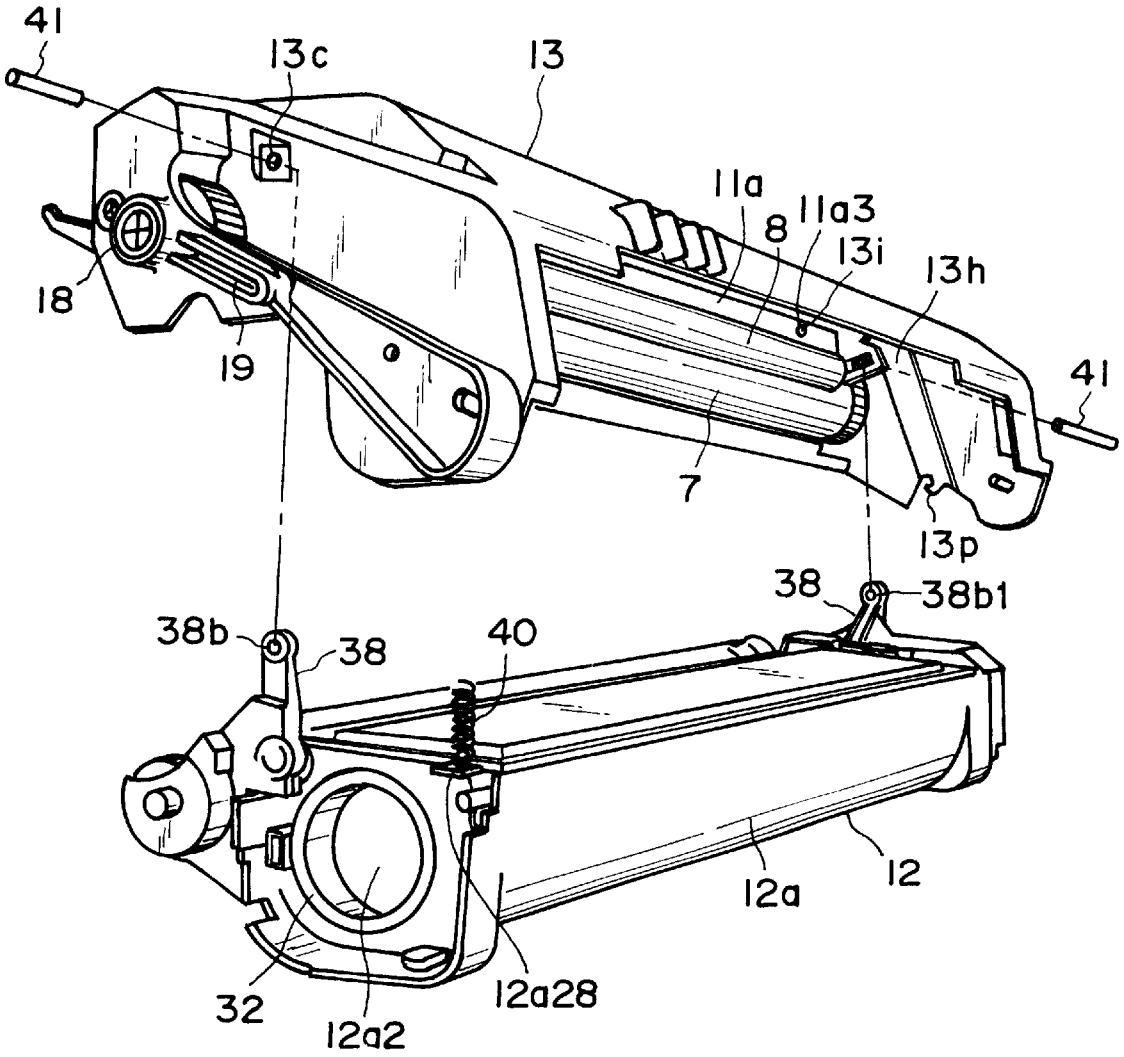
FIG. 11 is an exploded perspective view of a toner developing container and a cleaner container.
Figure 12:
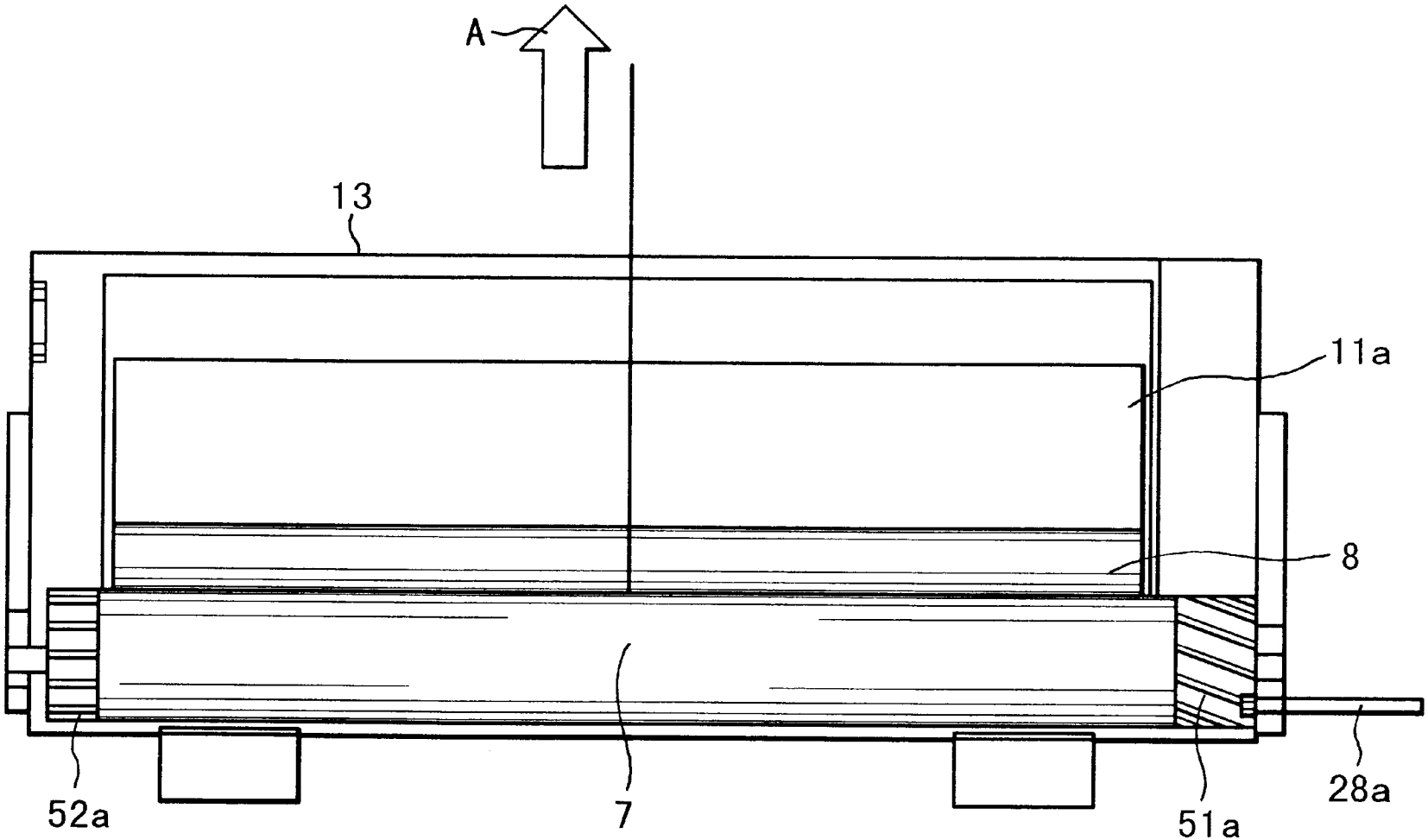
FIG. 12 is a developed schematic view of a cleaner container.
Figure 26:
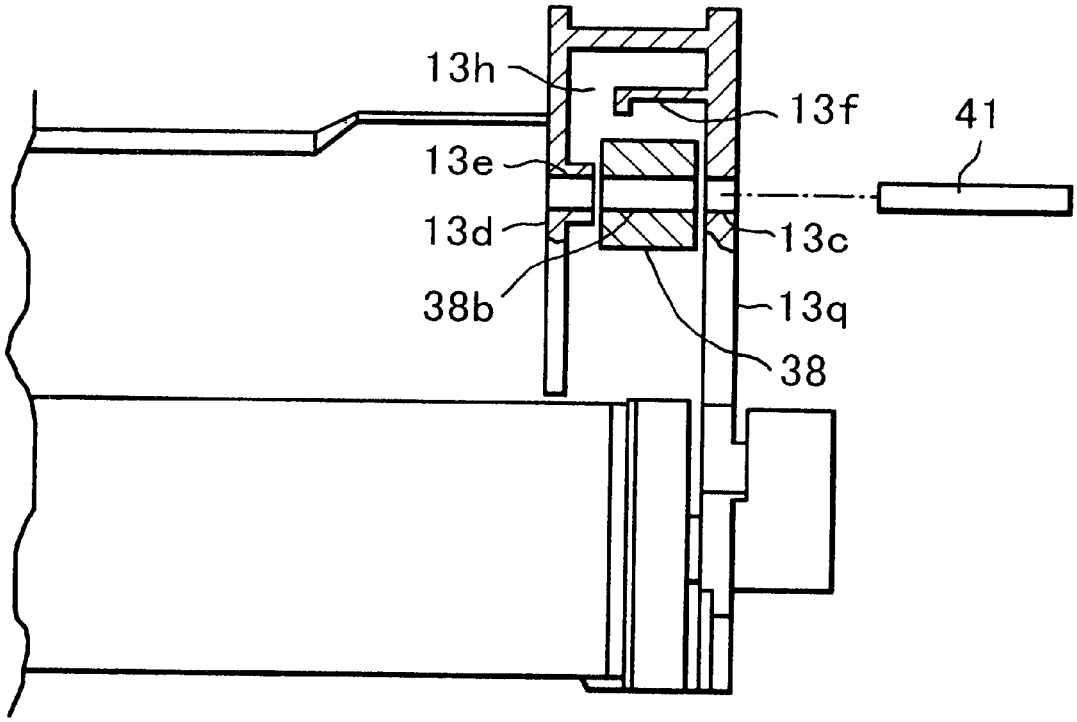
FIG. 26 is a longitudinal sectional view of a connecting portion between the toner developing container and the cleaner container.
Figure 27:
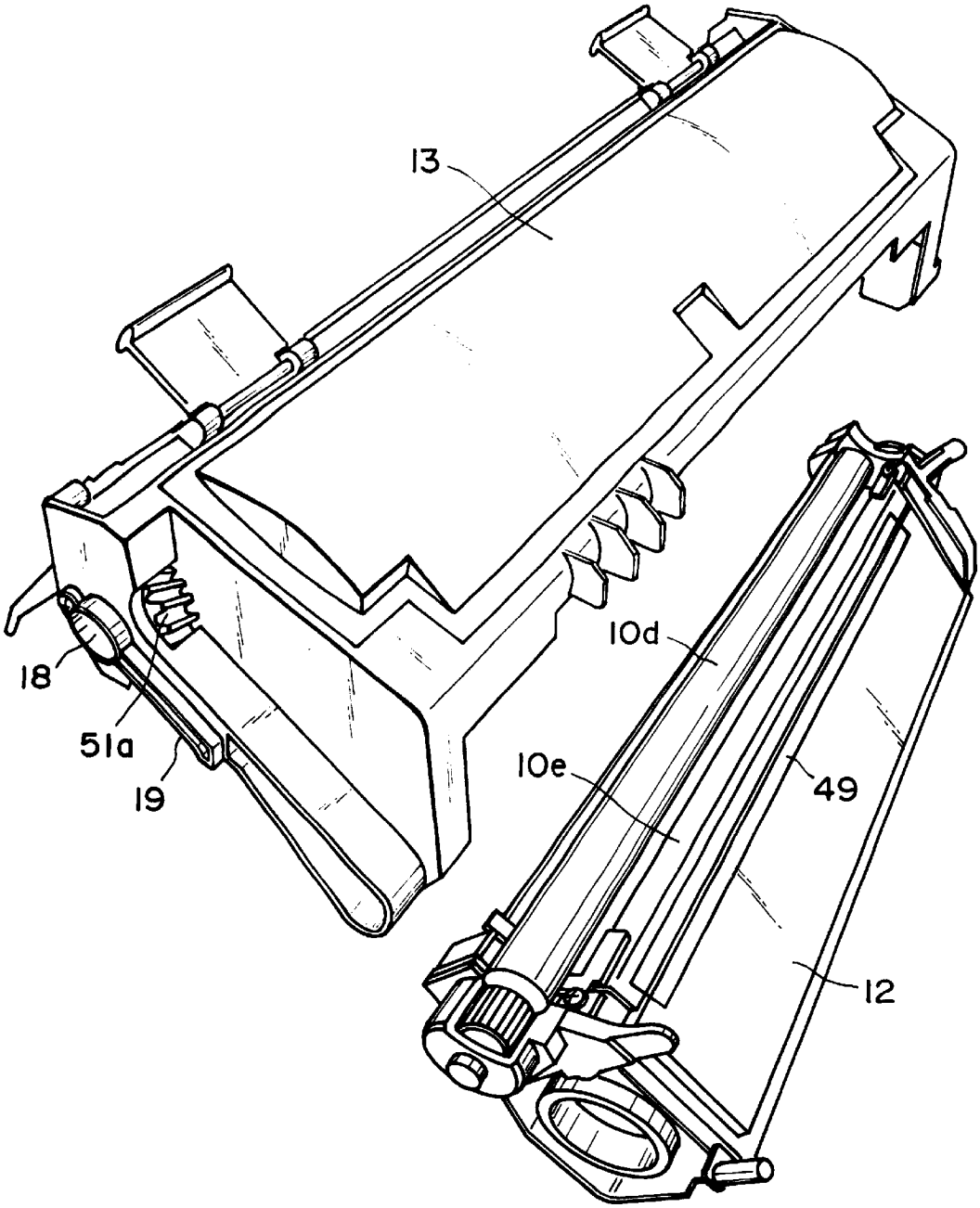
FIG. 27 is a perspective view of a toner developing container and a cleaner container.

Referring to FIGS. 7, 11, 24, 25, 26, a description will be provided as to the coupling between the toner developing container 12 and the cleaner container 13. FIGS. 7 and 11 are a side view and a perspective view illustrating the coupling between the containers 12, 13; FIG. 26 shows inside of the coupling portion; and FIGS. 24, 25 are side views of the copper end portion of the toner developing container 12. The containers 12, 13 are rotatably coupled through the arms 38 at the opposite ends. Since the covering structures at the left and right ends are substantially the same, and therefore, a description will be made as to only one end. However, the portions which a different between the left and right hands will be described for the respective ends.

As shown in FIGS. 11 and 24, the developing device frame 12*a* is provided with an integral spring mounting portion 12*a*28, on which a compression coil spring 40 is mounted. The position of the compression coil spring 40 is adjacent one of the longitudinal ends of the developing device frame 12*a*, and is away from the arm portion 38 in the direction perpendicular to the longitudinal direction. The compression coil spring 40 is extended out in parallel with the arm portion 38. At a free end portion of the arm portion longitudinal end where the compression coil spring 40 is provided, a through-hole 38*b* is provided for receiving a pin 41 which will be described hereinafter. As shown in FIG. 26, an outer wall 13*q* of the cleaner container 13 is provided with a hole 13*c* for receiving the pin 41, and an inner wall 13*d* thereof is provided with a hole 13*e* for being press-fitted by the pin 41. The hole 13*c* and the hole 13*e* are aligned along a line parallel with the photosensitive drum 7. An elongated bore 38*b*1 is formed in the arm portion 38 and the other end of the cleaner container 13, and a line connecting the center of the elongated bore 38*b*1 and the hole 38*b* passes through the centers of the holes 13*c*, 13*e*. The elongated bore 38*b*1 is elongated in a direction parallel with a line connecting the center of the photosensitive drum 7 and the center of the developing roller 10*d*, and a width of the elongated bore 38*b*1 is equal to the diameter of the pin 41.

When the toner developing container 12 and the cleaner container 13 are coupled together with each other, as shown in FIGS. 7 and 11, the arm portion 38 of the toner developing container 12 is inserted into the recess 13*h* of the cleaner container 13, and the pin 41 is penetrated through the hole 13*c*, 13*c* of the cleaner container 13, the through hole 38*b*, of the arm portion 38 and the elongated bore 38*b*1 in the order named, and is press-fitted into the hole 13*e*, 13*e* of the inner wall 13*d*. By doing so, the toner developing container 12 and the cleaner container 13 are rotatably coupled for rotation about the pin 41. At this time, the compression coil spring mounted to the developing device frame 12*a* is compressed out the abutment to the spring seat 13*f* (FIG. 26) of the cleaner container 13. The photosensitive drum 7 and the developing roller 10*d* are urged toward each other about the pin 41 so that spacer rollers 10*d*1 of the developing roller 10*d* are press-contacted to the photosensitive drum 7.

Because of the provision of the elongated bore 38*b*1, the photosensitive drum 7 and spacer rollers 10*d*1 of the developing roller 10*d* are contacted to each other at the generating lines thereof. The generating lines are parallel with the center lines of the photosensitive drum 7 and the developing roller 10*d*.

FIG. 7 shows an end surface portion which is opposite from the end where the compression coil spring 40 is provided. Opposite ends of a tension coil spring 59 are engaged with a spring hook 13*p* of the cleaner container 13 and a spring hook 12*a*29 of the developing device frame 12*a* of the toner developing container 12, respectively. The direction of the tension coil spring S9 is substantially parallel with a line connecting the centers of the photosensitive drum 7 and the developing roller 10*d*.

By doing so, by the compression coil spring 40 and the tension coil spring 59, the developing roller 10*d* mounted in the toner developing container 12 is urged toward the photosensitive drum 7 mounted in the cleaner container 13, so that spacer rollers 10*d*1 at the opposite longitudinal ends of the developing roller 10*d* are contacted to the photosensitive drum 7 by which the developing roller 10*d* is correctly positioned relative to the photosensitive drum 7. The drum gear 51*a* fixed to the end of the photosensitive drum 7 is brought into meshing engagement with the developing roller gear 10*f* fixed to the end of the developing roller 10*d*, so that driving force can be transmitted.

(Remanufacturing of Process Cartridge)

Embodiment 1

(Separating Step Between Toner Developing Container and Cleaner Container)

The tension coil spring 59 shown in FIG. 7 is disengaged from the spring hook 13*p* of the cleaner container 13.

By doing so, the force between the photosensitive drum 7 and the developing roller 10*d* is provided only by the compression coil spring 40. Therefore, the toner developing container 12 and the cleaner container 13 are rotatable relative to each other about the pin 41.

Then, the pin 41 is removed. This is done by pulling out the pin 41 using a plyer or the like if the pin 41 is projected out of the process cartridge B. If not, the pin 41 is pushed into the process cartridge to disengage it.

Thus, the container separating step is completed, by which the toner developing container 12 comprising the toner accommodating portion 10*a*, the toner supply opening 12*a*1, the developing roller 10*d* and the developing blade 10*e*, and the cleaner container 13 comprising the photosensitive drum 7, are separated from each other by disengaging the pins 41 at one and the other longitudinal ends of the process cartridges B. FIG. 11 shows the thus separated toner developing container 12 and cleaner container 13.

(Removing Step of Developing Roller)

Figure 28:
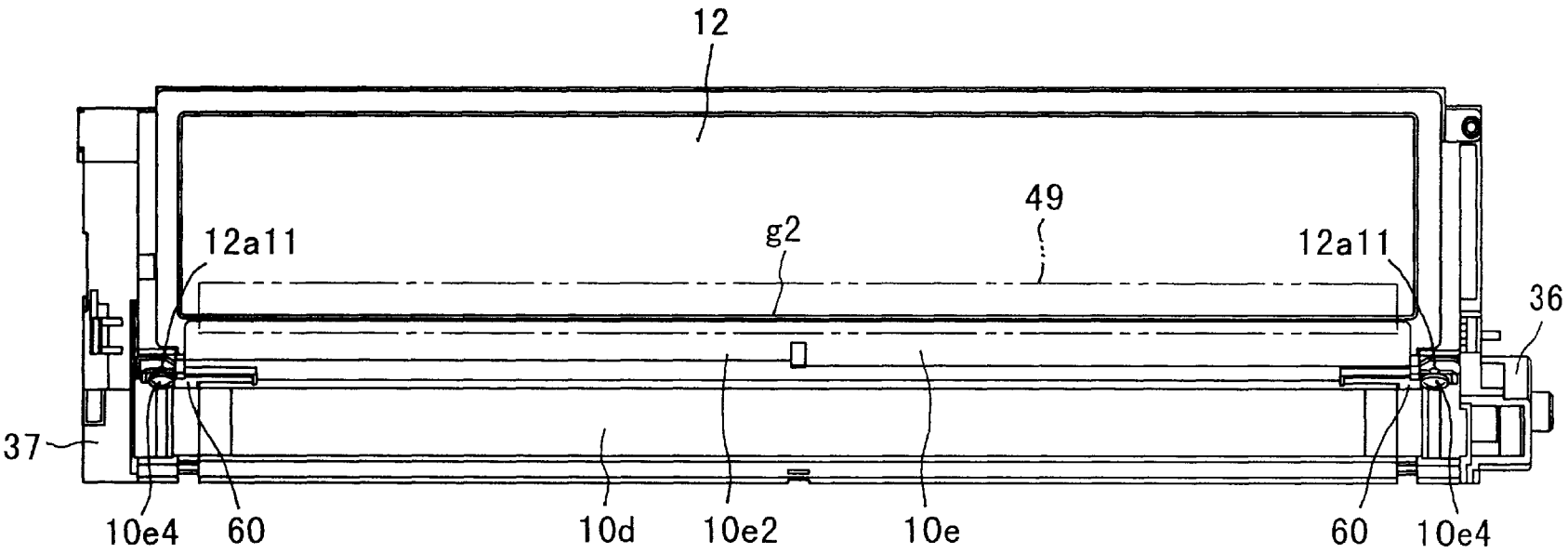
FIG. 28 is a top plan view of a toner developing container.

As shown in FIG. 28, the separated toner developing container 12 includes the developing roller 10*d* and the developing blade 10*e* mounted thereto.

First, the development holders 36, 37 fixed to the opposite end of the developing device frame 12*a* are removed. The small screw 56 fastening the development holder 36 and the bearing 33*a* to the developing device frame 12*a*, as shown in FIG. 15, is removed, and the development holder 36 is moved longitudinally outwardly. Then, the developing roller gear 10*f* is pulled off the developing roller shaft 10*d*2. The bearing 33*a* supporting the developing roller 10*d* is removed from the shaft 10*d*2 of the developing roller 10*d*. The developing roller 10*d* is pulled in the actual direction to remove it from the bearing 33*b* of the development holder 37, and the developing roller 10*d* is removed from the toner developing container 12.

Figure 14:
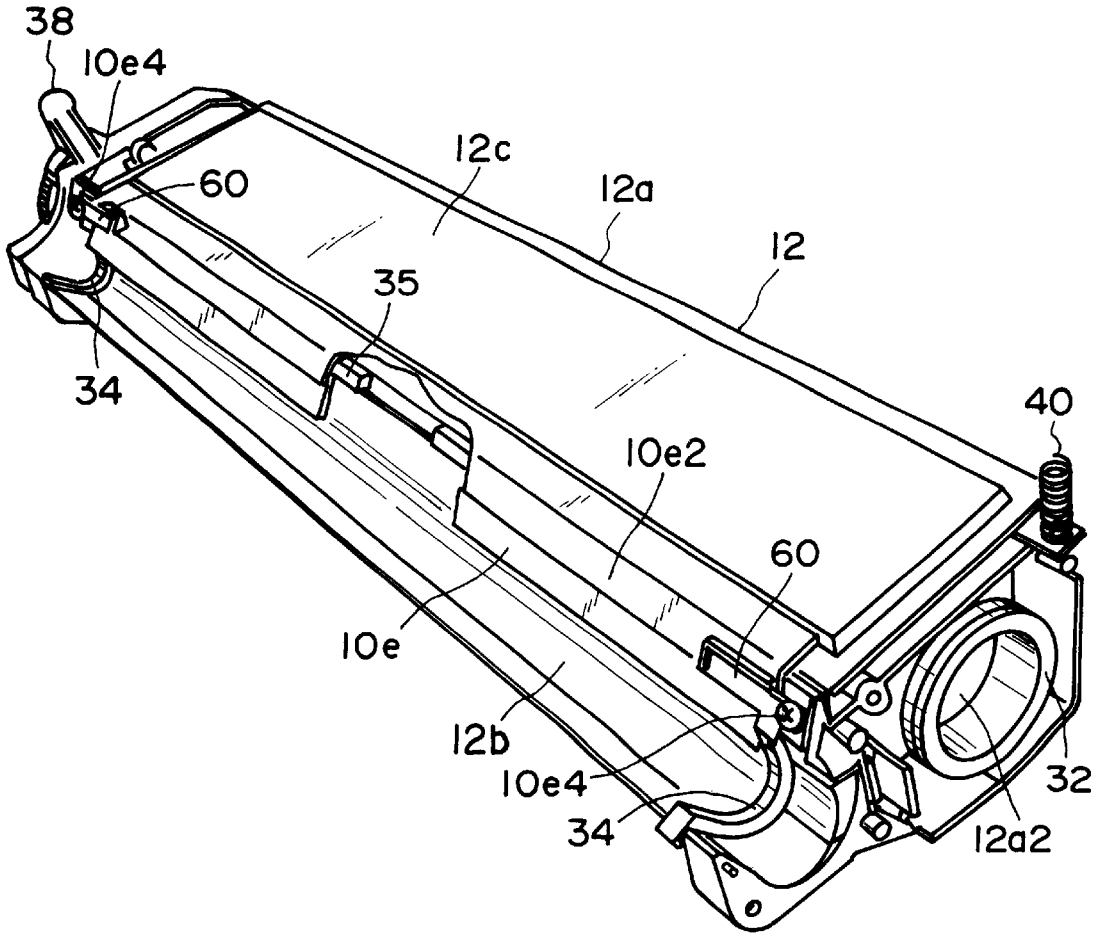
FIG. 14 is a perspective view of a toner developing container without a developing roller.

By doing so, the developing roller dismounting step is completed, by which the developing roller 10*d* mounted to the toner developing container 12 is removed. FIG. 14 shows a state in which the developing roller 10*d* has been removed. When the gear train 61 (FIG. 25) for driving the toner feeding member 10*b* is to be inspected, the development holder 37 is removed from the developing device frame 12*a* by removing the small screw 57.

(Dismounting Step of Developing Blade)

After the developing roller 10*d* has been removed, the developing blade 10*e* is removed. The developing blade 10*e* is a movement by unthreading the small screws 10*e*4 which fixes the developing blade 10*e* to the blade mounting seat surface 12*a*4 of the developing device frame 12*a* as shown in FIG. 14, and then moving the developing blade 10*e* away from the blade mounting seat surface 12*a*4.

Figure 29:
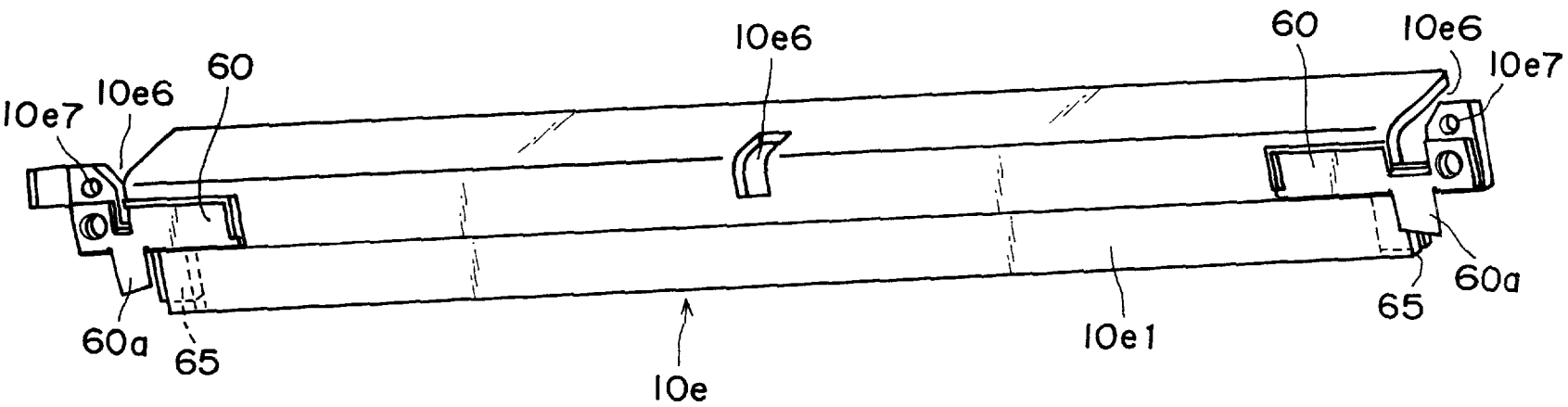
FIG. 29 is a perspective view of a cleaning blade.

Thus, the developing blade dismounting step is completed by which the developing blade 10*e* mounted to the toner developing container 12 separated by the separation step. FIG. 17 is a top plan view showing the toner developing device frame 12*a* from which the developing blade 10*e* has been removed. FIG. 29 shows the removed developing blade 10*e* (except for the side pad 65).

Here, all the elements which should be removed from the toner developing device frame 12*a* have been removed. The drum shutter member 28 is not removed by these retained.

(Application of Sealing Material for Toner Developing Container)

If the toner seal 31 is restored, the remanufactured process cartridge is substantially the same as a new process cartridge. According to the invention, the toner seal 31 is not repaired or restored. Even without the toner seal 31, it will suffice if the toner does not leak when the developing means is mounted to the toner developing container.

(End Seal)

Each or one of the end seals 34 is replaced with new one if it is confirmed as being damaged after inspection.

(Filling Sealing Material into Gap Between Developing Device Frame and Lower Developing Frame)

Between the developing device frame 12*a* and the lower developing frame 12*b*, the gap g extends along the inner surface of the end seal 34 at each of the end portions. The gap g is in the form of a crank extending toward the gap g1 as shown in FIG. 20, as seen from an outside of the toner developing container 12.

Figure 30:
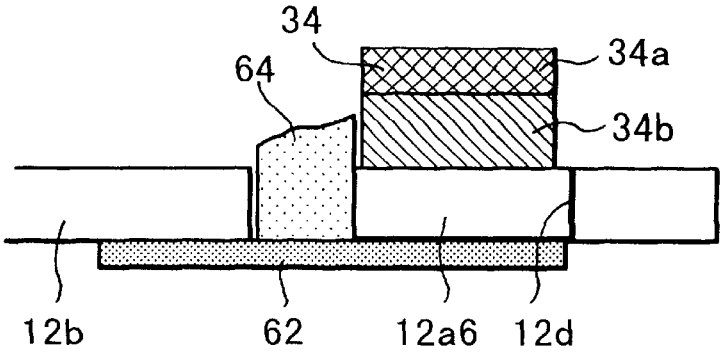
FIG. 30 is a front view illustrating a sealing step for a cutaway portion.
Figure 31:
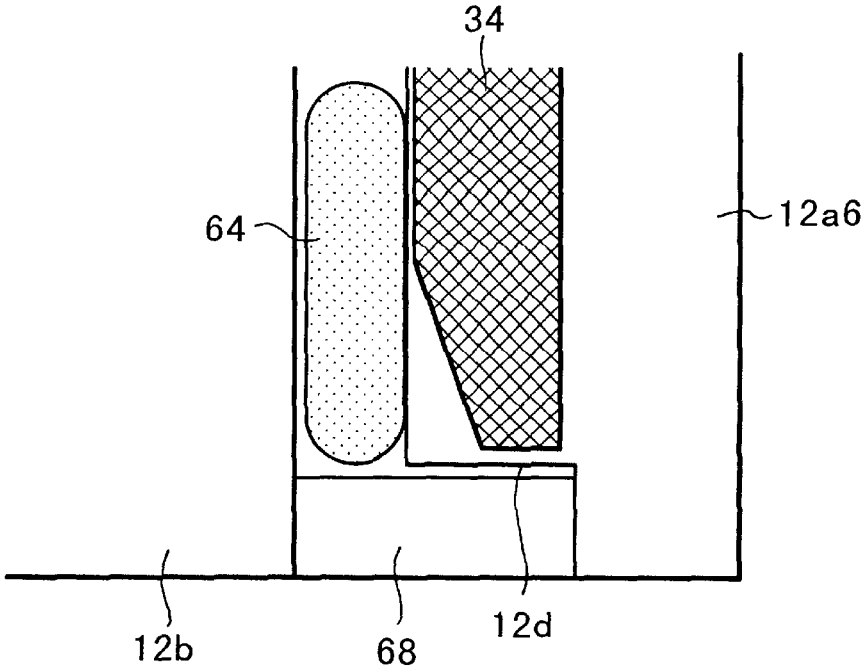
FIG. 31 is a top plan view of the device shown in FIG. 30.
Figure 32:
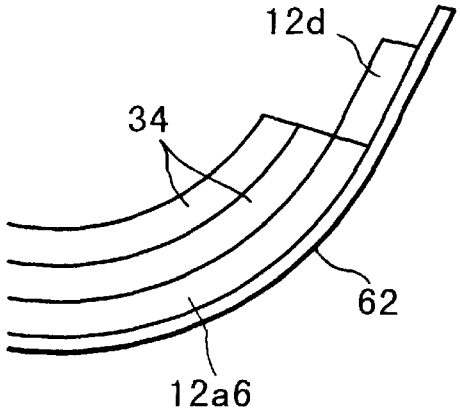
FIG. 32 is a side view of the device shown in FIG. 30.

First, the, gaps g and g1 are sealed. This sealing is effected by continuously sticking a developing container cover side seal 62 which is an adhesive tape on an outer periphery of the lower developing frame 12*b* and the arcuate portion 12*a*6 as shown in FIG. 20 (hatching line) and FIGS. 30, 32. The sealing covers the entire length of the gaps g and g1 and also covers the slit 12*d*.

Then, the gap g is filled with a sealing material 64. The sealing material 64 is supplied from the inner side of the arcuate portion 12*a*6. When the sealing material 64 is filled into the gap g, the sealing material 64 is injected into the gap g at a position which is substantially the middle of the length of the gap using a tool (unshown), and thereafter the sealing material 64 is expanded toward one and the other ends of the length of the gap g, thus filling the sealing material 64 into the gap g in its full length.

The sealing material 64 is plastically deformable. Examples of such sealing material 64 includes polymeric materials having a curing property or polymeric materials having a thermoplastic property. The sealing materials include a silicon bond which is polymeric material having a silicone bonding material curing property. The polymeric material having a thermoplastic property includes hot melt plastic resin material.

When the silicon bond is used as the sealing material 64, for example, the sealing material is filled, and it is left for approximately 6 hours, and the cover side seal 62 is removed after it is dried.

(Sticking of Side Pad)

Figure 33:
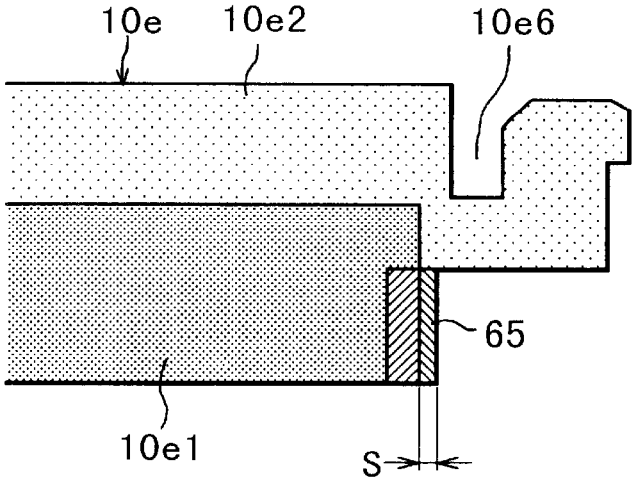
FIG. 33 is a front view of a side pad.
Figure 34:
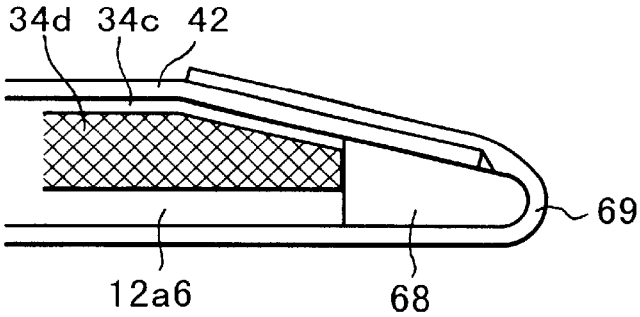
FIG. 34 is a side view after the side cover seal is mounted.

As shown in FIG. 33, a gap S exists between the longitudinal end of the elastic blade 10*e*1 of the developing blade 10*e* and the end seal 34. During the image forming operation, the toner does not leak out in the longitudinal direction by the provisions of the end seal 34 despite the existence of the gap S. However, during the transportation, the toner is liable to leak out since the comer portion between the end seal 34 and a seal 35 is a linear portion 34*b* of the end seal 34 so that it is not in close contact with the developing roller 10*d*. Therefore, a side pad is provided.

As shown in FIG. 29, a side pad 65 (seal) is stuck on the longitudinal surface of the elastic blade 10*e*1 of the developing blade 10*e* at each of the opposite end portions so as to extend beyond the longitudinal end of the blade.

The pad is stuck on the backside of the elastic blade 10*e*1, that is, the side not facing the developing roller 10*d*, using an adhesive material. The side pad 65 has such a size that it is compressed into the corner formed by the end seal 34 and a seal 5, so that it contacts them by its elasticity, and one side is substantially leveled with the free end of the elastic blade 10*e*1.

When the developing roller 10*d* is mounted, the side pad 65 provides sealing between the end seal 34 and the end of the elastic blade 10*e*1. The side pad 65 is press-contacted to the end seal 34 and to the seal 35.

By doing so, during transportation, the toner is prevented from leaking out through between the developing device frame 12*a* and the developing blade 10*e* at the opposite ends of the developing roller 10*d*.

The side pad 65 is mounted on the reused developing blade 10*e* if the developing blade 10*e* is reusable. When the developing blade 10*e* is to be replaced with a new part, the new part developing blade 10*e* is already provided with the side pad 65.

In this example, the side pad 65 is made of an elastic material such as a sponge.

(End Lateral Seal)

A jaw seal sticking seat surface 12*b*5 (FIG. 4) of the lower developing frame 12*b* after a jaw seal (blow-preventing seal) 42 is stuck is a flat surface, and an extension surface thereof is lower than the extension of the arcuate surface of the inner surface (the surface contacting to the developing roller 10*d*) of the arcuate portion 34*a* of the end seal 34. That is, the jaw seal sticking seat surface 12*b*5 is not flush with the upper surface of the end seal 34. Therefore, when the jaw seal 42 is stuck, a gap remains between the counterpart of the seal 42 at the longitudinal end thereof. The counterpart member is the sealing material 64 having sealed the gap g.

Therefore, an end lateral seal 66 of an elastic member is mounted against the end seal 34 provided at each of one and the other ends of the developing roller 10*d* at the longitudinal inside of the developing roller 10*d* and at the opposite side from the side where the toner accommodating portion 10*a* is provided.

Figure 35:
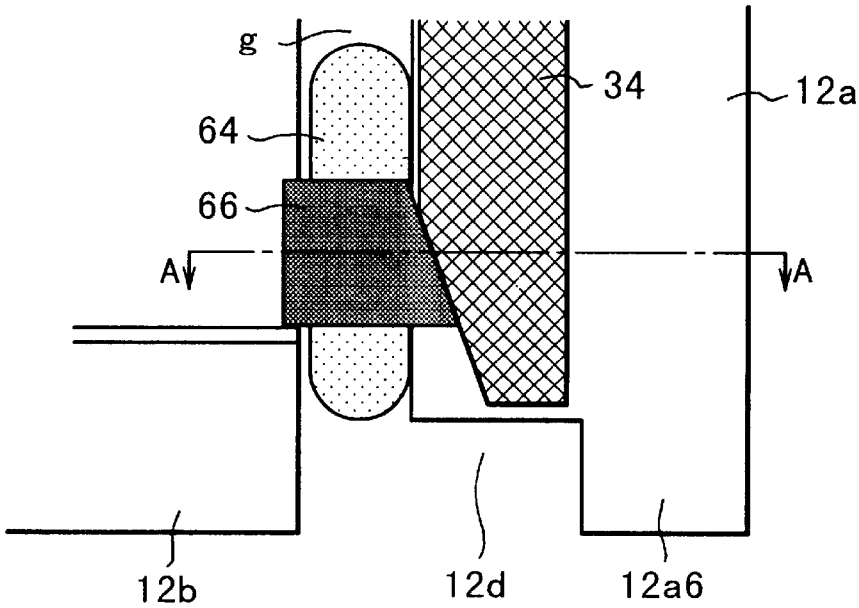
FIG. 35 is a top plan view of an end lateral seal.
Figure 36:
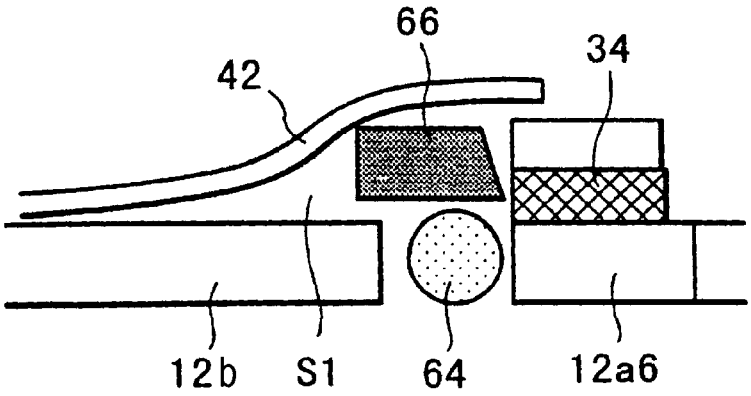
FIG. 36 is a front view showing the disposition of the end lateral seal.

FIG. 35 shows an end lateral seal developed into a plane. FIG. 36 is a sectional view taken along a line A—A. For the purpose of easy understanding, gaps are shown between members. Actually, however, the members shown in FIG. 36 are contacted without gaps. As shown in the figure, the end lateral seal 66 is stuck to the lower developing frame 12*b* at the comers of the sealing material 64 and the end seal 34, by adhesive material. As will be described hereinafter, the jaw seal 42 is stuck usually first in the remanufacturing process. By doing so, the end lateral seal 66 is closely contacted to the end seal 34, the sealing material 64 and the lower developing frame 12*b*. The gap S1 among the jaw seal 42, the lower developing frame 12*b* and an end lateral seal 66 is reduced by the side cover seal 69 and is sealed from the outside.

Figure 43:
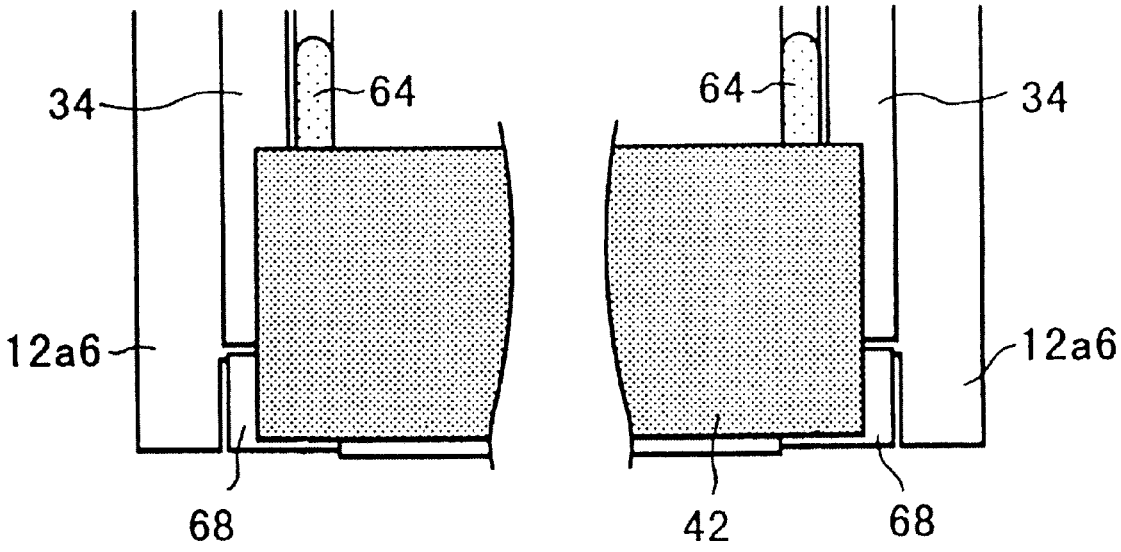
FIG. 43 is a top plan view illustrating the position of the relationship between the groove filling seal and the jaw seal.

As shown in FIGS. 36, 43, the opposite ends of the jaw seal 42 are overlaid on the end lateral seal 66 and the end seal 34.

With the above-described process, the sealing is provided between the jaw seal 42 and an end seal 34.

(Seal for Slit for Developing Gap Measurement)

As described in the foregoing, the toner sealing is quite completely accomplished by the sealing material 64, the side pad 65, the end lateral seal 66 and the seal 42. However, if the toner were passed through between the jaw seal 42 and the end lateral seal 66, the toner might reach the slit 12*d* provided in order to assure the optical path for the measurement of the development gap. In view of this, a seal is provided to prevent the toner having reached the slit 12*d* from leaking out.

Figure 37:
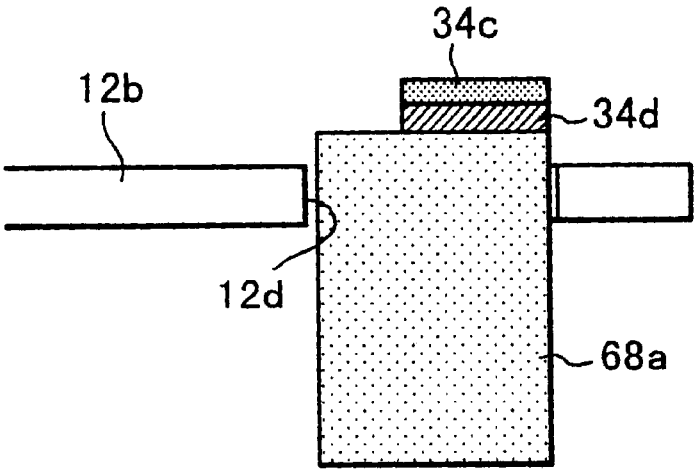
FIG. 37 is a front view showing mounting of a FIG. 37 groove filling seal.
Figure 38:
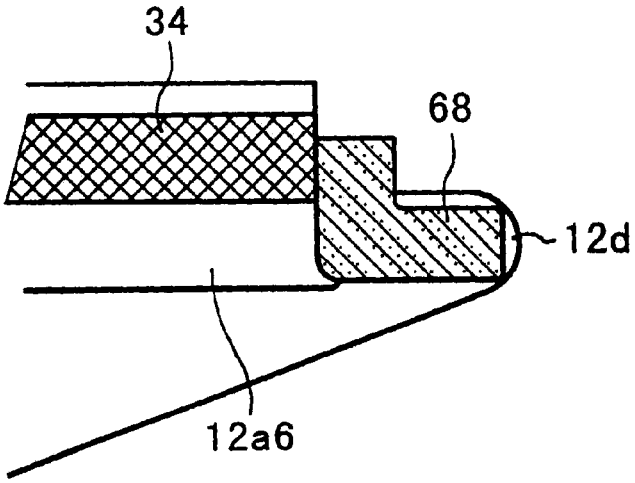
FIG. 38 is a side view of the groove filling seal.
Figure 39:
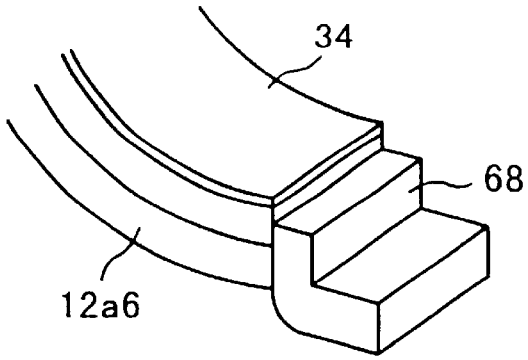
FIG. 39 is a perspective view of the groove filling seal.

FIG. 37 is a front view of the cut-away portion constituting the slit 12*d* as seen in a direction perpendicular to the longitudinal direction of a developing roller 10*d*. As shown in FIG. 38, the jaw groove filling seal 68 is filled substantially the entire width of the cut-away portion 12*d*.

Figure 40:
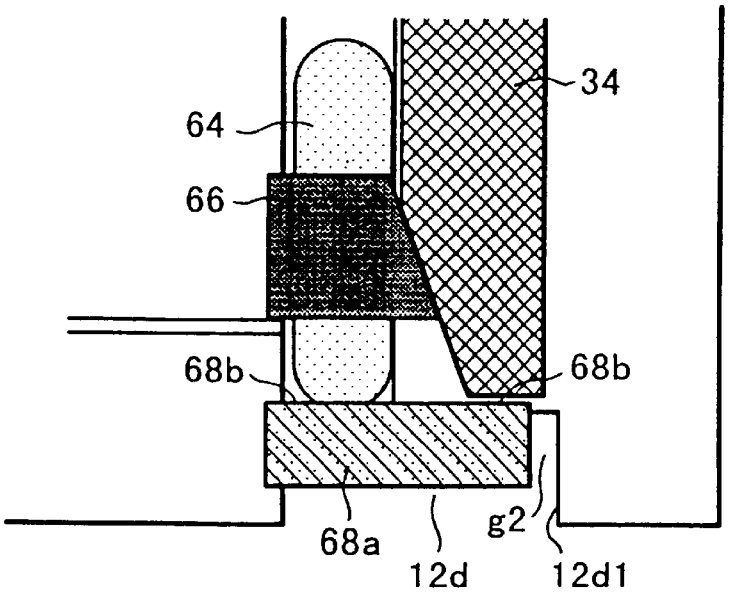
FIG. 40 is a top plan view illustrating mounting of the groove filling seal.
Figure 41:
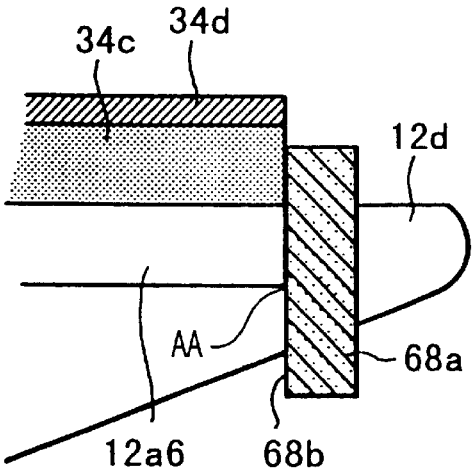
FIG. 41 is a side view of the device shown in FIG. 40.

The process will be described. As shown in FIGS. 37, 40, 41, a double-coated adhesive tape or the like is stuck on one surface 68*b* of a relatively thin rectangular sealing material 68*a*, and it is stuck on the end of the sealing material 64, the wool felt portion 34*c* of the end seal 34, the bottom of the cut-away portion 12*d* substantially flush therewith. The end seal 34 comprises a felt portion 34*c* and a sliding portion 34*d* thereon which is made of fibers having a small friction coefficient.

The sealing material 68*a* is bent by 90° from a comer AA where the arcuation of the arcuate portion 12*a*6 ends (FIG. 41) toward the outside, by which the slit 12*d* is substantially closed, as shown in FIG. 38. However, the complete closure of the slit is not intended. As shown in FIG. 41, if the upper portion of one surface 68*b* of the sealing material 68*a* is partly overlapped with the end of the end seal 34, the toner may pass through between the end lateral seal 66 and the jaw seal 42 to reach the slit 12*d*. It will suffice if the leakage of such toner is prevented, and therefore, as shown in FIG. 40, a gap g2 may be provided between the lateral wall 12*d*1 of the cut-away portion 12*d* and the sealing material (side cover seal 69 which will be described hereinafter).

(Mounting of Jaw Seal)

Figure 42:
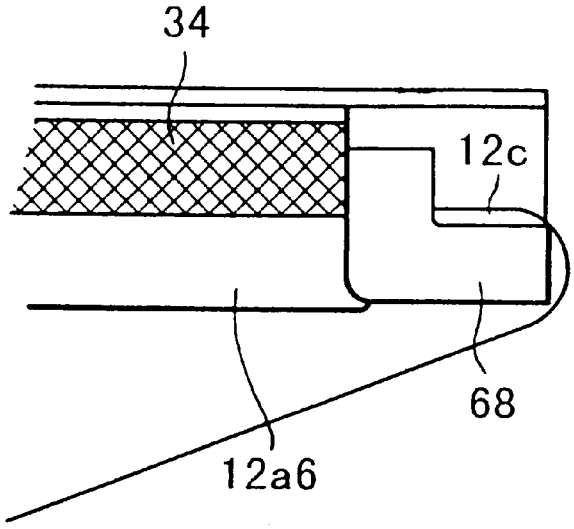
FIG. 42 is a side view illustrating a positional relationship between the groove filling seal and the seal.
Figure 45:
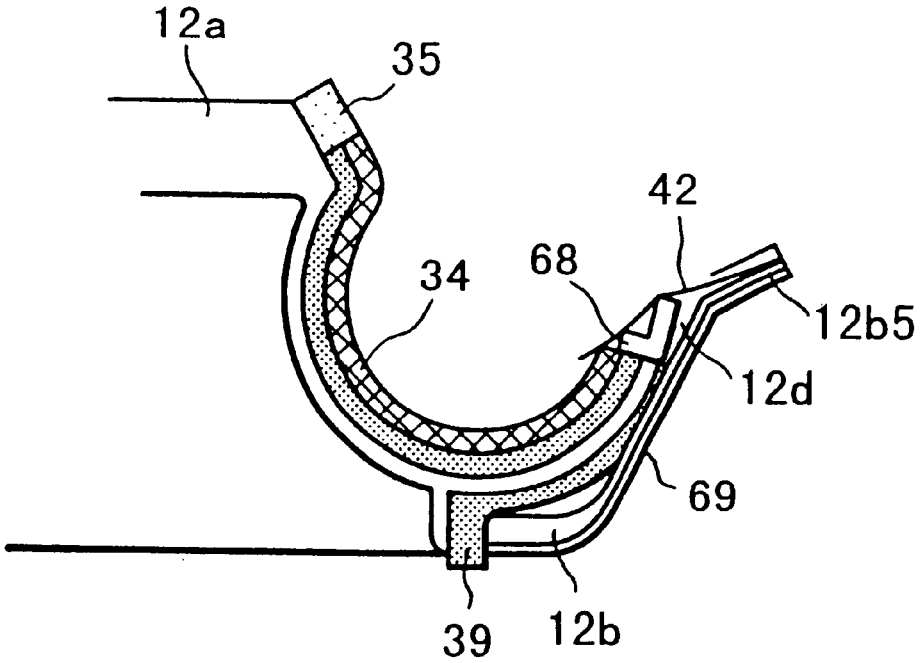
FIG. 45 is a longitudinal sectional view of an end seal portion.

After mounting various seals described in the foregoing, the jaw seal 42 is stuck on the seat surface 12*b*5. As shown in FIG. 42, 43, the jaw seal 42 is stuck. The opposite longitudinal ends of the jaw seal 42 ride on the associated end seals 34 and are bonded thereto by adhesive material. As shown in FIG. 45, the free end, extending in the longitudinal direction of the process cartridge, of the jaw seal 42 is pressed against the developing roller codirectionally with respect to the peripheral movement of the surface of the developing roller. (In this embodiment, the new cartridge is not provided with the jaw seal, since the toner in the developer container is confined therein by the seal 31.

(Side Cover Seal)

A side cover seal is provided for the purpose of back-up and toner leakage prevention at a portion where the bent portion of the jaw groove filling seal 68 and end portions of the jaw seal 42 are overlapped with the end lateral seal 66.

Figure 44:
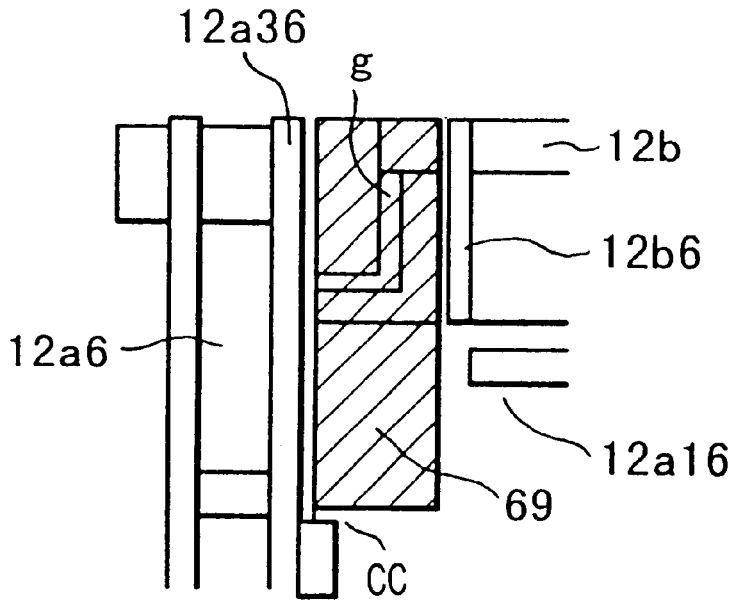
FIG. 44 is a front view of a developing roller at a longitudinal end of the toner developing container as seen from the lower side.

As shown in FIG. 44, such a surface of the arcuate portion 12*a*6 of the developing device frame 12*a* as is not faced to the developing roller 10*d*, there is provided a rib 12*a*36. The lower developing frame 12*b* is provided with a rib 12*b*6 which is parallel with the rib 12*a*36 with the longitudinal gap g between the lower developing frame 12*b* and the arcuate portion 12*a*6 of the developing device frame 12*a* disposed between the ribs. The side cover seal 69 has a width which is equal to the gap between the ribs 12*a*36 and 12*b*6. The side cover seal 69 is stuck and extended from a position CC at a free end (in the direction of a width, that is, perpendicular to the longitudinal direction) of the flange 12*a*16 (FIGS. 4 and 8) of the developing device frame 12*a* the cover the developing device frame 12*a* and the gap g in the form of a crank, is then folded back over the free end portion D to embrace the groove filling seal 68 and the jaw seal 42 end as shown in FIG. 45. By doing so, the jaw seal 42 at a longitudinal extension of the jaw seal sticking seat surface 12*b*5 of the lower developing frame 12*b* is closely contacted to the jaw groove filling seal 68, and the jaw seal 42 is not easily removed from the sticking seat surface 12*b*5 at an edge of a side surface of the seal 68.

(Mounting of Developing Blade)

When a developing device frame 12*a* is deformed, for example, a gap is produced between the metal blade 10*e*2. Here, the seal 35 is long, therefore, the sealing property is relatively not very good. In view of this, a re-assembling of this embodiment will be described according to which the performance of the toner developing container 12 is substantially the same as a new one.

A seal is provided in addition to the seal 35 in consideration of the case where the sealing property of the seal 35 of the toner developing container 12 deteriorates.

The developing blade 10*e* having been removed is subjected to simultaneous air suction and air blow, or the like such that deposited toner is removed from the blade to clean it.

Then, the developing blade 10*e* is inspected to determine whether it is reusable or not. If the result of the inspection indicates that performance thereof is lower than a predetermined standard, it is replaced with a new one.

Between the blade mounting seat surfaces 12*a*4 at the opposite ends of the developing device frame 12*a*, a flange is provided, which is provided with a mounting seat 12*a*3.

The bent portion of the metal blade 10*e*2 of the developing blade 10*e* shown in FIG. 16 is urged toward the seat 12*a*3 of the flange of the developing device frame 12*a* with the seal 35 compressed therebetween, and the holes 10*e*7 of the metal blade 10*e*2 are fitted around the positioning dowels 12*a*11 provided on the developing blade mounting seat surface 12*a*4. Then, a small screw 10*e*4 (only one longitudinal end portion of the metal blade 10*e*2 is shown) is threaded into the developing blade mounting seat surface 12*a*4 through the hole 10*e*7 provided adjacent each of the opposite longitudinal ends of the metal blade 10*e*2 so that developing blade 10*e* is fixed to the developing device frame 12*a*.

This is the end of the developing blade mounting step to the separated toner developing container 12.

(Developing Roller Mounting Step)

The developing roller 10*d* which has been removed is subjected to the air suction and simultaneous air blowing or another process to clean it by removing the deposited toner.

Then, the developing roller 10*d* is inspected, and it is determined whether or not it is reusable. If the determination is negative, that is, the performance does not satisfy a predetermined reference, the developing roller is replaced with a new one.

The developing roller 10*d* may be worn due to the friction with the developing blade 10*e*. Therefore, when the statistic probability that replacement is necessary on the basis of the inspections during development thereof or remanufacturing thereof, the developing roller may be replaced with a new one without the inspection, and by doing so, the remanufacturing operation is efficient.

In the inspection of the developing roller 10*d*, it is disassembled into the main body of the developing roller, the magnet 10*c*, the bearings 33*a*, 33*b*, spacer rollers 10*d*1, roller electrode (unshown), the developing roller gear 10*f* and so on are inspected, respectively, to find reusable parts. The non-reusable parts are replaced with new ones.

As for the gear train 61 for driving the toner feeding member 10*b* rotatably supported on the developing device frame 12*a* and the lower developing frame 12*b*, the development holder 37 is removed, and the gear train is cleaned and inspected, and is replaced with an usable parts, and they are reassembled prior to the assembling of the used or new developing roller 10*d*.

Referring to FIGS. 15 and 16, the process 10 of mounting the developing roller 10*d* to the toner developing container 12 will be described.

The development holder 37 is engaged to the developing device frame 12*a*. A small screw 57 is threaded into the developing device frame 12*a* through the development holder 37 so that development holder 37 is fixed to the developing device frame 12*a*. Then, a journal hole at an end of the developing roller 10*d* is engaged with a bearing 33*b* of the development holder 37. Subsequently, at a longitudinal end which is opposite from the bearing 33*b*, the bearing 33*a* is engaged in the journal at the other end of the developing roller 10*d*, and the bearing 33*a* is aligned with the developing device frame 12*a*. Into a D-shaped shaft portion provided at the journal end of the developing roller 10*d* projected, outwardly beyond the bearing 33*a*, the developing roller gear 10*f*, having a hole which has the complementary shape and size, is attached.

Then, the engaging portion 36*a* of the development holder 36 is engaged with a cylindrical engaging portion 33*a*3 of the bearing 33*a*. At this time, one end of the magnet 10*c* is engaged with a D-shaped hole 36*d* which is provided longitudinally outwardly beyond the bearing hole. The shaft portion at the end of the magnet 10*c* has the complementary shape and size with the D-shaped hole 36*d*. Then, a small screw 56 is threaded into a female screw 12*a*13 of the developing device frame 12*a* through the hole 36*c* of the development holder 36 and the hole 33*a*1 of the bearing 33*a*. By doing so, the development holders 37, 36 are fixed to the developing device frame 12*a*, and the developing roller 10*d* is supported by the toner developing container.

This is the end of the process of mounting the developing roller 10*d* to the separated toner developing container 12.

The toner developing container 12 to which the developing roller 10*d* is mounted is shown in FIG. 11. A new toner developing container 12 has a remanufactured toner developing container 12 that is same as seen in the direction shown in FIG. 11.

(Developing Blade Top Seal)

If the toner developing container 12, particularly, the surface on which the seal 35 is stuck this deformed during transportation, a gap is formed between the metal blade 10*e*2 and the seal 35. So, there is a risk that toner leaks between the longitudinal end edge of the metal blade 10*e*2 and the developing device frame 12*a*.

Figure 46:
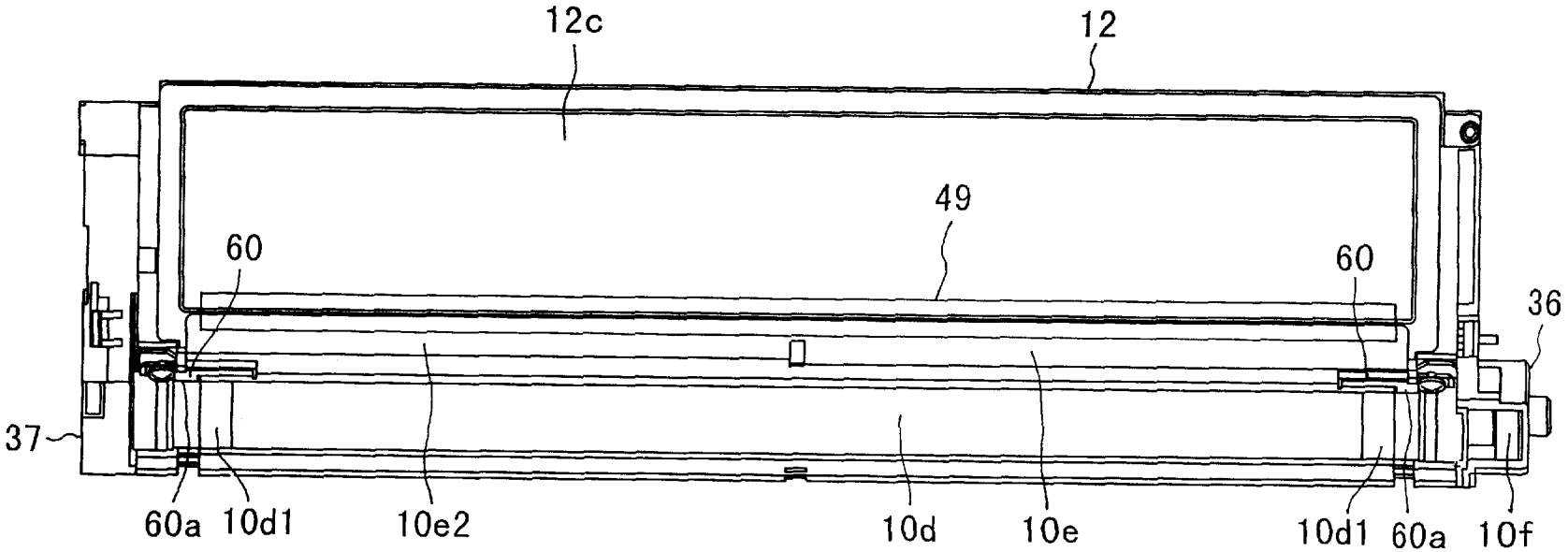
FIG. 46 is a top plan view of a toner developing container.

In view of this, as shown in FIG. 46, a seal is stuck on the outside of the toner developing device frame 12*a* over the metal blade 10*e*2 and the cap member 12*c*. The seal is called here a blade top seal 49. As shown in FIG. 29, a scraper 60 is fixed to the metal blade 10*e*2. The free end 60*a* of the scraper 60 is contacted to the developing roller 10*d* by its elastic force. The free end 60*a* is inclined relative to the generating line of the developing roller 10*d*.

The inclining direction of the free end 60*a* is in a direction downstream with respect to the peripheral movement of the developing roller 10*d* toward the longitudinally inside. By inclining the free end 60*a*, the toner deposited on the developing roller 10*d* is prevented from moving in the longitudinally outward direction, so that toner returns from the end of the jaw seal 42 into between the jaw seal 42 and the developing roller 10*d*.

A longitudinal end of the blade top seal 49 stuck on the metal blade 10*e*2 and the cap member 12*c* such that it closes the gap between the metal blade 10*e*2 and the cap member 12*c* in the longitudinal direction, is within a range where the scraper 60 exists.

By doing so, the seal sticking step for sticking the seal for preventing the toner from leaking, over the metal late portion of the developing blade 10*e* and the toner developing container 12 is completed.

The seal sticking step may be carried out immediately after the developing blade 10*e* is mounted to the toner developing container 12.

The blade top seal 49 is an adhesive tape.

(Toner Filling Step)

Toner is filled into the toner developing device frame 12*a* which has been sealed at various positions described above, through the toner filling opening 12*a*2, and a toner cap 32 or plug is press fitted into the toner filling opening 12*a*2 to seal it.

Figure 56:
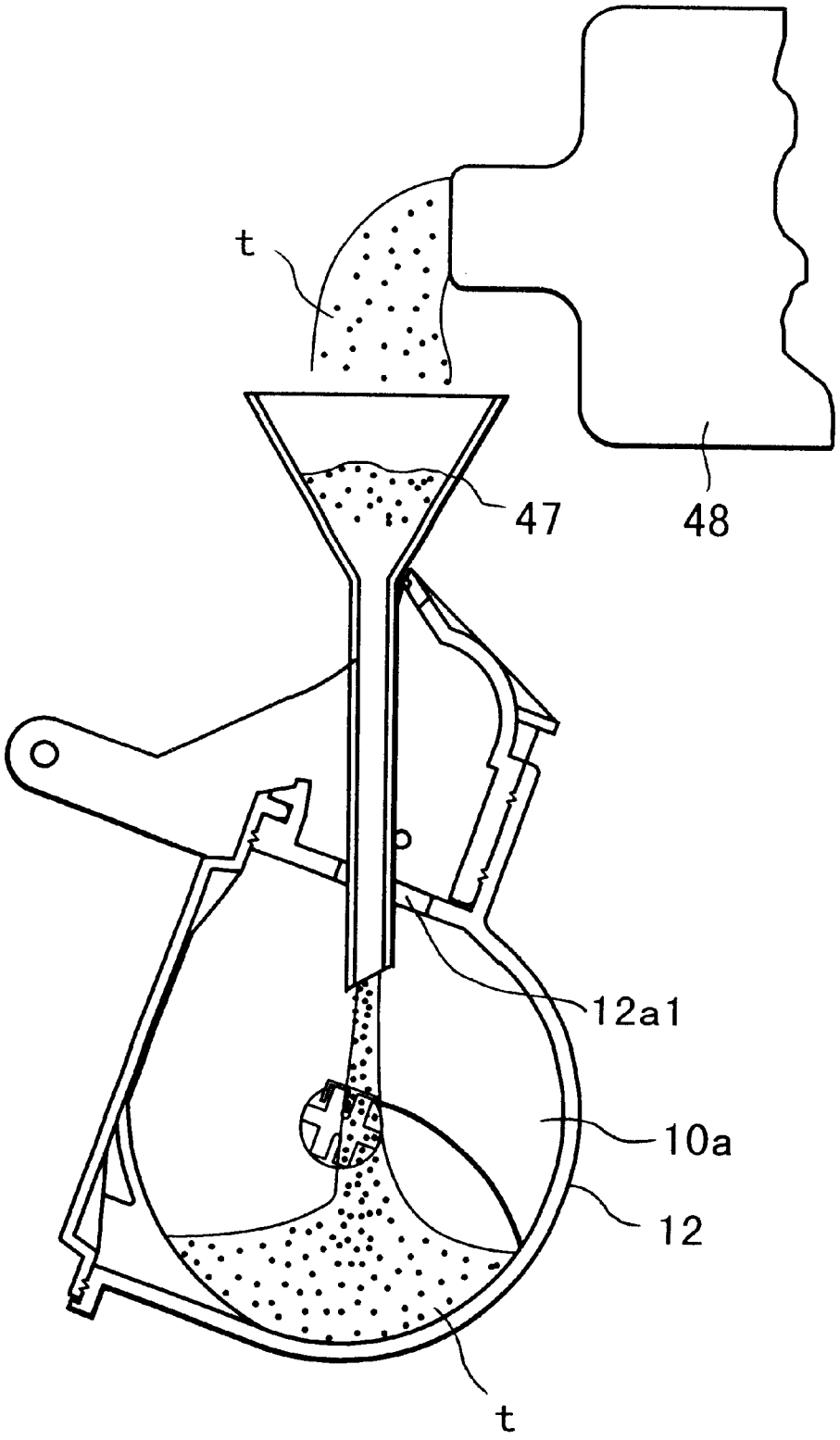
FIG. 56 is a longitudinal sectional view of a toner filling operation according to a further embodiment of the present invention.

In an alternative method, the toner may be filled before the developing blade 10*e* and the developing roller 10*d* are remounted. In such a case, as shown in FIG. 56, the toner developing container 12 is placed with the toner supply opening 12*a*1 face up and the toner accommodating portion 10*a* at a lower position. A free end of a funnel 47 is inserted into the opening 12*a*1, and the toner falls from the toner bottle 48 onto the funnel 47. After the toner filling, the developing blade 10*e* and the developing roller 10*d* are remounted in the same manner as with the case described above. A metering supplying device provided with an auger may preferably provided in the funnel, since then the toner can be efficiently supplied.

Thus, the toner filling step into the toner accommodating portion 10*a* through the toner supply opening 12*a*1 is completed.

The toner does not leak out through the gap g in the form of a crank at the end portions of the developing device frame 12*a* and the lower developing frame 12*b* because of the sealing material 64 provided as described hereinbefore.

The toner end lateral seal 66 is effective to prevent the leakage which may otherwise occur between the jaw seal (blow-out preventing seal) 42 and the end seal 34.

In addition to the end lateral seal 66, the jaw groove filling seal 68 is effective to seal the end of the end seal 34, and further, the side cover seal 69 is effective to back up the sealing function of the jaw seal 42 and the end seal 34, so that toner leakage is further prevented.

Moreover, a side pad 65 stuck on the elastic blade 10*e*1 of the developing blade 10*e* is contacted to the comer formed between the seal 35 and the end seal 34, and therefore, the longitudinal end of the elastic blade 10*e*1 is closely contacted to the developing roller 10*d*, and is sealed by the side pad 65, and the toner is prevented from leaking out of the longitudinal ends of the elastic blade 10*e*1.

Therefore, no toner leaks out of the inside of the toner developing container 12 having the developing roller 10*d* and the developing blade 10*e* during normal transportation and handling.

(Coupling of Toner Developing Container and Cleaner Container)

The coupling step for the toner developing container 12 and the cleaner container 13 is similar to the coupling for the toner developing container 12 and the cleaner container 13 having the toner seal. Therefore, a description will be provided of this step in conjunction with FIGS. 11, 7, 26.

In FIG. 11, the arm portions 38 of the toner developing container 12 are inserted into the recesses 13*h* of the cleaner container 13. As shown in FIG. 26, the through hole 38*b* and the elongated bore 38*b*1 of the arm portion 38 are aligned with the holes 13*c* on the outer wall surface 13*q* of the cleaner container 13. When the hole 13*c* and the through hole 38*b* and the elongated bore 38*b*1 are aligned, the through hole 38*b* and the elongated bore 38*b*1 are aligned with the holes 13*e* in the surface 13*d* of the inner wall of the cleaner container 13. Then, the pin 41 is inserted through the holes 13*c* of the cleaner container 13 and the hole 38*b* and the elongated bore 38*b*1 of the arm portion 38 of the toner developing container 12. Further, the pin 41 is press-fitted into the hole 13*e* in the inner wall of the cleaner container 13. As shown in FIG. 7, the end portions of the tension coil spring 59 are hooked on the spring hook 12*a*29 of the toner developing container 12 and the spring hook 13*p* of the cleaner container 13, and thus the tension coil spring 59 is stretched. By this, the photosensitive drum 7 is press-contacted to the spacer rollers 10*d*1 at the end portions of the developing roller 10*d*.

In this manner, the remanufacturing of the process cartridge is possible without remounting of the toner seal 31.

(Remanufacturing of Cleaner Container)

During the remanufacturing of the toner developing container 12, the separated cleaner container 13 is remanufactured.

Figure 47:
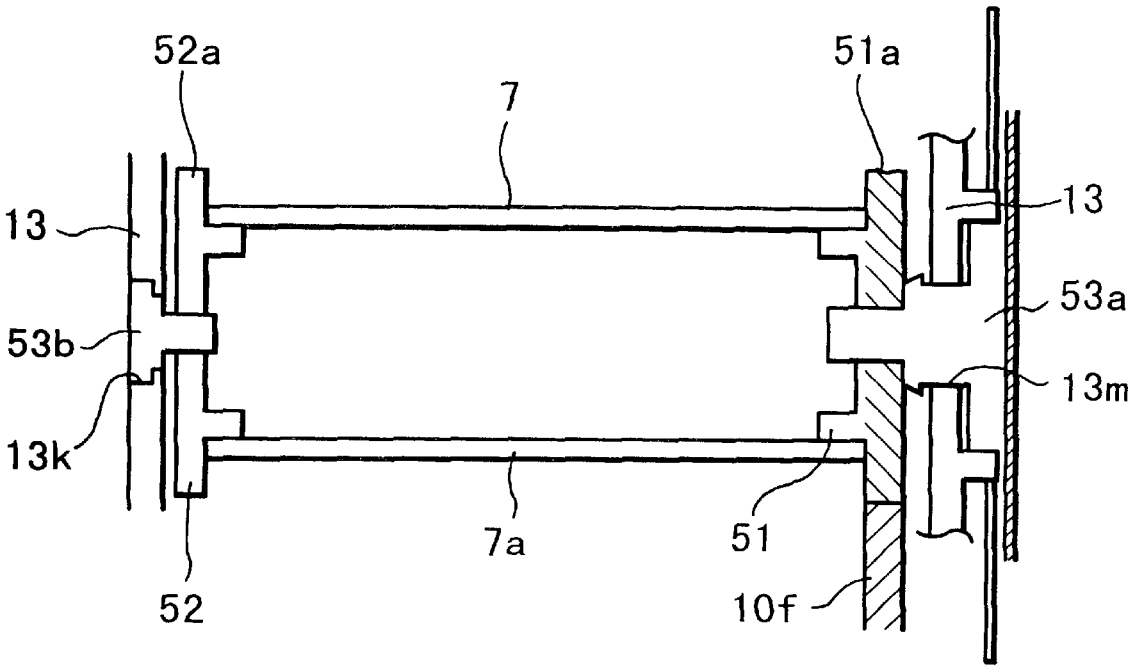
FIG. 47 is a longitudinal sectional view of a support structure for the photosensitive drum.
Figure 48:
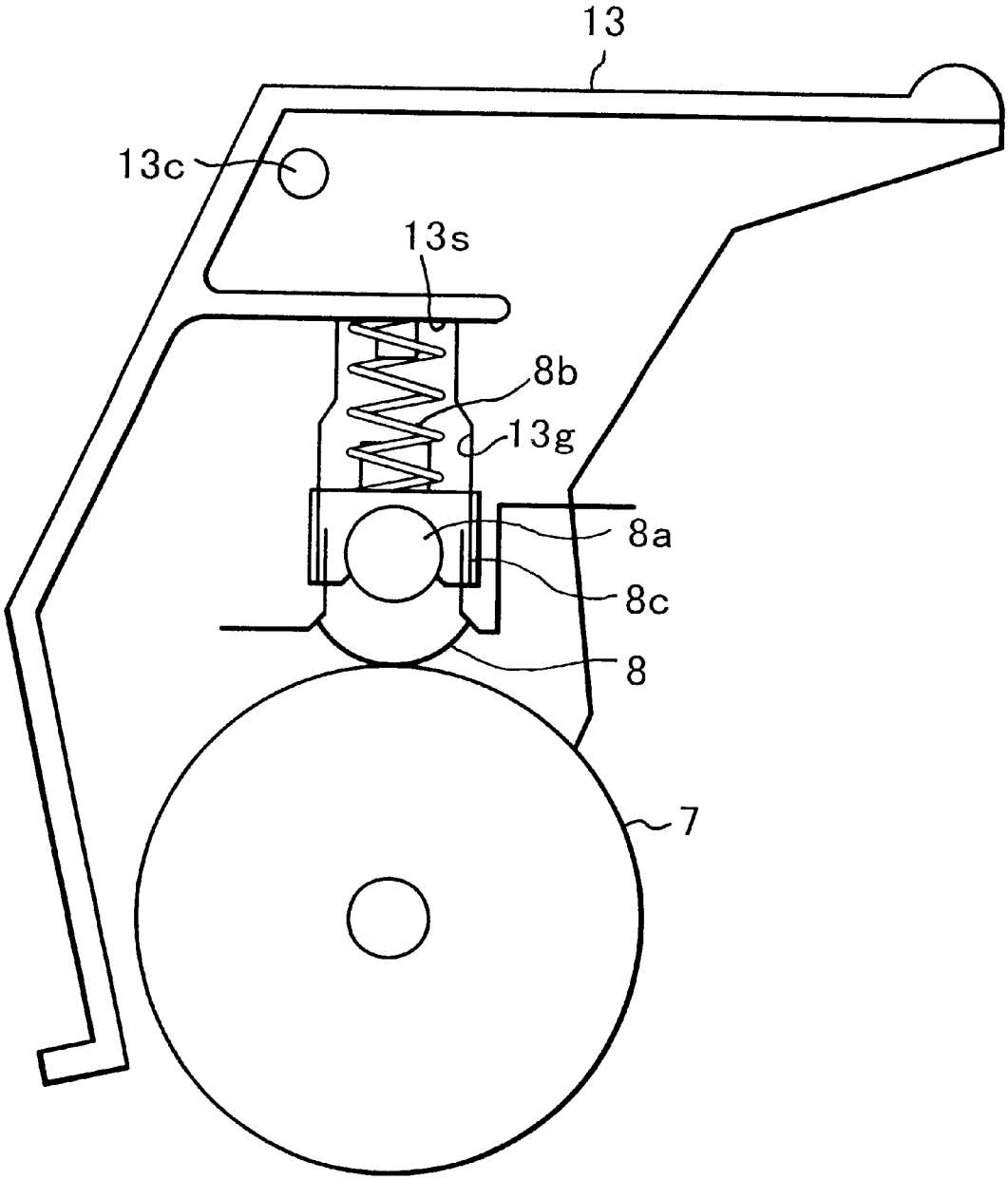
FIG. 48 is a side view of a support structure for the charging roller.

FIG. 11 is a perspective view showing the cleaner container 13 having the photosensitive drum 7, the charging roller 8, and the cleaning blade 11*a*. FIG. 47 is a longitudinal sectional view wherein the photosensitive drum 7 is mounted to the cleaner container 13. FIG. 48 shows a structure for supporting the charging roller 8 on the cleaner container 13.

As shown in FIG. 47, the photosensitive drum 7 is provided at one end of the drum cylinder 7*a* (hollow aluminum cylinder) having a photosensitive layer thereon with a flange 51 and is provided at the other end with a flange 52. The flanges are fixed to the drum by bonding or crimping. The flange 51 is provided with a drum gear 51*a*. The flange 52 has a transfer roller driving gear 52*a*. The drum shafts 53*a*, 53*b* penetrating the flanges 51, 52, are received by holes 13*k*, 13*m* of the cleaner container 13 and are supported by the cleaner container 13. When the process cartridge B is mounted to the main assembly 14 of the image forming apparatus, the drum gear 51*a* is brought into meshing engagement with the driving gear 22 of the main assembly 14 of the image forming apparatus shown in FIG. 2, and the transfer roller driving gear 52*a* is brought into meshing engagement with the unshown gear fixed to the transfer roller 4. When the coupling between the cleaner container 13 and the toner developing container 12 is completed, the drum gear 51*a* is engaged with the developing roller gear 10*f* of the developing roller 10*d*.

As shown in FIG. 48, the charging roller 8 comprises a metal shaft 8*a* and a rubber roller thereon having an intermediate resistance, and the metal shaft 8*a* is exposed at the end portions.

As shown in FIG. 48, the shaft 8*a* of the charging roller 8 is rotatably engaged in charging roller bearings 8*c* which is slidably engaged in the guide groove 13*g* extending substantially on a line connecting the centers of the photosensitive drum 7 and the charging roller 8. The charging roller bearing 8*c* is urged toward the photosensitive drum 7 by the compression coil spring portion 8*b* which is compressed between the charging roller bearing 8*c* and the spring seat 13*s* at one end of the guide groove 13*g*, so that charging roller 8 is press-contacted to the photosensitive drum 7. The charging roller 8 is driven by the photosensitive drum 7. The compression coil spring 8*b* is held in the bearing 8*c*.

An unshown electrode contacts the metal shaft 8*a* of the charging roller 8, and is extended to the outside of the process cartridge B. The outer contact portion of the electrode is electrically connected with a contact portion of the main assembly 14 of the image forming apparatus which is connected with an outer contact portion in the main assembly.

The cleaning blade 11*a*, as shown in FIG. 4, comprises a metal blade 11*a*2 and an elastic blade 11*a*1 of rubber or the like fixed to the metal blade 11*a*2 and contacted to the photosensitive drum 7 along a generating line thereof. As shown in FIG. 4, the cleaning blade 11*a* is fixed to the cleaner container 13 by threading a small screw 11*a*4 through a hole at the end portions of the metal blade 11*a*2.

A description will be provided as to dismounting of the photosensitive drum 7, the charging roller 8 and the photosensitive drum 7 from the cleaner container 13.

The photosensitive drum 7 is dismounted from the cleaner container 13 when the shafts 53*a*, 53*b* are pulled out of the center holes of the flange 51, 52, shown in FIG. 47.

When the photosensitive drum 7 is dismounted, the charging roller 8 is moved in a direction perpendicular to the axis, so that bearings 8*c* are moved along the guide groove 13*g*, by which the bearing 8*c* is dismounted from the guide groove 13*g* together with the charging roller 8. The bearing 8*c* is disengaged from the shaft 8*a*, and the compression coil spring 8*b* is dismounted. In this manner, an opening G, between the cleaning blade 11*a* and the receptor sheet 11*b* and extending in the longitudinal direction, appears (FIG. 4).

The removed photosensitive drum 7, the charging roller 8 and the bearings 8*c*, are subjected to inspections to determine whether to reuse the cartridge or not, and if it should be reused, it is assembled into the cleaner container 13 in the reassembling operation which will be described hereinafter, and if not, a new part or parts are used. Usually, however, the photosensitive drum 7 has such a long lifetime that it is still usable at the time when the toner is used up.

(Removal of Residual toner in Cleaner Container)

The residual toner in the cleaner container 13 is removed after the photosensitive drum 7, the charging roller 8, the bearing 8*c* and the like are removed.

Figure 49:
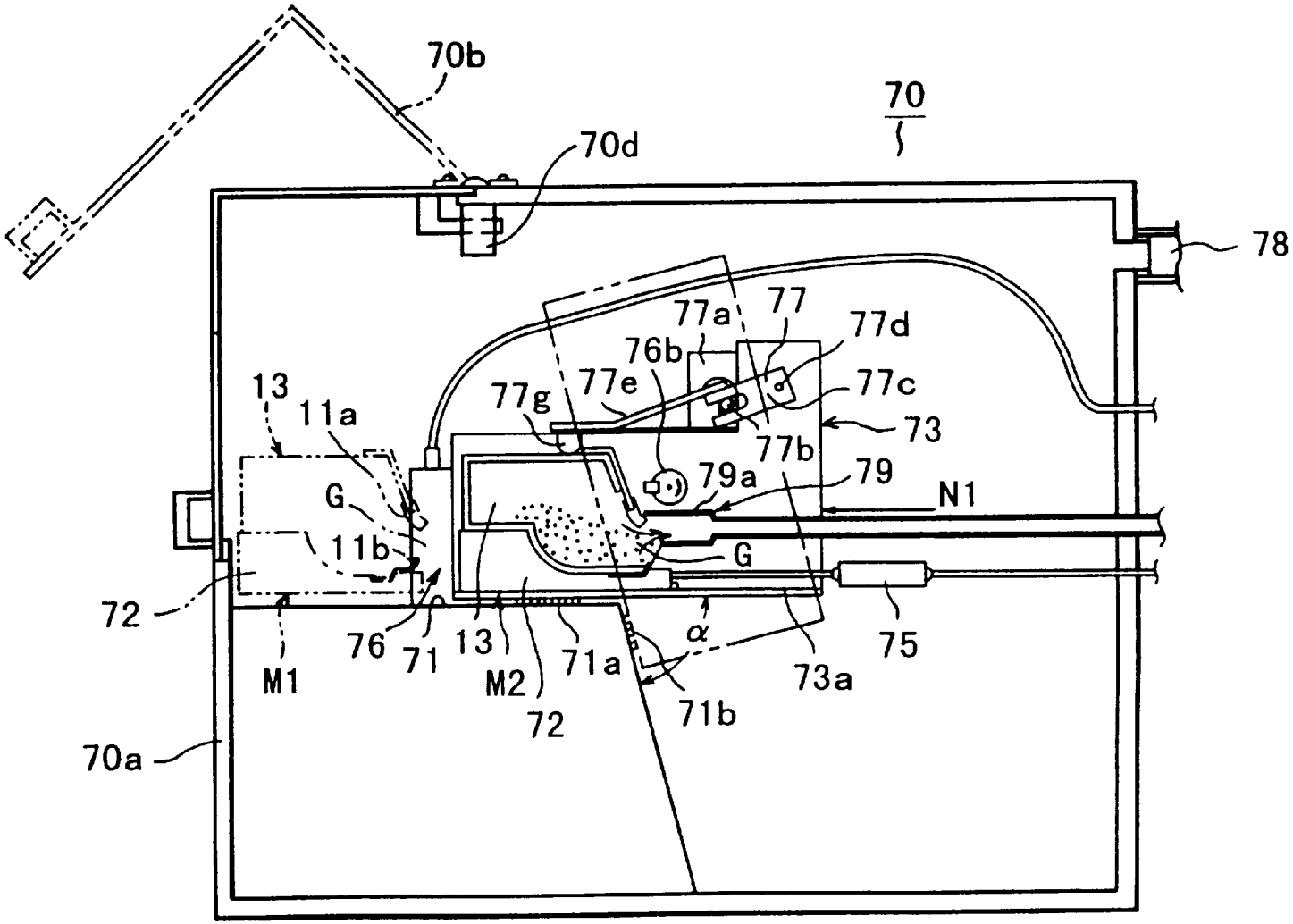
FIG. 49 is a longitudinal sectional view of a cleaning device for a cleaner container.
Figure 50:
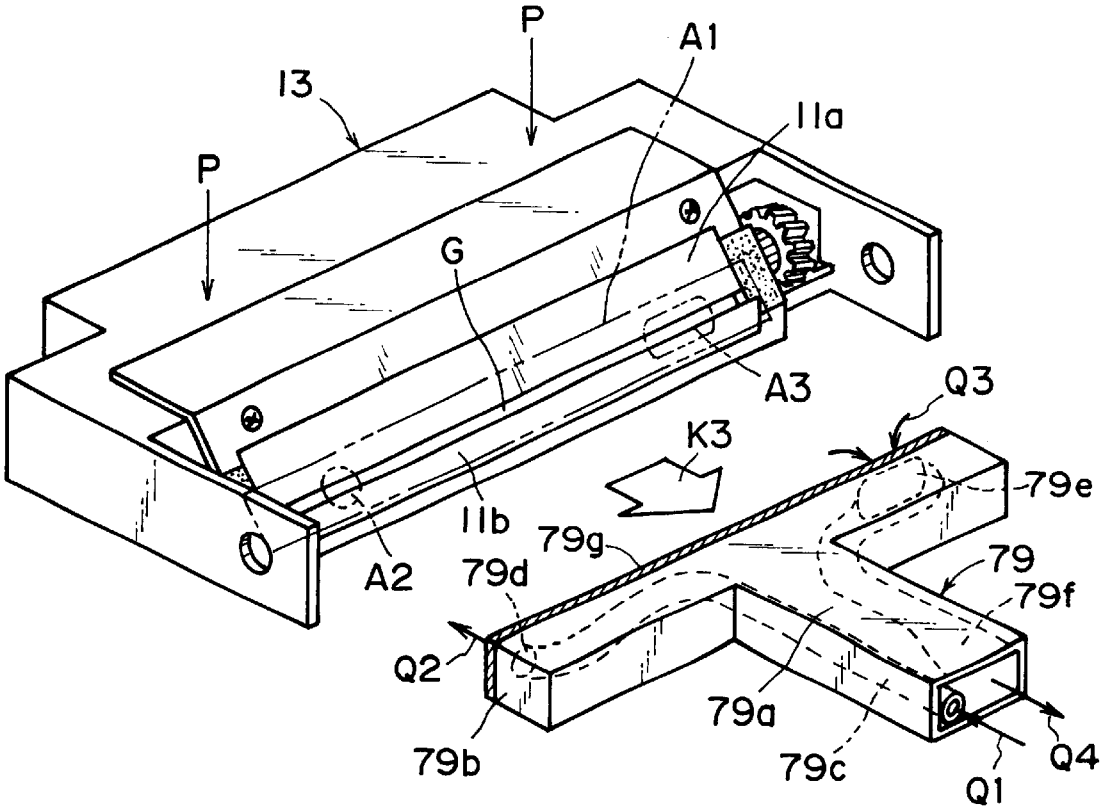
FIG. 50 is a perspective view of a nozzle of the cleaning device.
Figure 51:
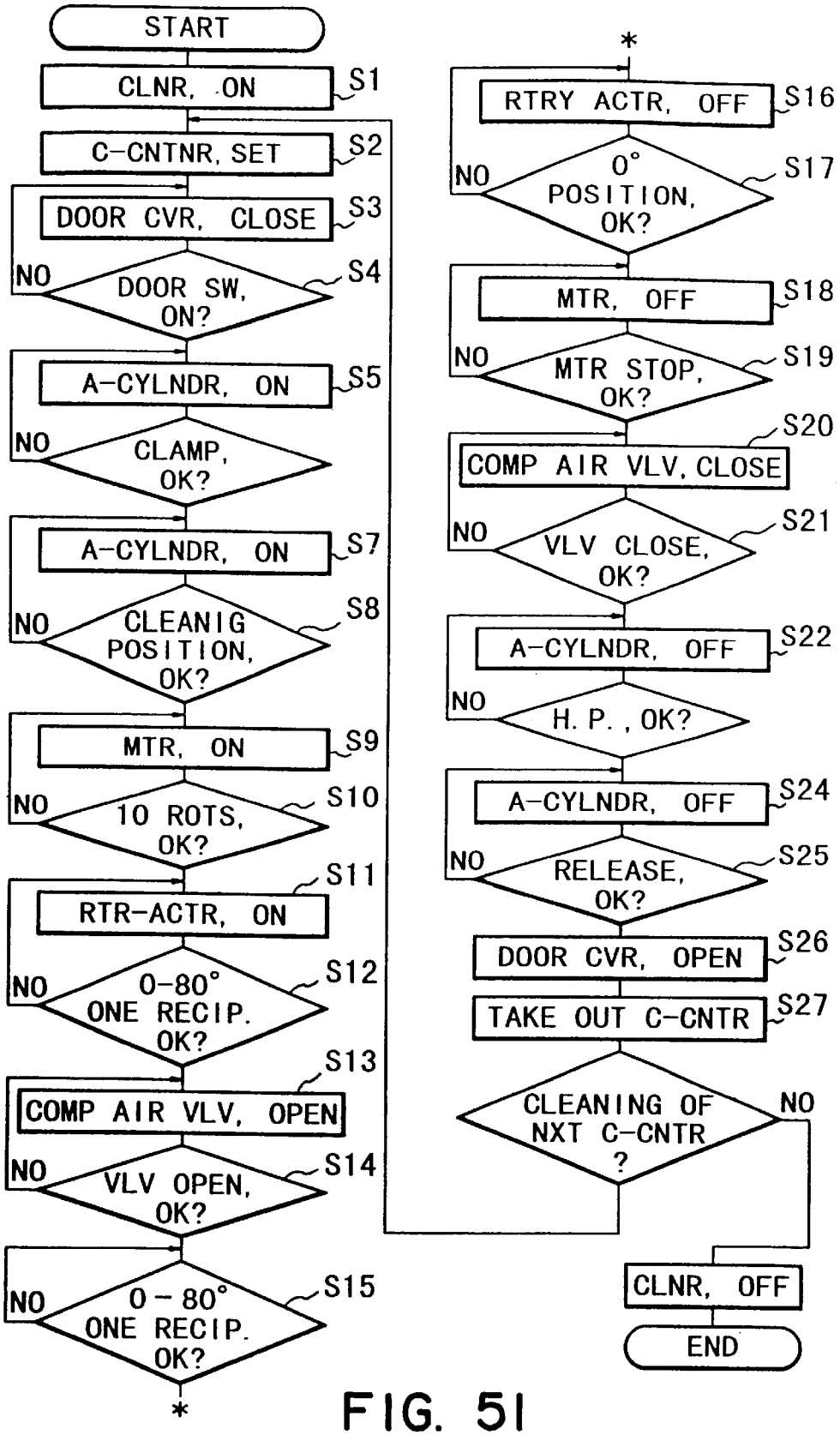
FIG. 51 is a flow chart of the cleaning function.

Referring to FIGS. 49, 50, 51, a description will be provided as to the removal of the toner contained in the removed toner accommodating portion 11*c* of the cleaner container 13.

FIG. 49 shows a cleaning device for the cleaner container. The cleaner container 13 is set in a casing 70*a* of the cleaning device 70. The casing 70*a* seals the inside against the atmosphere. The cleaner container 13 is impacted by an impacting device 77 which is carried on the pivoting device 73, and the residual toner is sucked out of the set by a suction device 79. Simultaneously, the cleaner container 13 is swung about a shaft 76*b* by a swing device 73.

FIG. 50 shows details of an air block 79*a* of the suction device 79. The air block 79*a* is generally hollow, and has a close contact surface 79*g* to be contacted to the edge of the opening G of the cleaner container 13, the close contact surface 79*g* being coated with a rubber-like seal member 79*b* except for the ejection opening 79*d* and the suction opening 79*e*. An air supply tube 79*c* for supplying the air into the cleaner container 13 is disposed in the air block 79*a*, and an air blow opening 79*d* opens adjacent a longitudinal end of the above-described close contact surface 79*g*. Furthermore, a suction tube 79*f* is disposed in the air block 79*a*, and the suction opening 79*e* of the suction tube 79*f* is disposed adjacent the other end of the close contact surface 79*g*. The close contact surface 79*g* having the air blow opening 79*d* and the suction opening 79*e* is contacted to the cleaning blade 11*a* and the receptor sheet 11*b* of the cleaner container 13 which has been moved in the direction of arrow K3 to a cleaning position M2 by a table 72, so that the opening G between the edges of them is completely covered. This is indicated by chain lines in the opening G in FIG. 50, more particularly, the sealing range Al, air blowing opening A2 and the air discharging outlet A3. The sealing range A1, the air blowing opening A2, and the air discharging outlet A3 correspond to the close contact surface 79*g*, the air blow opening 79*d*, and the suction opening 79*e*, respectively. In the suction device 79, compressed air Q1 is supplied into the cleaner container 13, which closely contacts the air block 79*a*, from the air supply tube 79*c* through the air blow opening 79*d*, which closely contacts the air blowing opening A2 and through the opening G (arrow Q2) to scatter the residual toner; and the residual toner and the air are sucked from the cleaner container 13 through the suction opening 79*e*, which closely contacts the air discharging outlet A3 (arrow Q3), into the suction tube 79*f* (arrow Q4).

The residual toner leaked out of the air block 79*a* and cleaner container 13, is sucked by an auxiliary suction device (unshown) with the atmosphere in the suction device 75 through the ambience suction opening 78, as shown in FIG. 49.

Referring to FIGS. 49 and 50 and a flow chart of FIG. 51, a description will be provided as to the cleaning method of the cleaner container 13 and the operation of the cleaning device 70 in detail.

The operation of the cleaning device (cleaner) 70 is started at step (S1). Then, the cleaner container 13 to be cleaned is placed on the top of a table 72, which is at a home position at this time (S2). The cover 70*b* is closed (S3), which event is detected by a sensor (door switch) 70*d* (S4), and an air cylinder of a clamping device (unshown) is actuated (S5), by which the top side of the cleaner container 13 is pushed.

By this, the cleaner container 13 is clamped on the table 72 at a predetermined position. An air cylinder 75 having a piston rod directly connected to the table 72 is actuated (S7), so that table 72 moves from the home position M1 on the slide base 71 to a cleaning position M2 in the swing device 73 (S8), and the opening G of the cleaner container 13 is closely contacted to the surface 79*g* of the suction device 79.

Then, a motor 77*a* is actuated (S9), and the impacting device 77 is started, by which the pin 77*b* of the crank to which the shaft of the motor 77*a* is fixed is swung about a pin 77*d* supporting the yoke 77*c*. Impact is applied to a point P (FIG. 50) on the top side of the cleaner container 13 by a hummer 77*g* fixed to an end of the leaf spring arm 77*e* fixed to the yoke 77*c* (S10). By doing so, the residual toner deposited on the inner wall of the cleaner container 13 is forced to fall, and the mobility of the residual toner is enhanced. A rotary actuator 76 is started (S11), and the swing table 73*a* of the swing device 73 reciprocate about a shaft 76*b* swingablely supporting the swing table 73*a* within the range of $\alpha$=0–80°. The swing table 73*a* is stopped by abutting stoppers 71*a*, 71*b*, the positions of which are adjustable. A stop valve (unshown) for the compressed air is opened (S13, S14) to supply the compressed air into the cleaner container 13 through the air blow opening 79*d* (FIG. 50) and the opening G, and simultaneously, the air in the cleaner container 13 is sucked through the opening G and the suction opening 79*e* together with the residual toner. The operation is continued for a proper period.

The swing table 73*a* is swung through one reciprocation (S15). A rotary actuator 76 is deactivated (S16), and the horizontal position N1 of the swing table 73*a* is checked (S17), and then, the motor 77*a* is deactivated (S18, S19), so that impact imparted by the hammer to the position N1 ends. The stop valve is closed (S20, S21). The air cylinder 75 is urged in the reseting direction (S22), and then, the table 72 located at the cleaning position M2 is returned to the home position M1. In response this, an unshown clamping air cylinder is deactivated (S24), and the clamp of the cleaner container 13 relative to the table 72 is released (S25). Then, the cover 70*b* is opened (S26), and the cleaner container 13 is taken out of the casing 70*a* (S27). This is the end of the cleaning operation for the cleaner container 13.

In the cleaning step, the impact to the cleaner container 13 by the device 77 continues in the period between the steps S9 and S18 in the flow chart of FIG. 51, and contemporaneously therewith, the swing action of the cleaner container 13 and the suction of the residual toner are carried out. Thus, the residual toner deposited on the inner wall or the like of the cleaner container 13 are beaten out, and the residual toner is smoothly moved toward the opening G. The compressed air blown out from the air blow opening 79*d* is effective to scatter around in the cleaner container 13, and the residual toner is sucked from the suction opening 79*e*. By the series of the operations, the residual toner can be substantially completely removed from the cleaner container 13.

After the cleaning, the cleaning blade 11*a* is removed from the cleaner container 13 by unthreading the small screw 11*a*4 (FIG. 4). Then, the receptor sheet 11*b* is removed from the cleaner container 13. Then, while sucking the air from the inside of the cleaner container 13, compressed air is blown into the cleaner container 13, thus cleaning the inside of the cleaner container 13. Thereafter, a new receptor sheet 11*b* is stuck on the cleaner container 13. Holes 11*a*3 of a new cleaning blade 11*a* at the end portions (FIG. 11 shows only one end portions) are brought into engagement with the positioning projections 13*i* of the cleaner container 13, and a small screw 11*a*4 is threaded into the cleaner container 13 through the hole of the metal blade 11*a*2.

Then, a charging roller 8, engaged with the bearings 8*c* to which the compression coil springs 8*b* are mounted, is mounted on the shaft 8*a*. This is done by engaging the bearing 8*c* into the guide groove 13*g* with the compression coil spring 8*b* at the leading side. Thereafter, as shown in FIGS. 47, the photosensitive drum 7 is engaged between the end walls of the cleaner container 13, and the center holes 51*b*, 52*b* of the flanges 51, 52 are aligned with holes 13*k*, 13*m* in the end walls at the opposite ends of the cleaner container 13, and then, the drum shafts 53*a*, 53*b* are engaged into the holes 13*k*, 51*b*, 52*b*, 13*m*. The drum shafts 53*a*, 53*b* are press-fitted in the holes 13*m*, 13*k*, and the drum shafts 53*a*, 53*b* are slidably engaged in the holes 51*b*, 52*b*. The photosensitive drum 7 in the unit is rotatable on the drum shafts 53*a*, 53*b*.

(Gap between Photosensitive Drum and Developing Roller)

Figure 52:
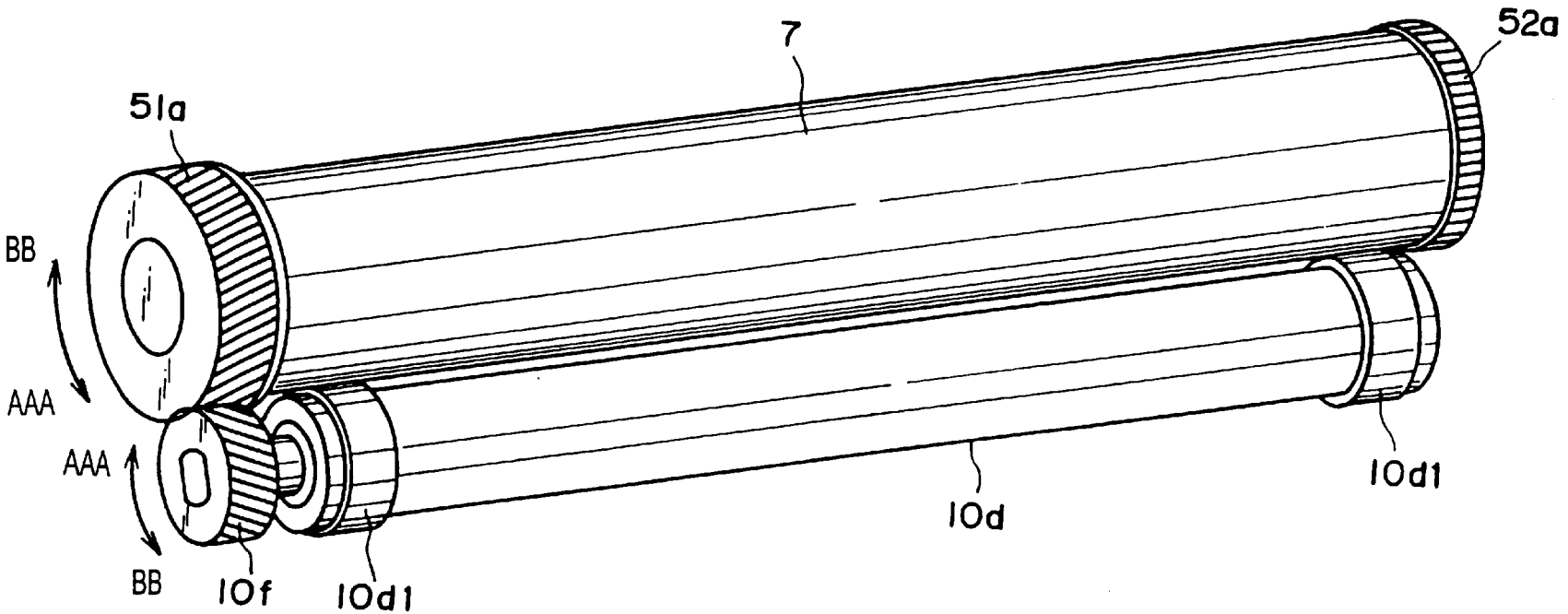
FIG. 52 is a perspective view of the photosensitive drum and the developing roller during an image forming operation.

When the photosensitive drum 7 and the developing roller 10*d* contact each other, the drum gear 51*a* and the developing roller gear 10*f* are in meshing engagement with each other. When the process cartridge is transported, with the drum gear 51*a* and the developing roller gear 10*f* in meshing engagement with each other, the tooth surfaces of the gears are in contact, and therefore, they may be rotated by impact or vibration. If the direction of the rotation is as indicated by an arrow AAA in FIG. 52 (the same direction as in the image forming operation), there is no problem. However, the direction of the rotation is not assured, since the vibration or the impact during the transportation occurs at random. If the photosensitive drum 7 rotates in the direction indicated by an arrow BB, that is, if the photosensitive drum 7 and the developing roller 10*d* are rotated in the direction opposite from the normal direction, toner may leak out through between the jaw seal 42 (blow-out preventing sheet) and the developing roller 10*d*, and in the worst-case, the seal 42 may be wound around the developing roller since the preventing sheet contacts the developing roller counter directionally. In addition, the scraper 60 mounted to each of the opposite ends of the developing blade 10*e* and functioning to guide the toner inwardly at the opposite ends of the developing roller 10*d* can operate correctly when the developing roller 10*d* rotates in the normal direction, and therefore, if it is rotated in the wrong direction, the toner may leak out at the opposite ends of the developing roller 10*d*.

In this embodiment, the back clearance of the meshing between the drum gear 51*a* and the developing roller gear 10*f* is made larger than that during image formation to avoid abutment between the tooth surfaces during the transportation. Another alternative is to disengage them for the transportation.

Figure 53:
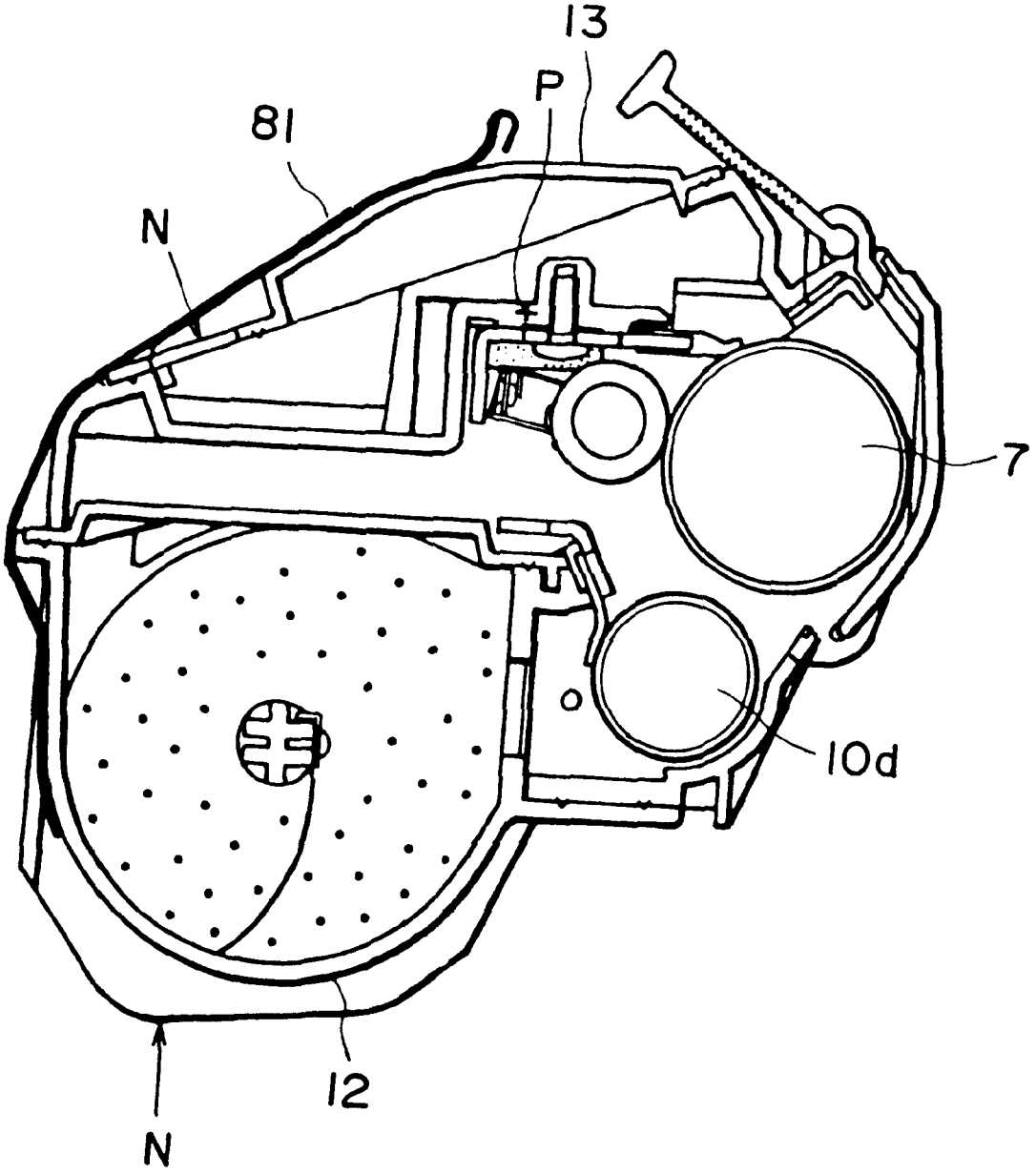
FIG. 53 is a longitudinal sectional view of the process cartridge during the transportation thereof.
Figure 54:
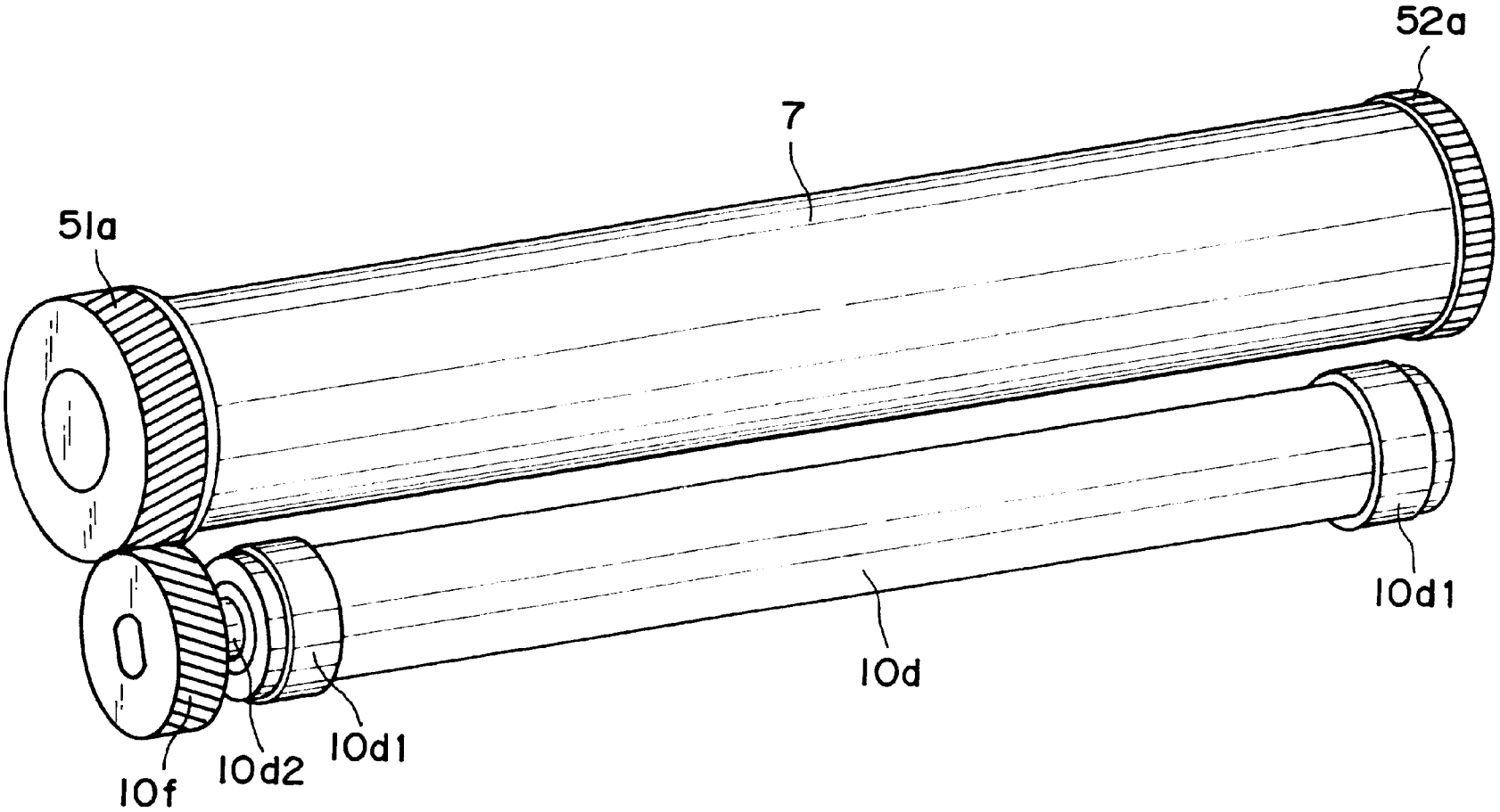
FIG. 54 is a perspective view illustrating the relationship between the photosensitive drum and the charging roller during transportation of the process cartridge.
Figure 55:
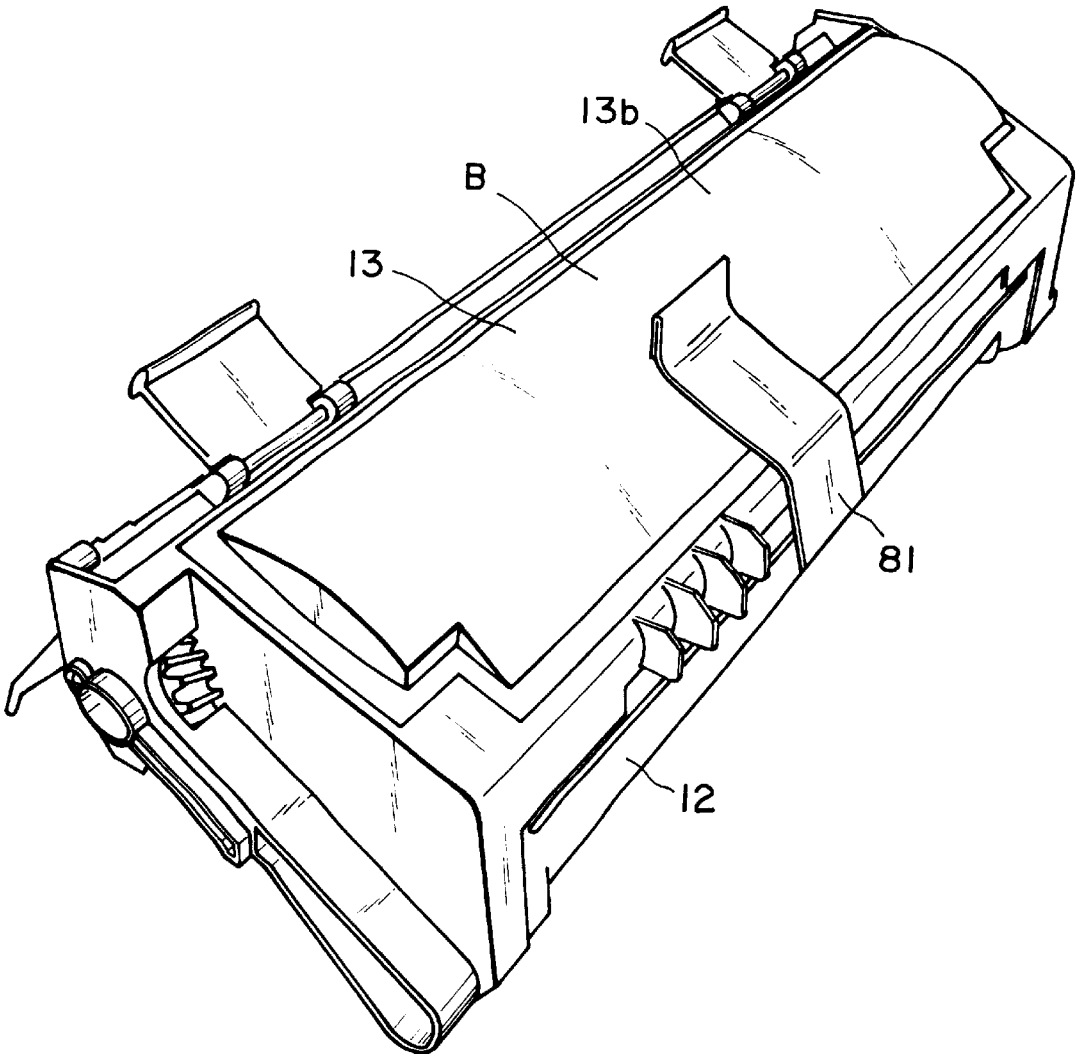
FIG. 55 is a perspective view of a process cartridge during transportation thereof.

Referring to FIG. 54, a description will be provided as to means for maintaining the disengaged state or large back clearance between the drum gear 51 a and the developing roller gear 10*f*. In the case of FIG. 53, a tape 81 is stuck over the toner developing container 12 and the cleaner container 13 with the drum gear 51*a* and the developing roller gear 10*f* disengaged from each other or with a large back clearance.

More particularly, a force is applied to the toner developing container 12 and the cleaner container 13 toward each other and positions across a vertical surface passing through a point P, which is a pivot between the toner developing container 12 and the cleaner container 13, from the portion where the photosensitive drum 7 and the developing roller 10*d* are provided, as indicated by an arrow N in FIG. 53, by which the back clearance between the drum gear 51*a* and the developing roller gear 10*f* is increased, or they are disengaged from each other. The force is against the spring force provided by the tension coil spring 59 (FIG. 7) and the compression coil spring 40 (FIG. 11) for urging the photosensitive drum 7 and the developing roller 10*d* toward each other. Therefore, the tape 81 is stretched by the springs 40, 59. Therefore, the tape 81 has sufficient width and thickness such that stress during the transportation is within a tolerable range, and in addition, the adhesive material or 5 the adhesive material for the tape has also sufficient bonding strength against the toner developing device frame 12*a* and the cleaner container 13.

The foregoing embodiments are summarized as follows.

1. A remanufacturing method of remanufacting a process cartridge B comprises:
   (a) a step of preparing a used process cartridge B, which comprises a toner developing container 12, a cleaning container 13 and pins for coupling the toner developing container 12 and the cleaning container 13 at opposite longitudinal ends of the process cartridge 8, the toner developing container 12 including a toner accommodating portion 10*a*, a toner supply opening 12*a*1, a developing roller 10*d* and a developing blade 10*e*, the toner developing container 12 being provided adjacent the opposite ends with a cut-away portion 12*d* for passing a laser beam for measuring a gap between the photosensitive drum and the developing roller 10*d;*
   the cleaning container 13 including an electrophotographic photosensitive drum 7;
   (b) a container separating step of separating the process cartridge B into the toner developing container 12 and the developing container by disengaging the pins from the process cartridge B;
   (c) a developing roller 10*d* dismounting step of dismounting the developing roller 10*d* from the toner developing container 12 separated by the container separating step;
   (d) a developing blade 10*e* dismounting step of dismounting the developing blade 10*e* from the toner developing container 12 separated by the container separating step;
   (e) a cut-away portion 12*d* sealing step of sealing with a seal the cut-away portion of a or the toner developer container;
   (f) a developing blade 10*e* mounting step of mounting a developing blade or the developing blade 10*e* on the toner developer container having the cut-away portion 12*d* sealed with the seal mounted thereto;
   (g) a developing roller 10*d* mounting step of mounting a developing roller or the developing roller 10*d* on the toner developer container having the cut-away portion 12*d* sealed with the seal mounted thereto;
   (h) a toner refilling step of refilling the toner into a toner accommodating portion or the toner accommodating portion 10*a* of the toner developing container 12 having the seal, the developing blade 10*e* and the developing roller 10*d*; and
   (i) a container coupling step of coupling the toner developing container 12 having the seal, the developing blade 10*e* and the developing roller 10*d* with a cleaning container or the cleaning container 13 by engaging a pin or the pin 41 into them.

By this, arrangement toner leakage through the cut-away portion 12*d* can be effectively prevented.

2. A method according to Paragraph 1, further comprising a flexible sheet 42 mounting step of mounting, after the cut-away portion 12*d* sealing step and before the toner refilling step, a flexible sheet 42 to the toner developing container 12 so as to extend along the longitudinal direction of the developing roller 10*d* when the developing roller 10*d* is mounted to the toner developing container 12.
3. A method according to Paragraph 2, wherein in the flexible sheet 42 mounting step, each of longitudinal ends of the flexible sheet 42 extends over a part of the sealing material and a part of the end seal 34.
4. A method according to Paragraph 2 or 3, further comprising first and second side seal 64 mounting steps of mounting, after the flexible sheet 42 mounting step, a first side seal 64 continuously on a longitudinal end of the flexible sheet 42 mounted on the toner developing container 12 and the toner developing container 12, and mounting a second side seal 64 continuously on the other longitudinal end of the flexible sheet 42 and the toner developing container 12.

By this arrangement, the leakage through the seal 42 and the sealing material 63 can be prevented.

5. A remanufacturing method of remanufacting a process cartridge B comprises:
   (a) a step of preparing a used process cartridge B which comprises a toner developing container 12, a cleaning container 13 and pins for coupling the toner developing container 12 and the cleaning container 13 at opposite longitudinal ends of the process cartridge B,
   the toner developing container 12 including a toner accommodating portion 10*a*, a toner supply opening 12*a*1, a developing roller 10*d* and a developing blade 10*e*, the toner developing container 12 being provided adjacent the opposite ends with a cut-away portion 12*d* for passing a laser beam for measuring a gap between the photosensitive drum and the developing roller 10*d;*
   the cleaning container 13 including an electrophotographic photosensitive drum 7;
   (b) a container separating step of separating the process cartridge B into the toner developing container 12 and the developing container by disengaging the pins from the process cartridge B;
   (c) a developing roller 10*d* dismounting step of dismounting the developing roller 10*d* from the toner developing container 12 separated by the container separating step;
   (d) a developing blade 10*e* dismounting step of dismounting the developing blade 10*e* from the toner developing container 12 separated by the container separating step:
   (e) a cut-away portion 12*d* sealing step of sealing with a seal a cut-away portion or the cut-away portion of a toner developer container or the toner developer container;
   (f) a flexible sheet 42 mounting step of mounting a flexible sheet 42 to the toner developing container 12 having the cut-away portion 12*d* so as to extend along the longitudinal direction of the developing roller 10*d* when the developing roller 10*d* is mounted to the toner developing container 12;
   (g) first and second side seal mounting steps of mounting a first side seal continuously on a longitudinal end of the flexible sheet 42 mounted on the toner developing container 12 having the cut-away portion 12*d* and the toner mounting developing container 12 having the cut-away portion 12*d*, and mounting a second side seal continuously on the other longitudinal end of the flexible sheet 42 and the toner developing container 12 having the cut-away portion 12*d;*
   (h) a developing blade 10*e* mounting step of mounting a developing blade or the developing blade 10*e* on the toner developer container having the cut-away portion 12*d* sealed with the seal mounted thereto;

(i) a developing roller 10*d* mounting step of mounting a developing roller or the developing roller 10*d* on the toner developer container having the cut-away portion 12*d* sealed with the seal mounted thereto;

(j) a toner refilling step of refilling the toner into a toner accommodating portion or the toner accommodating portion 10*a* of the toner developing container 12 having the seal, the developing blade 10*e* and the developing roller 10*d*; and (k) a container coupling step of coupling the toner developing container 12 having the seal, the developing blade 10*e* and the developing roller 10*d* with a cleaning container or the cleaning container 13 by engaging a pin or the pin 41 into them.

By this arrangement, the leakage of the toner can be prevented, without sealing the toner supply opening 12*a*1.

6. A method according to Paragraph 1 or 5, wherein the seal is mounted on toner developing container 12 after the developing blade 10*e* dismounting step.

7. A method according to any one of Paragraphs 1 to 6, wherein the seal is made of a plastically deformable material.

The sponge sealing material is contacted to the wall of the cut-away portion 12*d*. The sealing material, which is plastically deformable, can seal the cut-away portion 12*d* without a gap.

8. A method according to any one of Paragraphs 1 to 7, wherein the toner refilling step is carried out through a toner filling opening after the cut-away portion 12*d* sealing step, the developing blade 10*e* mounting step and the developing roller 10*d* mounting step.

By this arrangement, the toner can be refilled even if the toner filling opening cannot be opened.

9. A method according to any one of Paragraphs 1 to 8, wherein in the developing blade 10*e* mounting step, a new developing blade 10*e* or a used developing blade 10*e* is mounted.

By this arrangement, the toner filling equipment for a new process cartridge Bs can be used for the refilling.

10. A method according to any one of Paragraphs 1 to 9, wherein in the developing roller 10*d* step, a new or used developing roller 10*d* is mounted.

11. A method according to any one of Paragraphs 1 to 10, wherein prior to the container coupling process, the electrophotographic photosensitive drum 7 and the cleaning blade are dismounted from the cleaner container, and toner which has been removed from the electrophotographic photosensitive drum 7 and accommodated in the cleaner container, is removed.

12. A method according to Paragraph 11, wherein after the toner is removed, a new or used electrophotographic photosensitive drum 7 and a new or used cleaning blade are mounted.

13. A method according to any one of Paragraphs 1 to 12, wherein the remanufacturing method is implemented with a toner seal for sealing a toner supply opening 12*a*1 provided to supply the toner accommodated in the toner accommodating portion 10*a* to the developing roller 10*d* having been pulled out to supply toner accommodated in the toner accommodating portion 10*a* to the developing roller 10*d*.

14. A method according to any one of Paragraphs 1 to 5, wherein the process cartridge B comprises a gear fixed co-axially with the electrophotographic photosensitive drum 7 and a gear fixed co-axially with the developing roller 10*d*, which gears are in meshing engagement, and wherein after the container coupling process, the toner developing container 12 and the cleaner container are rotated about the pin 41 to disengage the gears from each other or to make a back clearance of the meshing engagement larger than that during image forming operation, and the disengagement or larger back clearance is maintained.

15. A method according to Paragraph 14, wherein the toner developing container 12 and the cleaner container are rotated toward each other about the pin 41 at a portion across the pin 41 from the electrophotographic photosensitive drum 7, and a tape is stuck on the toner developing container 12 and the cleaner container to maintain the disengagement or the larger back clearance.

According to the present invention, an easy remanufacturing method for process cartridges, and an easy remanufacturing method for process cartridges with which the toner leakage can be effectively prevented, is provided.

While the invention has been described with reference to the structures disclosed herein, it is not confined to the details set forth and this application is intended to cover such modifications or changes as may come within the purpose of the improvements or the scope of the following claims.

What is claimed is:

1. A remanufacturing method of remanufacturing a process cartridge comprising:

(a) a step of preparing a used process cartridge which comprises a toner developing container, a cleaning container and pins for coupling said toner developing container and said cleaning container at opposite longitudinal ends of said process cartridge, said toner developing container including a toner accommodating portion, a toner supply opening, a developing roller and a developing blade, said toner developing container being provided adjacent said opposite ends with a cut-away portion for passing a laser beam for measuring a gap between an electrophotographic photosensitive drum and said developing roller;

said cleaning container including the electrophotographic photosensitive drum;

(b) a container separating step of separating said process cartridge into said toner developing container and said cleaning container by disengaging said pins from said process cartridge;

(c) a developing roller dismounting step of dismounting said developing roller from said toner developing container separated by said container separating step;

(d) a developing blade dismounting step of dismounting said developing blade from said toner developing container separated by said container separating step;

(e) a cut-away portion sealing step of sealing with a seal said cut-away portion of said toner developer container;

(f) a developing blade mounting step of mounting said developing blade on said toner developer container having the cut-away portion sealed with the seal mounted thereto;

(g) a developing roller mounting step of mounting said developing roller on said toner developer container having the cut-away portion sealed with the seal mounted thereto;

(h) a toner refilling step of refilling the toner into said toner accommodating portion of said toner developing container having said seal, said developing blade, and said developing roller; and (i) a container coupling step of coupling said toner developing container having said seal, said developing blade, and said developing roller with said cleaning container having said electrophotographic photosensitive drum by engaging said pins into them.

2. A method according to claim 1, further comprising a flexible sheet mounting step of mounting, after said cut-away portion sealing step and before used developing roller is mounted.

3. A method according to claim 2, wherein in said flexible sheet mounting step, each of the longitudinal ends of said flexible sheet extends over a part of said seal.

4. A method according to claim 2 or 3, further comprising first and second side seal mounting steps of mounting, after said flexible sheet mounting step, a first side seal continuously on a longitudinal end of said flexible sheet mounted on said toner developing container and said toner developing container, and mounting a second side seal continuously on the other longitudinal end of said flexible sheet and said toner developing container.

5. A remanufacturing method of remanufacturing a process cartridge comprising:

(a) a step of preparing a used process cartridge which comprises a toner developing container, a cleaning container and pins for coupling said toner developing container and said cleaning container at opposite longitudinal ends of said process cartridge, said toner developing container including a toner accommodating portion, a toner supply opening, a developing roller, and a developing blade, said toner developing container being provided adjacent said opposite ends with a cut-away portion for passing a laser beam for measuring a gap between an electrophotographic photosensitive drum and said developing roller;

said cleaning container including the electrophotographic photosensitive drum;

(b) a container separating step of separating said process cartridge into said toner developing container and said developing container by disengaging said pins from said process cartridge;

(c) a developing roller dismounting step of dismounting said developing roller from said toner developing container separated by said container separating step;

(d) a developing blade dismounting step of dismounting said developing blade from said toner developing container separated by said container separating step;

(e) a cut-away portion sealing step of sealing with a seal said cut-away portion of said toner developer container;

(f) a flexible sheet mounting step of mounting a flexible sheet to said toner developing container having the cut-away portion sealed with the seal mounted thereto so as to extend along the longitudinal direction of said developing roller when said developing roller is mounted to said toner developing container;

(g) first and second side seal mounting steps of mounting a first side seal continuously on a longitudinal end of said flexible sheet mounted on said toner developing container having the cut-away portion and said toner developing container having the cut-away portion sealed with the seal mounted thereto, and mounting a second side seal continuously on the other longitudinal end of said flexible sheet and said toner developing container having the cut away portion sealed with the seal mounted thereto;

(h) a developing blade mounting step of mounting said developing blade on said toner developer container having the cut-away portion sealed with the seal mounted thereto;

(i) a developing roller mounting step of mounting said developing roller on said toner developer container having the cut-away portion sealed with the seal mounted thereto;

(j) a toner refilling step of refilling the toner into said toner accommodating portion of said toner developing container having said seal, said developing blade, and said developing roller; and (k) a container coupling step of coupling said toner developing container having said seal, said developing blade, and said developing roller with said cleaning container having said electrophotographic photosensitive drum by engaging said pins into them.

6. A method according to claim 1 or 5, wherein said seal is mounted on said toner developing container after said developing blade dismounting step.

7. A method according to claim 1 or 5, wherein said seal is made of sponge or a plastically deformable material.

8. A method according to claim 1 or 5, wherein said toner refilling step is carried out through a toner filling opening after said cut-away portion sealing step, said developing blade mounting step, and said developing roller mounting step.

9. A method according to claim 1 or 5, wherein in said developing blade mounting step, a new developing blade or a used developing blade is mounted.

10. A method according to claim 1 or 5, wherein in said developing roller mounting step, a new or used developing roller is mounted.

11. A method according to claim 1 or 5, wherein prior to said container coupling process, said electrophotographic photosensitive drum and said cleaning blade are dismounted from said cleaner container, and toner which has been removed from said electrophotographic photosensitive drum and accommodated in said cleaning container, is removed.

12. A method according to claim 11, wherein after the toner is removed, a new or used electrophotographic photosensitive drum and a new or used cleaning blade are mounted.

13. A method according to claim 1 or 5, wherein said remanufacturing method is implemented with a toner seal for sealing the toner supply opening provided to supply the toner accommodated in said toner accommodating portion to said developing roller having been pulled out to supply toner accommodated in said toner accommodating portion to said developing roller.

14. A method according to claim 1 or 5, wherein said process cartridge comprises a gear fixed co-axially with said electrophotographic photosensitive drum and a gear fixed co-axially with said developing roller, which gears are in-meshing engagement, and wherein after said container coupling process, said toner developing container and said cleaning container are rotated about said pins to disengage said gears from each other or to make a back clearance of the meshing engagement larger than that during image forming operation, and the disengagement or larger back clearance is maintained.

15. A method according to claim 14, wherein said toner developing container and said cleaning container are rotated toward each other about said pins at a portion across said pins from said electrophotographic photosensitive drum, and a tape is stuck on said toner developing container and said cleaning container to maintain the disengagement or the larger back clearance.

16. A remanufacturing method of remanufacturing a process cartridge comprising:

(a) a step of preparing a used process cartridge which comprises a toner developing container, a cleaning container and pins for coupling said toner developing container and said cleaning container at opposite longitudinal ends of said process cartridge, said toner developing container including a toner accommodating portion, a toner supply opening, a developing roller and a developing blade, said toner developing container being provided adjacent said opposite ends with a cut-away portion for passing a laser beam for measuring a gap between an electrophotographic photosensitive drum and said developing roller;

said cleaning container including the electrophotographic photosensitive drum;

(b) a container separating step of separating said process cartridge into said toner developing container and said developing container by disengaging said pins from said process cartridge;

(c) a developing roller dismounting step of dismounting said developing roller from said toner developing container separated by said container separating step;

(d) a developing blade dismounting step of dismounting said developing blade from said toner developing contained separated by said container separating step;

(e) a cut-away portion sealing step of sealing with a seal said cut-away portion of said toner developer container;

(f) a toner refilling step of refilling the toner into said toner accommodating portion through said toner supply opening for supplying the toner to said developing roller provided in said toner accommodating portion;

(g) a developing blade mounting step of mounting said developing blade on said toner developer container having the cut-away portion sealed with the seal mounted thereto;

(h) a developing roller mounting step of mounting said developing roller on said toner developer container having the cut-away portion sealed with the seal mounted thereto;

said toner accommodating portion of said toner developing container having said seal, said developing blade, and said developing roller, through the toner supply opening of said toner developing container having said seal; and (i) a container coupling step of coupling said toner developing container having said seal, said developing blade, and said developing roller with said cleaning container having said electrophotographic photosensitive drum by engaging said pins into them.

17. A method according to claim 16, further comprising a flexible sheet mounting step of mounting, after said cut-away portion sealing step and before said toner refilling step, a flexible sheet to said toner developing container so as to extend along the longitudinal direction of said developing roller when said developing roller is mounted to said toner developing container.

18. A method according to claim 17, wherein in said flexible sheet mounting step, each of the longitudinal ends of said flexible sheet extends over a part of said seal.

19. A method according to claim 17 or 18, further comprising first and second side seal mounting steps of mounting, after said flexible sheet mounting step, a first side seal continuously on a longitudinal end of said flexible sheet mounted on said toner developing container and said toner developing container, and mounting a second side seal continuously on the other longitudinal end of said flexible sheet and said toner developing container.

20. A remanufacturing method of remanufacturing a process cartridge comprising:

(a) a step of preparing a used process cartridge which comprises a toner developing container, a cleaning container and pins for coupling said toner developing container and said cleaning container at opposite longitudinal ends of said process cartridge, said toner developing container including a toner accommodating portion, a toner supply opening, a developing roller, and a developing blade, said toner developing container being provided adjacent said opposite ends with a cut-away portion for passing a laser beam for measuring a gap between an electrophotographic photosensitive drum and said developing roller;

said cleaning container including the electrophotographic photosensitive drum;

(b) a container separating step of separating said process cartridge into said toner developing container and said developing container by disengaging said pins from said process cartridge;

(c) a developing roller dismounting step of dismounting said developing roller from said toner developing container separated by said container separating step;

(d) a developing blade dismounting step of dismounting said developing blade from said toner developing container separated by said container separating step;

(e) a cut-away portion sealing step of sealing with a seal said cut-away portion of said toner developer container;

(f) a flexible sheet mounting step of mounting a flexible sheet to said toner developing container having the cut-away portion sealed with the seal mounted thereto so as to extend along the longitudinal direction of said developing roller when said developing roller is mounted to said toner developing container;

(g) first and second side seal mounting steps of mounting a first side seal continuously on a longitudinal end of said flexible sheet mounted on said toner developing container having the cut-away portion sealed with the seal mounted thereto and said toner developing container having the cut-away portion sealed with the seal mounted thereto, and mounting a second side seal continuously on the other longitudinal end of said flexible sheet and said toner developing container having the cut away portion sealed with the seal mounted thereto;

(h) a toner refilling step of refilling the toner into said toner accommodating portion through said toner supply opening for supplying the toner to said developing roller provided in said toner accommodating portion;

(i) a developing blade mounting step of mounting said developing blade on said toner developer container having the cut-away portion sealed with the seal mounted thereto;

(j) a developing roller mounting step of mounting said developing roller on said toner developer container having the cut-away portion sealed with the seal mounted thereto;

said toner accommodating portion of said toner developing container having said seal, said developing blade, and said developing roller, through the toner supply opening of said toner developing container having said seal; and (k) a container coupling step of coupling said toner developing container having said seal, said developing blade, and said developing roller with said cleaning container having said electrophotographic photosensitive drum by engaging said pins into them.

21. A method according to claim 16 or 20, wherein said seal is mounted on said toner developing container after said developing blade dismounting step.

22. A method according to claim 16 or 20, wherein said seal is made of sponge or a plastically deformable material.

23. A method according to claim 16 or 20, wherein in said developing blade mounting step, a new developing blade or a used developing blade is mounted.

24. A method according to claim 16 or 20, wherein in said developing roller mounting step, a new or used developing roller is mounted.

25. A method according to claim 16 or 20, wherein prior to said container coupling process, said electrophotographic photosensitive drum and a cleaning blade are dismounted from said cleaning container, and toner which has been removed from said electrophotographic photosensitive drum and accommodated in said cleaning container, is removed.

26. A method according to claim 25, wherein after the toner is removed, a new or used electrophotographic photosensitive drum and a new or used cleaning blade are mounted.

27. A method according to claim 16 or 20, wherein said remanufacturing method is implemented with a toner seal for sealing said toner supply opening provided to supply the toner accommodated in said toner accommodating portion to said developing roller having been pulled out to supply toner accommodated in said toner accommodating portion to said developing roller.

28. A method according to claim 16 or 20, wherein said process cartridge comprises a gear fixed co-axially with said electrophotographic photosensitive drum and a gear fixed co-axially with said developing roller, which gears are in meshing engagement, and wherein after said container coupling process, said toner developing container and said cleaning container are rotated about said pins to disengage said gears from each other or to make a back clearance of the meshing engagement larger than that during an image forming operation, and the disengagement or larger back clearance is maintained.

29. A method according to claim 28, wherein said toner developing container and said cleaning container are rotated toward each other about said pins at a portion across said pins from said electrophotographic photosensitive drum, and a tape is stuck on said toner developing container and said cleaning container to maintain the disengagement or the larger back clearance.

* * * * *

UNITED STATES PATENT AND TRADEMARK OFFICE

CERTIFICATE OF CORRECTION

PATENT NO. : 6,397,025 B1
DATED : May 28, 2002
INVENTOR(S) : Akira Higeta et al.

It is certified that error appears in the above-identified patent and that said Letters Patent is hereby corrected as shown below:

Column 7,
Line 20, “comers” should read -- corners --.

Column 15,
Line 26, “comer” should read -- corner --.

Column 16,
Line 13, “comers” should read -- corners --.
Line 51, “comer” should read -- corner --.

Column 24,
Line 54, “51 a” should read -- 51a --.

Column 25,
Line 8, “5” should be deleted.

Column 29,
Line 5, “used developing roller” should read -- said toner refilling step, a flexible sheet to said toner developing container so as to extend along the longitudinal direction of said developing roller when said developing roller is mounted to said toner developing container. --
Line 6, “is mounted.” should be deleted.

Signed and Sealed this

Eighteenth Day of March, 2003

JAMES E. ROGAN
*Director of the United States Patent and Trademark Office*